US012453393B2

(12) United States Patent
Duffy et al.

(10) Patent No.: US 12,453,393 B2
(45) Date of Patent: Oct. 28, 2025

(54) GOLF SHOE WITH SPRING PLATE

(71) Applicant: Acushnet Company, Fairhaven, MA (US)

(72) Inventors: Keith M. Duffy, Whitman, MA (US); Robert S. Bento, Raynham, MA (US); Jean-Marie Bidal, Marlborough, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 18/476,707

(22) Filed: Sep. 28, 2023

(65) Prior Publication Data

US 2024/0130466 A1 Apr. 25, 2024
US 2024/0225183 A9 Jul. 11, 2024

Related U.S. Application Data

(63) Continuation-in-part of application No. 17/970,817, filed on Oct. 21, 2022.

(60) Provisional application No. 63/490,070, filed on Mar. 14, 2023.

(51) Int. Cl.

| | |
|---|---|
| ***A43B 13/18*** | (2006.01) |
| ***A43B 5/00*** | (2022.01) |
| ***A43B 13/02*** | (2022.01) |
| ***A43B 13/12*** | (2006.01) |

(52) U.S. Cl.

CPC ..... *A43B 13/186* (2013.01); *A43B 5/001* (2013.01); *A43B 13/026* (2013.01); *A43B 13/122* (2013.01); *A43B 13/125* (2013.01)

(58) Field of Classification Search

CPC ... A43B 13/188; A43B 13/186; A43B 13/183; A43B 13/125; A43B 13/122; A43B 13/026; A43B 5/001

USPC ..... 36/107, 108

See application file for complete search history.

(56) References Cited

U.S. PATENT DOCUMENTS

| | | | |
|---|---|---|---|
| 6,763,611 | B1 | 7/2004 | Fusco |
| 6,775,930 | B2 | 8/2004 | Fuerst |
| 6,860,034 | B2 | 3/2005 | Schmid |
| 7,096,605 | B1 | 8/2006 | Kozo et al. |
| 7,276,191 | B2 | 10/2007 | Park |
| 7,421,805 | B2 | 9/2008 | Geer |
| 7,434,337 | B2 | 10/2008 | Gibert et al. |
| 8,353,968 | B2 | 1/2013 | King et al. |
| 8,510,970 | B2 | 8/2013 | Baum et al. |
| 8,789,295 | B2 | 7/2014 | Burch et al. |
| 8,943,708 | B2 | 2/2015 | Spiller et al. |
| 8,984,775 | B2 | 3/2015 | Dombrow et al. |
| 9,282,785 | B2 | 3/2016 | Grondin |
| 9,462,845 | B2 | 10/2016 | Auger et al. |
| 9,578,920 | B2 | 2/2017 | Grott et al. |
| 9,610,746 | B2 | 4/2017 | Wardlaw et al. |

(Continued)

FOREIGN PATENT DOCUMENTS

| | | |
|---|---|---|
| DE | 102020101703 | 7/2021 |
| WO | 2015138815 | 9/2015 |
| WO | 2017123726 | 7/2017 |

*Primary Examiner* — Haley A Smith

(57) ABSTRACT

A golf shoe with an upper and a sole assembly connected to the upper. The sole assembly may include a midsole and an outsole. In some cases, a custom insert may be integrated with or embedded in the sole assembly. In some cases, the custom insert may include an elastic member configured as a spring element.

20 Claims, 35 Drawing Sheets

(56) References Cited

U.S. PATENT DOCUMENTS

| | | | | |
|---|---|---|---|---|
| 9,820,529 | B2 | 11/2017 | Droege et al. | |
| 9,849,645 | B2 | 12/2017 | Wardlaw et al. | |
| 9,883,714 | B2 | 2/2018 | Cavaliere et al. | |
| 9,907,353 | B2 | 3/2018 | Lester et al. | |
| 9,943,432 | B1 | 4/2018 | Butler | |
| 9,956,732 | B2 | 5/2018 | Murphy et al. | |
| 9,974,358 | B2 | 5/2018 | Miner | |
| 10,016,919 | B2 | 7/2018 | Cook et al. | |
| 10,463,103 | B2 | 11/2019 | Hayes et al. | |
| 10,932,521 | B2 | 3/2021 | Perrault et al. | |
| 10,974,447 | B2 | 4/2021 | Constantinou et al. | |
| 11,241,826 | B2 | 2/2022 | Constantinou et al. | |
| 11,730,228 | B2 * | 8/2023 | Diard | A43B 13/143 36/28 |
| 12,022,912 | B2 * | 7/2024 | Diard | A43B 3/0068 |
| 2003/0051372 | A1 | 3/2003 | Lyden | |
| 2011/0146110 | A1 | 6/2011 | Geer | |
| 2012/0246969 | A1 * | 10/2012 | Baum | A43B 13/188 36/27 |
| 2016/0044992 | A1 | 2/2016 | Reinhardt et al. | |
| 2019/0037969 | A1 | 2/2019 | Busbee et al. | |
| 2019/0200699 | A1 * | 7/2019 | Ghiotti | A43B 17/006 |
| 2021/0177093 | A1 | 6/2021 | Perrault et al. | |
| 2021/0378360 | A1 * | 12/2021 | Escowitz | A43B 13/181 |
| 2022/0039506 | A1 * | 2/2022 | Diard | A43B 13/143 |
| 2023/0157408 | A1 | 5/2023 | Tribus | |

* cited by examiner

GOLF SHOE WITH SPRING PLATE

CROSS REFERENCE

This application claims priority to U.S. Provisional Patent Application No. 63/490,070 filed on Mar. 14, 2023 and is a Continuation-in-Part of co-pending, co-assigned U.S. patent application Ser. No. 17/970,817 filed on Oct. 21, 2022, each of which is incorporated herein by reference in its entirety for all purposes.

BACKGROUND

The sport of golf can involve a variety of actions that a subject (e.g., a golfer) can perform, such as swinging a golf club, walking a golf course, and/or crouching down to line up a putt. The equipment used to play golf can affect how well a golfer performs or executes golf-related actions or movements.

Golf shoes are one example of a piece of equipment that can affect performance. When a golfer executes a golf-related action, there are a number of forces that can be exerted on the sole assembly of the golf shoe and/or the ground surface under the golf shoe. In some cases, the forces exerted during the golf-related action can cause the shoe to move or respond in a manner that is unintentional or undesired, which can negatively impact performance.

SUMMARY

Recognized herein are various shortcomings and disadvantages of conventional golf shoes and traditional methods of manufacturing golf shoes. Some golf shoes may include an insert that can be placed in a sole assembly of the golf shoe to control shoe movement (e.g., flexing of the sole assembly or translational or rotational motions of the sole assembly relative to the ground surface) and/or sole response (e.g., sole deformation in response to forces exerted on the midsole or the sole assembly). However, given the existing challenges around efficiently manufacturing a shoe with an insert that is sized and optimized to impart one or more desired structural properties in a sole assembly, commercially available shoes typically use simplistic insert geometries or configurations. Such simplistic geometries and configurations might impart a limited number of favorable material characteristics in the sole assembly, but may not provide the full range of performance characteristics needed for a high performance golf shoe. Conventional inserts are also inherently limited because they are not customized to a specific individual's anatomy and/or swing biomechanics in order to optimize golf performance.

The present disclosure addresses the abovementioned shortcomings and disadvantages of conventional golf shoes by providing various examples of customizable inserts with geometries and structural configurations that are optimized for golf-related actions or movements. The present disclosure also addresses the inherent shortcoming and disadvantages of conventional inserts for golf shoes by providing various examples of systems and methods for manufacturing golf shoes with inserts that are customized to an individual subject's particular anatomy and/or biomechanics. The present disclosure further addresses the shortcoming and disadvantages of conventional methods for manufacturing golf shoes by providing various exemplary methods for fabricating or producing golf shoes comprising midsoles and/or sole assemblies with various complex 3D structures (e.g., inserts, endoskeletons, etc.) that are impossible, impractical, and/or extremely difficult to integrate or embed in midsoles or sole assemblies using traditional methods. The complex 3D structures disclosed herein may have an optimal geometry that is customized for a particular individual's anatomy and/or swing biomechanics to provide a wide range of favorable performance characteristics compared to other conventional shoes with more simplistic insert geometries and configurations.

In some embodiments, the custom inserts described herein may be configured to (1) comfortably support loads exerted on the sole assembly during golf-related movements, (2) preserve the torsional stiffness of the sole assembly, (3) maintain favorable flex characteristics in transverse and/or longitudinal directions, (4) enhance traction with various ground surfaces, and/or (5) control a deformation of the midsole or sole assembly in response to one or more forces exerted on the midsole or sole assembly during a golf-related movement.

In some embodiments, the custom inserts described herein may allow a sole assembly to flex or deform during a golf-related movement in order to control, guide, and/or manage (i) a movement of a subject's feet during the golf-related movement, (ii) a distribution of one or more forces across the shoe to facilitate or execute the golf-related movement, and/or (iii) a direction or a magnitude of the one or more forces exerted on (a) the shoe or any components thereof or (b) a ground surface underneath the shoe. In some embodiments, the inserts described herein may allow a sole assembly to flex or deform in a predetermined or desired manner based on (1) the unique anatomical or biomechanical characteristics of the subject wearing the shoe and/or (2) the unique properties or characteristics of the subject's swing.

In some embodiments, the inserts described herein may allow a sole assembly to flex or deform in a manner that is optimal for a particular subject, based on his or her swing type, swing speed, anatomy, or biomechanical characteristics. In some embodiments, the inserts described herein may allow a sole assembly to flex or deform optimally for a particular subject even if the subject is executing a golf-related action in a manner that is sub-optimal for the subject given his or her swing type, swing speed, anatomy, or biomechanical characteristics. In some cases, a sub-optimal execution of the golf-related action may involve an actual movement by the subject that deviates from an optimal movement that can provide (i) maximum consistency, e.g., tighter ball dispersions and/or (ii) maximum performance, e.g., longer carry distances. The actual movement or the optimal movement may include, for example, a movement of the subject's arms or wrists, a rotation of a subject's body (hips, waist, etc.), a change in weight distribution across the subject's feet, or a pivoting of the subject's feet during a golf swing. In some cases, a sub-optimal execution of the golf-related action may involve a deviation between an actual posture of the subject and an optimal posture that can provide (i) maximum consistency and/or (ii) maximum performance. The actual posture or the optimal posture may include, for example, a position or an orientation of the subject's feet relative to a golf ball or a ground surface, and/or a position or an orientation of a first body part of the subject relative to a second body part of the subject. In some non-limiting embodiments, the sub-optimal execution of the golf-related action may be associated with a sub-optimal loading profile on the midsole of the shoe or a ground surface underneath the shoe. In some cases, the sub-optimal loading profile may involve a sub-optimal application or exertion of pressure on the midsole or the ground surface before, during, and/or after a golf-related movement. In some cases, the sub-optimal loading profile may involve a sub-optimal change in the application or exertion of pressure on the ground surface or various portions of the midsole over a period of time. In some cases, the sub-optimal loading profile may involve a sub-optimal application or exertion of pressure on one or more portions or regions of the midsole before, during, and/or after a golf-related movement. The sub-optimal application or exertion of pressure may involve the application or exertion of one or more forces (either at various regions of the midsole and/or at various time points over a select period of time) with a magnitude or a direction that deviates from an optimal magnitude or direction that can translate to or facilitate a golf-related movement with (i) maximum consistency and/or (ii) maximum performance.

In some embodiments, the inserts described herein may allow a sole assembly to flex or deform in a controlled or predictable manner in order to assist with a subject's golf swing, regardless of any deviations between the actual movements or posture of the subject and the movements or posture which may be considered optimal for the subject given his or her swing type, swing speed, anatomy, or biomechanical characteristics. In some embodiments, the inserts described herein may allow a sole assembly to flex or deform in a controlled or predictable manner for multiple subjects in order to assist with their golf swings, regardless of any differences in or variations between each subject's swing type, swing speed, anatomy, biomechanical characteristics, or personal preferences for golf-related movements or postures.

In any of the embodiments described herein, the inserts of the present disclosure may provide different suspension characteristics in or along different zones of the sole assembly. The suspension characteristics may be associated with, for example, a resistance of the sole material to compressive forces exerted on the sole assembly, or a reactionary spring force provided by the sole material in response to various forces exerted on the sole assembly during a golf-related movement. In some cases, the suspension characteristics for the different zones can be optimized based on a subject's bodily characteristics (e.g., weight, stature, foot shape or profile, center of gravity or center of mass, etc.) and/or the subject's preferences for comfort, fit, and/or performance. In some cases, the suspension characteristics for the different zones can be optimized for a variety or a range of different subjects with different bodily characteristics or different preferences for comfort, fit, and/or performance.

In any of the embodiments described herein, the insert geometry and/or the insert material may provide or impart a desired set of properties or characteristics to the sole assembly. The desired set of properties or characteristics may include, for example, torsional stiffness, torsional rigidity, flexural stiffness, flexural rigidity, hardness, tensile strength, or any of the other material properties described elsewhere herein. In some non-limiting embodiments, the insert geometry and/or the insert material may favor a particular set of torsional characteristics for the sole assembly. In some cases, the particular set of torsional characteristics may be biased in eversion (i.e., the torsional characteristics may promote or facilitate the tilting of the sole of the foot outwards, away from the midline of the body during a golf-related movement). In other cases, the particular set of torsional characteristics may be biased in inversion (i.e., the torsional characteristics may promote or facilitate the tilting of the sole of the foot inwards towards the midline of the body during a golf-related movement). In some cases, the particular set of torsional characteristics may be directionally neutral (i.e., the torsional characteristics may not be biased in either inversion or eversion, or may be biased equally in eversion and inversion).

In any of the embodiments described herein, the insert geometry and/or the insert material may assist with a golfer's specific/unique swing characteristics and effectively (1) realign a golfer's swing with an optimal swing path or trajectory, (2) align a golfer's body or movements with an optimal posture and/or an optimal set of movements in or along one or more optimal axes or planes in three-dimensional space, and/or (3) compensate for any deviations or variations between (a) the golfer's actual posture or movements and (b) the optimal posture or the optimal set of movements for the golfer. In any of the embodiments described herein, the insert geometry and/or the insert material may be configured to reduce the occurrence or likelihood of any undesirable shot trajectories (e.g., pull, push, hook, and/or slice) that may result from the actual movements or posture of a particular golfer (whether preferred or unintentional).

In one aspect, the present disclosure provides a method for generating a custom insert. In some cases, the custom insert is configured to (i) adjust a biomechanical aspect or feature of the subject's golf swing and (ii) enhance a performance metric associated with the subject's golf swing.

In some embodiments, the method may comprise (a) processing one or more signals from a sensor-based tracking or detection system to obtain data associated with one or more golf swings executed by a subject wearing a reference shoe, wherein the data includes information on (i) forces exerted on the reference shoe or a ground surface contacting the reference shoe, (ii) shoe movement or traction in response to said forces exerted on the reference shoe or the ground surface, and (iii) ball carry distance or ball dispersion. In some embodiments, the method may comprise (b) selecting one or more target attributes for one or more tunable parameters of (i) the reference shoe or (ii) a target shoe that is different than the reference shoe, based on the data obtained in (a). In some embodiments, the one or more target attributes include a target material property or a target structural configuration that enhances energy transfer, control, and stability during the subject's golf swing. In some embodiments, the one or more tunable parameters correspond to a material property or a structural configuration of the reference shoe or the target shoe. In some embodiments, the method may comprise (c) using a shoe insert customization algorithm to generate a model or a set of instructions for manufacturing a custom insert for the reference shoe or the target shoe, wherein the custom insert is configured to replicate in the reference shoe or the target shoe the one or more target attributes selected in (b) in order to enhance energy transfer, control, and stability during the subject's golf swing.

In some cases, the shoe insert customization algorithm is configured to generate the model by modifying a reference insert model. In some cases, modifying the reference insert model involves changing a shape, profile, material composition, or structural configuration of the reference insert model based on the data obtained in (a). In some cases, modifying the reference insert model involves changing a shape, profile, material composition, or structural configuration of the reference insert model based on an anatomy of the subject or a biomechanical aspect or feature of the subject's golf swing. In some cases, modifying the reference insert model involves changing a shape, profile, material composition, or structural configuration of the reference insert model based on a size, a shape, a structural configuration, and/or a material composition of the target shoe.

In some cases, the shoe insert customization algorithm is configured to generate the set of instructions by modifying one or more reference instructions for manufacturing a reference insert. In some cases, the one or more reference instructions are modified based on (i) the data obtained for the one or more golf swings executed by the subject, (ii) an anatomical feature of the subject or a biomechanical aspect or feature of the subject's golf swing, and/or (iii) a size, a shape, a structural configuration, or a material composition of the target shoe.

In some cases, the method may further comprise, prior to (c), obtaining additional data associated with the subject's golf swing to verify or validate the one or more target attributes selected in (b). In some cases, the method may further comprise updating the one or more target attributes based on the additional data, and using the one or more updated target attributes to generate the model or the set of instructions in (c). In some cases, the method may further comprise, subsequent to (c), computing a shots gained metric based on a comparison between a performance of the subject in the target shoe versus the reference shoe.

In some embodiments, the data used to customize the insert may comprise information associated with or derived from club speed, club path, club face angle, attack angle, swing plane, swing path, or swing direction. In some embodiments, the data may comprise information associated with or derived from ball speed, launch angle, launch direction, spin rate, spin axis, ball flight trajectory, carry distance, landing angle, roll distance, or roll speed.

In some embodiments, the material property corresponds to a hardness, a stiffness, or a flexibility of one or more portions of the reference shoe or the target shoe. In some embodiments, the structural configuration corresponds to (i) a size or a shape of a functional element or layer within the reference shoe or the target shoe or (ii) a position or an orientation of the functional element or layer within the reference shoe or the target shoe.

In some embodiments, the reference shoe comprises a functional insert. In other embodiments, the reference shoe does not comprise a functional insert or any other internal structure integrated with or embedded in a midsole of the reference shoe. In some embodiments, the reference shoe and the target shoe comprise a same or similar shoe or type of shoe. In other embodiments, the reference shoe and the target shoe comprise different shoes or different types of shoes.

In another aspect, the present disclosure provides a golf shoe comprising an upper and a sole assembly connected to the upper. In some embodiments, the sole assembly comprises a midsole with an insert integrated therein, wherein the insert comprises a continuous structure extending between (i) a medial or lateral side of a forefoot region of the sole assembly and (ii) a lateral or medial side of a rearfoot region of the sole assembly to stiffen the forefoot and rearfoot regions of the shoe.

In some embodiments, the continuous structure comprises a first set of symmetric arms extending between a midfoot region of the sole assembly and the forefoot region of the sole assembly and a second set of symmetric arms extending between the midfoot region of the sole assembly and the rearfoot region of the sole assembly. In some embodiments, the first set of arms comprises a first arm and a second arm that extend away from each other to provide a longitudinally flexible forefoot region between the first arm and the second arm. In some embodiments, the second set of arms comprises a third arm and a fourth arm that extend away from each other to provide a longitudinally flexible rearfoot region between the third arm and the fourth arm.

In some embodiments, the first arm and the second arm comprise one or more curved segments extending along the lateral or medial side of the forefoot region. In some embodiments, the third arm and the fourth arm comprise one or more curved segments extending along the lateral or medial side of the rearfoot region. In some embodiments, the first and second sets of arms collectively form an X-shaped member.

In some embodiments, the midsole includes a medial plantar region comprising a foam material with an adaptable hardness or stiffness that varies based on a force exerted on the sole assembly. In some embodiments, the foam material is configured to provide a first hardness or stiffness in response to a first force exerted on the foam material and a second hardness or stiffness in response to a second force exerted on the foam material. In some embodiments, the first force is less than a threshold force, and the second force is greater than the threshold force, wherein the threshold force ranges from about 800 pounds of force (lbs-force) to about 1200 lbs-force. In some embodiments, the first hardness or stiffness is less than the second hardness or stiffness. In some embodiments, the midsole includes a lateral plantar region or a medial tibial region with a greater hardness or stiffness than a lateral tibial region of the midsole.

In another aspect, the present disclosure provides a golf shoe comprising an upper and a sole assembly connected to the upper, wherein the sole assembly comprises a midsole with an insert integrated therein. In some embodiments, the insert comprises a continuous structure extending between (i) a medial or lateral side of a forefoot region of the sole assembly and (ii) a lateral or medial side of a rearfoot region of the sole assembly to stiffen the forefoot and rearfoot regions of the shoe. In some embodiments, the continuous structure comprises a first curved segment extending along the medial or lateral side of the forefoot region and a second curved segment extending along the lateral or medial side of the rearfoot region. In some embodiments, the first curved segment and the second curved segment form an S-shaped member configured to provide an elastic response during one or more golf-related movements executed by a subject wearing the golf shoe.

In some embodiments, a first end of the continuous structure is positioned towards a medial side of the forefoot region of the shoe, and a second end of the continuous structure is positioned towards a lateral side of the rearfoot region of the shoe. In some embodiments, a first end of the continuous structure is positioned towards a lateral side of the forefoot region of the shoe, and a second end of the continuous structure is positioned towards a medial side of the rearfoot region of the shoe.

In some embodiments, the continuous structure comprises a third segment extending from the first curved segment or the second curved segment. In some cases, the third segment may extend towards the forefoot region or the rearfoot region of the shoe.

In some embodiments, the continuous structure comprises a first concave curvature formed by the first curved segment and a second concave curvature formed by the second curved segment. In some embodiments, the first concave curvature is oriented towards the medial side of the shoe, and the second concave curvature is oriented towards the lateral side of the shoe. In some embodiments, the first concave curvature is oriented towards the lateral side of the shoe, and the second concave curvature is oriented towards the medial side of the shoe.

In some embodiments, the continuous structure includes one or more features. In some cases, the one or more features may include, for example, ribs, grooves, or cutouts.

In some embodiments, the continuous structure may be integrated with or embedded in a midsole of the shoe. In some embodiments, the continuous structure may be integrated with or embedded in a top layer, a middle layer, or a bottom layer of the midsole of the shoe.

In some embodiments, the midsole includes a medial plantar region comprising a foam material with an adaptable hardness or stiffness that varies based on a force exerted on the sole assembly. In some embodiments, the foam material is configured to provide a first hardness or stiffness in response to a first force exerted on the foam material and a second hardness or stiffness in response to a second force exerted on the foam material. In some embodiments, the first force is less than a threshold force, and the second force is greater than the threshold force, wherein the threshold force ranges from about 800 pounds of force (lbs-force) to about 1200 lbs-force. In some embodiments, the first hardness or stiffness is less than the second hardness or stiffness. In some embodiments, the midsole includes a lateral plantar region or a medial tibial region with a greater hardness or stiffness than a lateral tibial region of the midsole.

In another aspect, the present disclosure provides a golf shoe comprising an upper and a sole assembly connected to the upper, wherein the sole assembly comprises a midsole with an insert integrated therein, wherein the insert comprises a continuous structure extending between (i) a medial or lateral side of a forefoot region of the sole assembly and (ii) a lateral or medial side of a rearfoot region of the sole assembly to stiffen the forefoot and rearfoot regions of the shoe.

In some embodiments, the continuous structure comprises a first segment extending diagonally across a midfoot region of the sole assembly to stiffen the midfoot region of the shoe, a second segment extending from an upper midfoot portion of the first segment towards the medial or lateral side of the forefoot region of the sole assembly, and a third segment extending from a lower midfoot portion of the first segment towards the lateral or medial side of the rearfoot region of the sole assembly. In some embodiments, the second segment and the third segment each have a respective width that varies along a length of the sole assembly. In some embodiments, a first end of the continuous structure and a second end of the continuous structure are oriented in different directions. In some embodiments, at least one of the first end and the second end of the continuous structure is flat or substantially flat. In some embodiments, the first end of the continuous structure corresponds to a portion of the second segment that is proximal to and oriented towards an anterior end of the shoe. In some embodiments, the second segment is configured to extend from the first segment towards the anterior end of the shoe. In some embodiments, the second end of the continuous structure corresponds to a portion of the third segment that is proximal to and oriented towards a posterior end of the shoe. In some embodiments, the third segment is configured to extend from the first segment towards the posterior end of the shoe.

In some embodiments, the first segment and the second segment are disposed at an angle relative to each other, wherein the angle ranges from about 90 degrees to about 135 degrees. In some embodiments, the first segment and the third segment are disposed at an angle relative to each other, wherein the angle ranges from about 90 degrees to about 135 degrees.

In some embodiments, the continuous structure comprises a plurality of straight edges forming or defining a shape of the continuous structure. In some embodiments, the shape of the continuous structure does not include any curved edges or sides.

In some embodiments, the width of the second segment or the third segment decreases towards an anterior or posterior end of the sole assembly. In some embodiments, the second segment or the third segment may comprise an angular or pointed end.

In another aspect, the present disclosure provides a golf shoe comprising an upper and a sole assembly connected to the upper. In some embodiments, the sole assembly may comprise a midsole, an outsole, and an elastic member integrated with at least one of the midsole or outsole. In some embodiments, the elastic member may comprise a superior portion, an inferior portion, and at least one curved portion extending between the superior portion and the inferior portion.

In some embodiments, the superior portion of the elastic member may comprise a first member and a second member extending towards a posterior end of the sole assembly. In some embodiments, the first and second members may be spaced apart with a gap therebetween to facilitate a movement of the first and second members relative to each other or a movement of the first or second member relative to another portion of the elastic member. In some embodiments, the movement may comprise at least one of a rotational motion or a translational motion of the first or second member. In some embodiments, the gap may be configured to promote flexing of the elastic member along an axis extending between the first member and the second member. In some embodiments, the gap may be configured to provide a controlled torsional response for the elastic member during a golf swing.

In some embodiments, the superior portion of the elastic member may comprise a third member and a fourth member extending towards an anterior end of the sole assembly. In some embodiments, the third member and the fourth member may converge at or near the anterior end of the sole assembly.

In some embodiments, the at least one curved portion may comprise an anterior curved portion extending between an anterior end of the superior portion and an anterior end of the inferior portion. In some embodiments, the at least one curved portion may comprise at least one posterior curved portion extending between a posterior end of the superior portion and a posterior end of the inferior portion. In some embodiments, the superior portion and the inferior portion may be integrally formed with the anterior curved portion and the at least one posterior curved portion.

In some embodiments, the inferior portion may comprise a first set of arms extending from the anterior curved portion towards a break region located within a forefoot region of the sole assembly. In some embodiments, the break region may provide an axis along which the elastic member is configured to bend or flex. In some embodiments, the first set of arms may be configured to converge towards the anterior curved portion of the elastic member.

In some embodiments, the inferior portion may further comprise a second set of arms extending from the at least one posterior curved portion towards the break region. In some embodiments, the break region may be disposed between the first set of arms and the second set of arms to divide or bisect the inferior portion of the elastic member.

In some embodiments, the at least one posterior curved portion may comprise a first posterior curved portion and a second posterior curved portion connecting (i) the second set of arms of the inferior portion and (ii) the first and second members of the superior portion. In some embodiments, the first posterior curved portion and the second posterior curved portion may be remotely spaced to maintain the gap between the first and second members. In some embodiments, the gap may extend between the first and second posterior curved portions to divide and separate the posterior ends of both the superior and inferior portions of the elastic member.

In some embodiments, the inferior portion of the elastic member may comprise a shank region having a U-shaped or V-shaped profile. In some embodiments, the U-shaped profile may be formed by two or more sides or surfaces of the inferior portion that extend towards the superior portion of the elastic member to form a concave curvature. In some embodiments, the V-shaped profile may be formed by two or more sides or surfaces of the inferior portion that extend towards the superior portion of the elastic member to form a convex angle.

In some embodiments, the elastic member may comprise a molded carbon or composite component. In some embodiments, the molded carbon or composite component may include one or more curved fibers or strands extending along a linear or non-linear portion of the carbon or composite component.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

Non-limiting and non-exhaustive examples and embodiments of the present disclosure are described with reference to the following figures.

DETAILED DESCRIPTION

Figure 1:
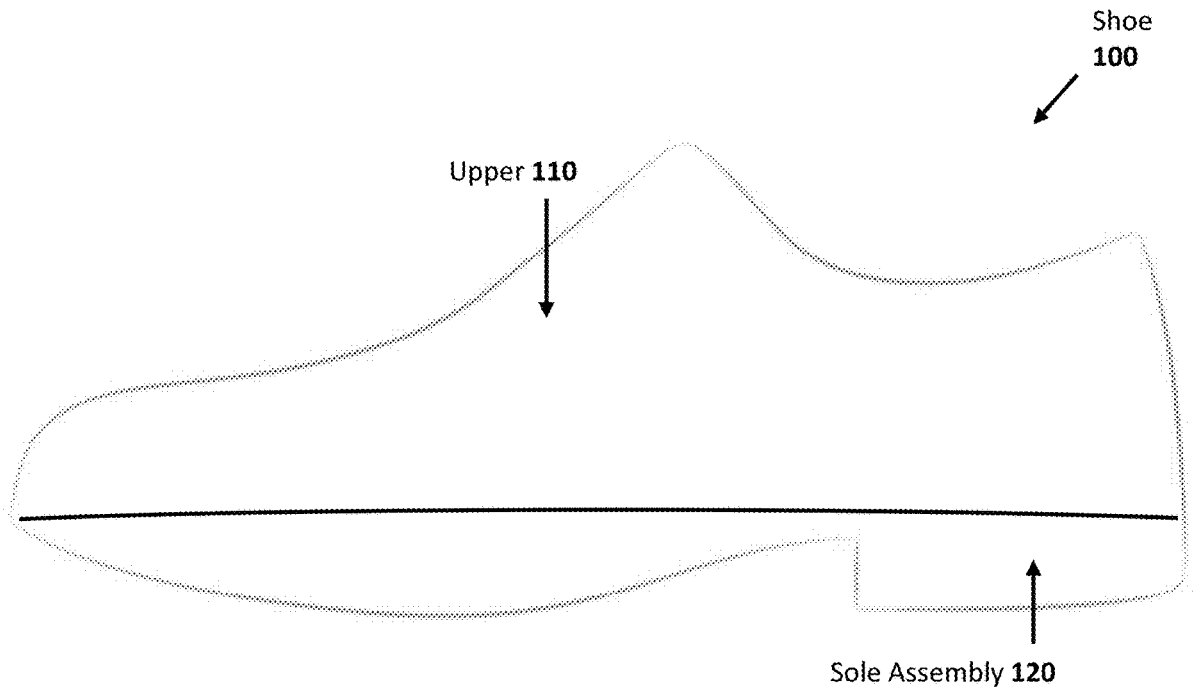
FIG. 1 schematically illustrates an exemplary golf shoe, in accordance with some embodiments.

The present disclosure will now be described more fully in reference to the accompanying figures, in which various non-limiting embodiments are shown. The views shown in the figures are of a right shoe and/or a left shoe, and it is understood that in some cases, the components for a left shoe can be mirror images of the right shoe, and vice versa. It should also be understood that the shoe(s) may be made in various sizes and thus the size and/or shape of the components or features of the shoe may be adjusted depending on the shoe size.

The terminology used herein is for the purpose of describing various embodiments only and is not intended to be limiting. As used herein, the singular forms "a," "an," and "the" are intended to include the plural forms as well, unless the context clearly indicates otherwise.

It shall be understood that when an element is referred to as being "attached," "coupled" or "connected" to another element, it can be directly attached, coupled or connected to the other element (with or without any intervening elements). In contrast, when an element is referred to as being "directly attached," directly coupled" or "directly connected" to another element, there may not or need not be any intervening elements present.

It is noted that any one or more aspects or features described with respect to one embodiment may be incorporated in various other different embodiments. That is, any embodiments and/or features of any embodiments can be combined in any way and/or in any order with any other embodiments and/or any other features of any embodiments, without limitation. Applicant reserves the right to modify any originally filed claim or file any new claim(s) accordingly, including the right to amend any originally filed claim to depend from and/or incorporate any feature of any other claim. Various non-limiting aspects and features of the present disclosure are provided in further detail in the specification set forth below.

Overview

The present disclosure provides various examples of golf shoes having structures (e.g., three-dimensional (3D) structures) that can be embedded in or integrated with a sole assembly (e.g., the midsole of a shoe) to enhance various material properties of the sole assembly, such as stiffness, rigidity, flexibility, and/or underfoot cushioning or support. In some embodiments, the structures may comprise a custom insert that is generated based on an individual subject's anatomy and/or biomechanics.

In some cases, the structures may be configured to distribute forces exerted on the sole assembly (e.g., during a golf-related movement) to different portions or regions of the shoe. The different portions or regions of the shoe may correspond to (i) a lateral and/or medial side of the shoe and/or (ii) a forefoot, midfoot, or rearfoot region of the shoe. In some cases, the forces exerted on the sole assembly may be distributed to an outsole region of the shoe (or to one or more traction elements coupled to the outsole region of the shoe) to improve traction on various different ground surfaces. In some cases, the structures disclosed herein may be configured to modulate or control (i) the movement of a golfer's feet during a golf-related action and (ii) a deformation or flexing of the sole assembly in response to forces exerted by the golfer's feet during the golf-related action, in order to provide a comfortable, high-performance sole assembly for golfers. In some cases, the structures may be configured to modulate or control a subject's stance and/or swing biomechanics (e.g., before, during, and/or after a golf-related movement or action).

Golf Shoe

In an aspect, the present disclosure provides a golf shoe. The golf shoe may comprise an article of footwear (e.g., a shoe) that can be worn by a subject to aid in a physical activity such as golf, or any other physical activity involving one or more actions or movements that can be used in the sport of golf.

The golf shoe may be worn by a subject. The subject may be, for example, an athlete or a golf player. When worn by the subject, the golf shoe may provide an optimal balance of comfort and control that allows the subject to focus on his or her game and maximize performance. The golf shoe may be sized, shaped, and configured to support the subject's foot and/or control a movement of the subject's foot during a golf-related movement to enhance (i) comfort, (ii) stability, and/or (iii) the subject's posture, stance, swing, stability, or overall performance (e.g., accuracy or precision).

FIG. 1 depicts an exemplary golf shoe 100, also referred to herein as a shoe. In some embodiments, the shoe 100 may comprise a shoe upper 110 and a sole assembly 120. In some cases, the upper 110 may include an insole. The insole may comprise an insole component such as an insole footbed and/or an insole board. In some cases, the sole assembly 120 may include a midsole and/or an outsole. In some cases, the sole assembly may be connected to the upper.

Upper

In some embodiments, the golf shoe 100 may comprise an upper 110. In some cases, the upper 110 may comprise a vamp for covering at least a forefoot region of a subject's foot. In some cases, the upper 110 may comprise a quarter for covering and/or supporting one or more side or rear portions of a subject's foot (e.g., the area adjacent to, surrounding, and/or below the Achilles tendon, the posterior of the heel, and/or the talus and calcaneus bones).

In some embodiments, the heel region of the quarter may comprise a heel cup. In some cases, the heel cup may comprise a molded heel cup. In some embodiments, at least a portion of the quarter may form a part of the molded heel cup. In some embodiments, the quarter may comprise a plurality of layers that can be molded together to form the heel cup.

In some embodiments, the vamp and the quarter may comprise separate pieces of material that are connected or fused to each other mechanically, chemically, thermally, or adhesively. In some cases, the upper material may comprise various materials that are stitched or bonded together to form the upper structure.

In some embodiments, the upper 110 may comprise a continuous piece of material for the vamp and quarter. In some cases, the continuous piece of material may comprise a single material comprising a plurality of regions each having different material properties. In other cases, the continuous piece of material may comprise a plurality of materials having different material properties. The material properties associated with the plurality of regions or the plurality of materials may include, for example, density, porosity, water absorbency/repellence, strength, flexibility, elasticity, softness, durability, chemical resistance, thermal conductivity, and the like.

In some cases, the upper 110 may comprise, for example, natural leather, synthetic leather, knits, woven materials, non-woven materials, natural fabrics, and/or synthetic fabrics. In other cases, the upper 110 may comprise a breathable mesh and/or synthetic textile fabrics made from materials such as nylons, polyesters, polyolefins, polyurethanes, rubbers, foams, or any combinations thereof. The material of the upper 110 may be selected and/or optimized based on desired properties such as breathability, durability, flexibility, comfort, and/or water resistance.

In some embodiments, the shoe 100 may be waterproof. In some cases, at least a forefoot, midfoot, and/or rearfoot area of the upper may be constructed of one or more materials or layers (e.g., membranes) having water resistant or water repellent properties. Additional features (e.g., non-porous or semi-porous membranes that permit a selective movement or passage of moisture) may be applied when fabricating the shoe 100 to provide additional waterproofing capabilities.

In some embodiments, the upper 110 may comprise an instep region with an opening for inserting a subject's foot. In some cases, the instep region may include a tongue member. In some embodiments, the upper 110 may comprise a heel collar extending around at least a portion of the opening. The heel collar may be configured to provide enhanced comfort and fit.

In some embodiments, the upper 110 may comprise an insole component (e.g., an insole footbed or an insole board). In some cases, the insole component may be designed to provide support for a subject's foot (e.g., as the subject exerts a force on the insole while walking, running, kneeling, squatting, or executing a swing). The insole component may be flexible, semi-rigid, or rigid. In some cases, the insole component may be a removable insert that can be positioned within the shoe 100. In some examples, the insole component can be worn inside the shoe 100 and may be designed to provide cushioning or support for the subject wearing the shoe 100.

In some embodiments, the forefoot region of the upper 110 may comprise an eye stay that can be attached to the vamp. In some cases, the eye stay may cover at least a portion of the tongue member. In some cases, the eye stay may comprise one or more eyelets through which one or more tightening devices or mechanisms can be threaded.

In any of the embodiments described herein, a variety of tightening systems or mechanisms can be used to secure the shoe 100 around the contour of the foot. In some cases, laces of various types of materials (e.g., natural or synthetic fibers, metal cable) may be used to tighten the shoe and/or to secure the shoe in a desired position and/or orientation relative to the subject's foot. In some cases, the shoe 100 may include a metal cable (lace)-tightening assembly that may comprise a dial, spool, and housing and locking mechanism for locking the cable in place.

Sole Assembly

In some embodiments, the golf shoe 100 may comprise a sole assembly 120. The sole assembly 120 may comprise a midsole and/or an outsole. In some cases, the sole assembly 120 may be connected to the upper 110.

In some embodiments, the sole assembly 120 may comprise a midsole. The midsole may comprise a relatively lightweight material configured to provide cushioning and/or support to the shoe 100. In some embodiments, the midsole may be made from one or more midsole materials such as, for example, a foam material. In some cases, the foam material may comprise a material (e.g., a molding agent) that is foamed using a foaming agent. In some case, the foam material may comprise a material that comprises a foam or foam-like structure. In some cases, the foam material may comprise an open cell foam comprising one or more open or partially open cells. In other cases, the foam material may comprise a closed cell foam comprising one or more closed or partially closed cells. In some non-limiting embodiments, the foam material may comprise an elastic foam. The elastic foam may include, for example, ethylene vinyl acetate copolymer (EVA), an elasticized closed-cell foam with rubber-like softness and flexibility. In other non-limiting embodiments, the foam material may comprise a viscous foam. The viscous foam may include, for example, a polyurethane foam or a polyethylene foam. In some alternate embodiments, the foam material may comprise a viscoelastic foam. The viscoelastic foam may have the elastic properties of an elastic foam and/or the viscous properties of a viscous foam. In some cases, the viscoelastic foam may comprise a memory foam or a memory foam-like material. In any of the embodiments described herein, the midsole may comprise a plurality of different foam materials (e.g., foamed ethylene vinyl acetate copolymer (EVA) and/or foamed polyurethane compositions). In any of the embodiments described herein, the foam material (described with respect to the midsole above or the outsole below) may not or need not comprise particles of an expanded material that are compressed, melted or fused together, or adhesively coupled to form the midsole or the outsole.

In some embodiments, the sole assembly 120 may comprise an outsole. The outsole may be designed to provide support and traction for the shoe. In some embodiments, the outsole may be integrated with the midsole. For example, the midsole may be fused with the outsole or otherwise attached to outsole (e.g., using an adhesive or as part of a manufacturing process for the midsole and/or the outsole). In some cases, the midsole can be molded as a separate piece and then joined to a top surface of the outsole by stitching, adhesives, or other suitable means. For example, the midsole can be heat-pressed and bonded to the top surface of the outsole. In some examples, the midsole and the outsole can be molded using a multi-shot molding method. In any of the embodiments described herein, the midsole may be positioned above the outsole such that at least a portion of the midsole is between a subject's foot and the outsole.

In some embodiments, the outsole may comprise an outsole material. In some cases, at least a portion of the outsole material may be configured to grip or otherwise engage a ground surface underneath the shoe (e.g., during a golf-related action or movement). In some embodiments, the outsole material may include, for example, thermoplastics such as nylons, polyesters, polyethers, polyolefins, and/or polyurethanes. In some non-limiting embodiments, the outsole material may include polyurethane compositions such as, for example, Estane® TRX thermoplastic polyurethanes. In some embodiments, the outsole material may include a rubber material or a thermoplastic rubber material, such as polybutadiene, polyisoprene, ethylene-propylene rubber ("EPR"), ethylene-propylene-diene ("EPDM") rubber, and/or styrene-butadiene rubber. In some embodiments, the outsole material may comprise a plastic material, a thermoplastic material, a thermoset plastic material, or any combination thereof. In some non-limiting embodiments, the outsole material may comprise acrylic, polymethyl methacrylate (PMMA), polycarbonate (PC), polyethylene (PE), polypropylene (PP), polyethylene terephthalate (PET), polyvinyl chloride (PVC), or acrylonitrile-butadiene-styrene (ABS).

In some embodiments, a bottom surface of the outsole may include a plurality of traction members configured to provide traction between the shoe 100 and the different surfaces of a golf course/range or other ground surfaces near a course/range. In some embodiments, the traction members may comprise any suitable material such as, for example, rubbers, plastics, and combinations thereof. Thermoplastics such as nylons, polyesters, polyolefins, and polyurethanes can also be used in combination or interchangeably. In some embodiments, the traction members may comprise thermoplastic polyurethane (TPU). Alternatively, different polyamide compositions including polyamide copolymers and/or aramids can be used to form the traction members. In one example, an elastomer comprising block copolymers of rigid polyamide blocks and soft polyether blocks can be used.

In some embodiments, the plurality of traction members may comprise spikes (e.g., hard spikes or soft spikes). The spikes may comprise a protrusion that is configured to at least partially penetrate or otherwise physically interface with or contact a ground surface.

In some embodiments, the plurality of traction members may not or need not comprise any spikes. For example, the traction members may comprise a grooved or textured surface or material that is configured to reduce a lateral or translational movement of the shoe relative to a ground surface when a force is exerted on the sole assembly of the shoe. In some cases, the grooved or textured surface may have a higher coefficient of friction (static and/or dynamic frictional coefficient) than other portions of the outsole. In some embodiments, at least one of the plurality of traction members may be removable or detachable from the outsole. In other embodiments, at least one of the plurality of traction members may be permanently attached or coupled to the outsole or another portion of the sole assembly. In some alternative embodiments, the outsole may not or need not comprise any traction elements.

Foot Subregions

In any of the embodiments described herein, the upper and/or the sole assembly and/or any components thereof (e.g., the insole footbed, the insole board, the midsole, and/or the outsole) may comprise a forefoot region, a midfoot region, and a rearfoot region. Each of the forefoot region, the midfoot region, and the rearfoot region may correspond to a respective forefoot, midfoot, and rearfoot anatomy of a subject's foot. In general, the anatomy of a human foot can be divided into three bony regions. The rearfoot region of the foot may include the ankle (talus) and heel (calcaneus) bones. The midfoot region of the foot may include the cuboid, cuneiform, and navicular bones that form the longitudinal arch of the foot. The forefoot region of the foot may include the metatarsals and the toes. The shoe, and accordingly, the components of the upper and/or the sole assembly (e.g., the insole footbed, the insole board, the midsole, and/or the outsole), may comprise a rearfoot region corresponding to the rearfoot and/or heel area, a midfoot region that corresponds to the midfoot, and a forefoot region corresponding to the forefoot and/or toe area.

In some cases, the rearfoot region (and heel area) can correspond to a posterior end of the shoe. In some cases, the forefoot area, including the toe area, can correspond to an anterior end of the shoe. In some cases, the midfoot area can correspond to a portion of the shoe that is between the anterior end and the posterior end of the shoe.

In addition to having a rearfoot region, midfoot region, and forefoot region, the shoe, and accordingly, the components of the upper and/or the sole assembly (e.g., the insole footbed, the insole board, the midsole, and/or the outsole), may also have a medial side and a lateral side that are opposite one another. The medial side may generally correspond to an inside area of the wearer's foot and a surface that faces towards the wearer's other foot. The lateral side may generally correspond to an outside area of the wearer's foot and a surface that faces away from the wearer's other foot. The lateral side and the medial side may extend through each of the rearfoot area, the midfoot area, and the forefoot area. In some cases, the medial side and a lateral side may extend around the periphery or perimeter of the shoe.

Figure 2A:
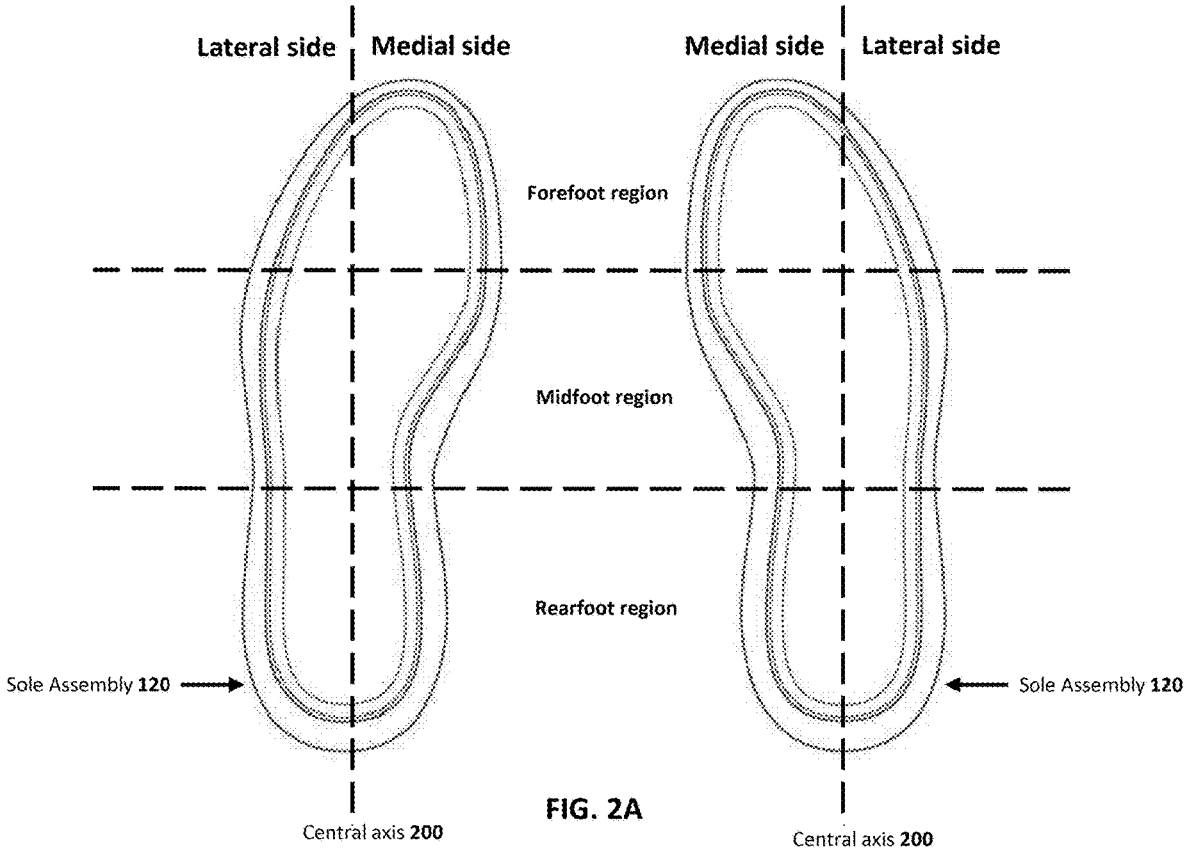
FIG. 2A schematically illustrates an exemplary golf shoe comprising a forefoot region, a midfoot region, and a rearfoot region, in accordance with some embodiments.

FIG. 2A illustrates the various regions of an exemplary left and right sole assembly 120. The sole assembly 120 may comprise a forefoot region, a midfoot region, and/or a rearfoot region. The forefoot, midfoot, and rearfoot regions may extend laterally along a first dimension (e.g., a width) of the sole assembly 120. The forefoot, midfoot, and rearfoot regions may extend laterally between a medial side and a lateral side of the sole assembly, as described above. The forefoot, midfoot, and rearfoot regions may extend laterally along different portions or sections of a second dimension (e.g., a length) of the sole assembly 120. The forefoot, midfoot, and rearfoot regions may extend between a posterior end and an anterior end of the sole assembly 120, as described above.

Figure 2B:
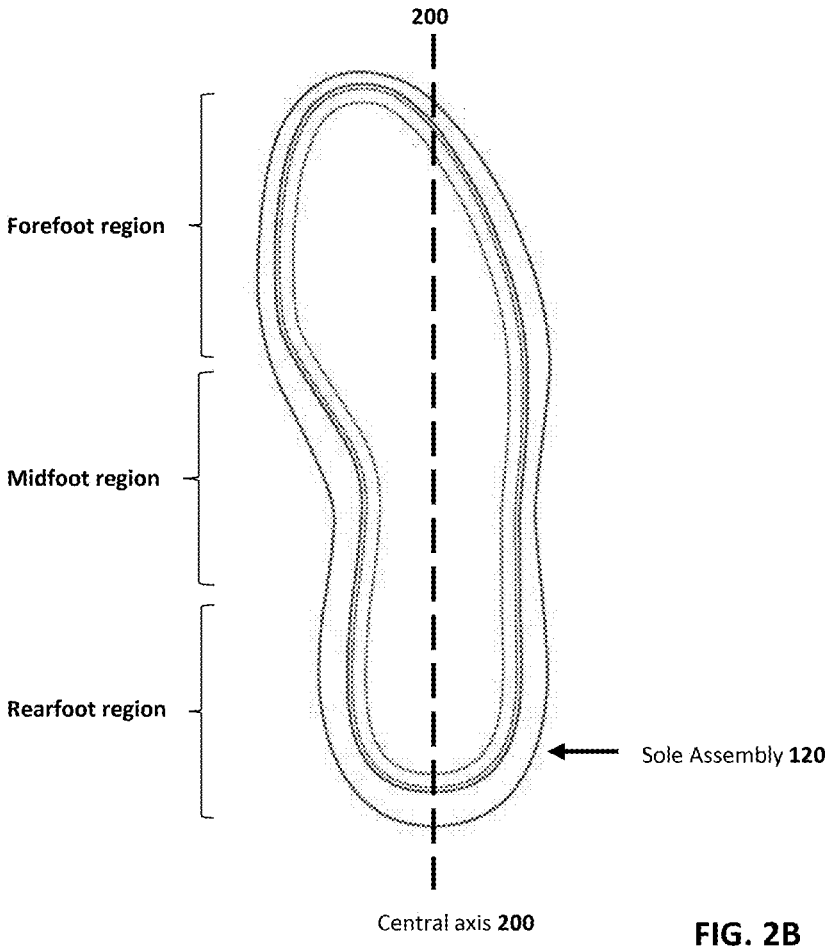
FIGS. 2B and 2C schematically illustrate a central axis extending through the forefoot, midfoot, and/or rearfoot regions of an exemplary golf shoe to divide the golf shoe into a medial side and a lateral side, in accordance with some embodiments.
Figure 2C:
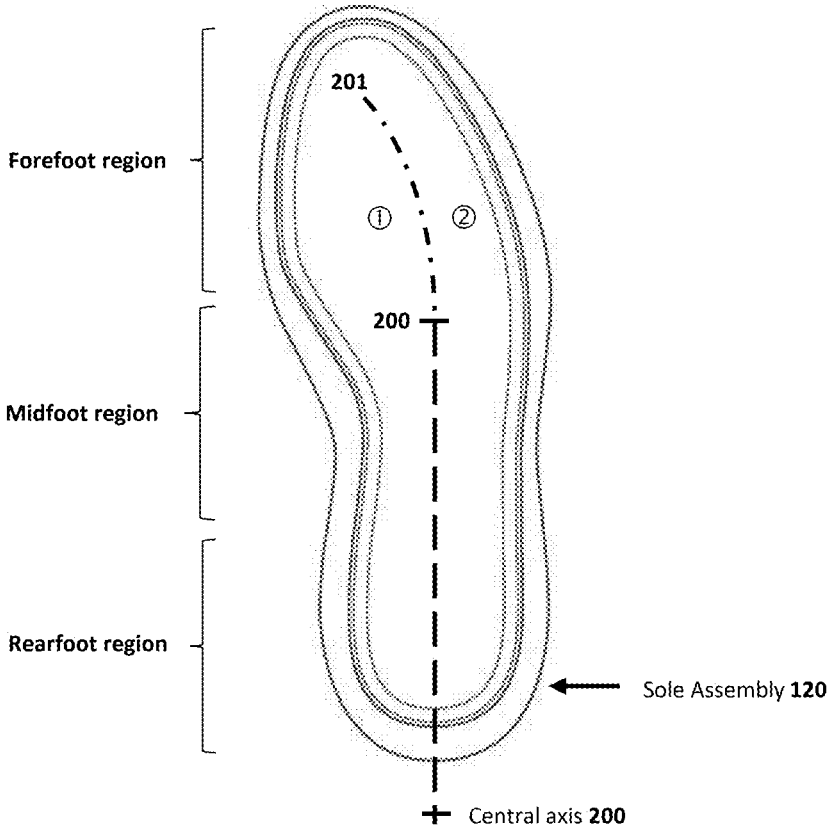

FIGS. 2A, 2B, and 2C schematically illustrate a central axis 200 of the sole assembly 120. The central axis 200 may extend from a rear most portion of the rearfoot region of the sole assembly 120 towards the midfoot and/or forefoot regions of the sole assembly 120. In some embodiments, the central axis 200 may extend in a direction that is perpendicular or normal to an axis tangential to the rear most portion of the rearfoot region of the sole assembly 120.

Referring to FIG. 2B, in some embodiments, a portion of the central axis 200 (e.g., the portion extending through at least the rearfoot and/or midfoot regions of the sole assembly 120) may divide or bisect the sole assembly 120 into a medial side and a lateral side. In some cases, a portion of the central axis 200 (e.g., the portion extending between the midfoot region of the sole assembly 120 and the forefoot region of the sole assembly 120) may not precisely divide or bisect the sole assembly 120 into a medial side and a lateral side. As shown in FIG. 2C, in some embodiments, the medial side ① and the lateral side ② of the forefoot region of the sole assembly may be divided along a curved axis 201 that deviates from the central axis 200. Any references herein to a medial side or a lateral side of an insole component, a midsole, an outsole, a sole assembly, or a shoe may contemplate a delineation of the medial and lateral sides of the insole component, midsole, outsole, sole assembly, or shoe along the central axis 200 and/or along a curved axis 201 (e.g., as shown in FIGS. 2B and 2C).

Structure

In one aspect, the present disclosure provides a golf shoe comprising an upper and a sole assembly connected to the upper. In some embodiments, the sole assembly may include a structure. In some embodiments, the structure may comprise an insert or a functional element that can be provided within the sole assembly or between two or more components or layers of the sole assembly to enhance a performance characteristic of the golf shoe.

In some embodiments, the structure may be embedded in or integrated with the midsole. In some embodiments, the structure may be co-molded with at least a portion of the midsole and/or the outsole. In some embodiments, the structure may be coupled to the midsole and/or the outsole of the shoe (e.g., using one or more adhesives or mechanical fasteners/couplers).

Embedding

In some embodiments, the shoe may comprise a structure embedded in the midsole or sole assembly of the shoe. As used herein, embedded may refer to a configuration in which at least a portion of the structure is either partially or fully covered or encapsulated by the midsole and/or sole assembly material.

In some cases, the structure may be embedded in the midsole or sole assembly such that the midsole or sole assembly material covers or encapsulates at least a portion of the surface area of the structure. In some cases, at least about 5%, 10%, 15%, 20%, 25%, 30%, 35%, 40%, 45%, 50%, 55%, 60%, 65%, 70%, 75%, 80%, 85%, 90%, or more of the surface area of the structure may be covered by the midsole or sole assembly material. In some cases, at least about 90%, 91%, 92%, 93%, 94%, 95%, 96%, 97%, 98%, 99%, or more of the surface area of the structure may be covered by the midsole or sole assembly material. In some cases, 100% of the surface area of the structure may be covered by the midsole or sole assembly material (i.e., the structure may be fully encapsulated by the midsole or sole assembly material such that the structure is insulated or covered by the midsole and/or sole assembly material on all sides).

In some embodiments, the midsole or sole assembly material encapsulating the structure may comprise a range of thicknesses. The thicknesses may correspond to a distance from (1) a point of contact between the structure and the midsole or sole assembly material and (2a) a point of contact between midsole or sole assembly material and another material or component of the shoe or (2b) an external surface of the midsole or sole assembly material that is exposed to the outside environment. In some cases, the thickness may range from about 0.1 millimeters (mm) to about 10 mm or more.

In some embodiments, the embedding of the structure in the midsole or sole assembly may yield an assembly that comprises at least two separate pieces that are coupled or attached to each other (the structure being one piece, and the midsole or sole assembly being another piece). In some cases, the two separate pieces may require a minimum amount of force to separate. The minimum amount of force may range from about 1 Newton (N) to about 100 Newtons (N) or more.

Integration

In some embodiments, the shoe may comprise a structure that is integrated with the midsole or outsole of the shoe. As used herein, integration may refer to a configuration in which at least a portion of the structure is placed adjacent or proximal to the midsole or outsole material. In some cases, integration may involve combining the structure with the midsole or outsole material. In some cases, integration may involve attaching or coupling the midsole or outsole material to the structure.

In some embodiments, the integration of the structure with the midsole or outsole material may involve a coupling or attachment of at least a portion of the structure to at least a portion of the midsole or outsole material. In some embodiments, the integration of the structure with the midsole or outsole material may involve a portion of the structure being coupled or attached to an inner portion, surface, or volume of the midsole or outsole material. In some embodiments, the integration of the structure with the midsole or outsole material may involve a portion of the structure being enveloped by or embedded in the midsole or outsole material. In some embodiments, the integration of the structure with the midsole or outsole material may involve a portion of the structure being covered by the midsole or outsole material.

In some cases, the integration of the structure and the midsole or outsole material may result in a contact between a surface of the structure and the midsole or outsole material. In some cases, the surface area of contact between the structure and the midsole or outsole material may range from about 1 cm 2 to about 100 cm 2 or more.

In some cases, the integration of the structure and the midsole or outsole material may yield an assembly that comprises at least two separate pieces that are coupled or attached to each other (the structure being one piece, and the midsole or outsole material being another piece). In some cases, the two separate pieces may require a minimum amount of force to separate. The minimum amount of force to separate the pieces may range from about 100 Newton (N) to about 1000 Newtons (N) or more.

Co-Molding

In some embodiments, the structure provided within the sole assembly may be co-molded with the midsole and/or outsole material or a portion of the midsole or outsole. In some embodiments, the structure may be provided within a mold that is used to form at least a portion of the midsole or outsole of the shoe. In some embodiments, the midsole material and/or the outsole material may be molded around the structure. In some cases, the midsole material and the outsole material may be molded around a same portion of the structure. In other cases, the midsole material and the outsole material may be molded around different portions of the structure.

Adhesive Coupling

In some embodiments, the structure provided within the sole assembly may be positioned between the midsole and the outsole of the sole assembly. In some embodiments, the structure may be directly or indirectly coupled to the midsole material and/or the outsole material. In some embodiments, the structure may be attached to the midsole and/or the outsole using one or more adhesives. In some cases, the structure may be attached to the midsole and the outsole using a same adhesive. In other cases, the structure may be attached to the midsole and the outsole using different adhesives.

Insert Customization

In an aspect, the present disclosure provides various examples of methods for customizing an insert for a shoe. In some cases, the insert may be customized to provide different material and/or mechanical properties to one or more portions or sections of the shoe. In some cases, the insert may be customized to control eversion and inversion characteristics of the shoe. In some cases, the insert may be customized to influence, tune, or modify a biomechanical aspect of an action or a movement by a subject wearing the shoe. In some cases, the biomechanical aspect may correspond to a stance of the subject, a position and/or an orientation of the subject's body, or a position and/or an orientation of a first body part of the subject relative to a second body part of the subject. In some cases, the biomechanical aspect may correspond to a movement of a subject's body or a set of movements executed by the subject during a golf-related movement or action. In some cases, the biomechanical aspect may correspond to a path along which the subject's body (or a portion thereof) moves. In some cases, the biomechanical aspect may correspond to a path along which a golf club held by the subject moves in three-dimensional space.

In some cases, the insert may be customized to provide a response that can guide or facilitate a subject's movement in order to (i) enhance one or more biomechanical aspects of the subject's actions and/or (ii) enhance a performance characteristic associated with the subject's actions. In some non-limiting embodiments, the performance characteristic may relate to a movement or a traction stiffness of the subject's shoe relative to a ground surface as the subject performs an action. In other non-limiting embodiments, the performance characteristic may relate to an object-related metric. The object-related metric may be associated with a movement or a displacement of an object or a kinematic property of the object, either during or as a result of the action(s) performed by the subject. The object may include, for example, a golf ball and/or a golf club. In some alternative/optional embodiments, the performance characteristic may include an accuracy, a precision, a consistency, or a dispersion-related metric that quantitatively or qualitatively represents or characterizes the movement or the kinematic properties of the subject and/or the object before, during, and/or after one or more actions performed by the subject.

Methods of Customization

In one aspect, the present disclosure provides various methods for customizing an insert for a golf shoe. The insert may be configured to provide a desired or optimal set of mechanical or material properties to the golf shoe. The set of mechanical or material properties provided by the insert may individually or collectively modify or enhance the biomechanical aspects or features of the subject's golf swing. The enhanced biomechanics of the subject's golf swing can help to maximize the subject's performance (e.g., on a golf range or a golf course).

The methods disclosed herein be implemented in conjunction with a shoe fitting experience for both casual and dedicated golfers alike. The shoe fitting experience may be informed by footwear performance analytics and algorithms such as those described herein, which can provide a high level of customization that cannot be practically realized with other conventional methods.

In some cases, a subject (e.g., a golfer) may want to wear golf shoes that are fitted for the subject's particular play style, anatomy, and/or swing biomechanics. The subject may engage in, undergo, or participate in a shoe fitting experience that involves the acquisition and processing of data associated with one or more golf-related movements or actions executed by the subject. In some cases, the subject may be wearing a reference shoe when executing the one or more golf-related movements or actions. In some cases, the subject may want to customize a target shoe having a set of desired properties that can enhance the subject's golf game/performance.

In some embodiments, the reference shoe may be different than the target shoe. For example, the reference shoe may be a shoe that the subject currently wears, and the target shoe may be a new and different shoe that the subject is interested in wearing. Alternatively, the reference shoe could be a standard or baseline shoe that is used across multiple shoe fittings for different subjects. In some cases, the standard or baseline shoe may have a set of known material or mechanical properties. In some cases, the standard or baseline shoe may have a known response when subjected to various forces or different ranges of forces.

In some cases, the standard or baseline shoe may include a functional element. In some cases, the functional element may include an insert or a layer or component of the sole assembly with a set of known properties and/or a predictable response when subjected to forces associated with one or more golf-related movements or actions. In some cases, the functional element may include one or more sensors for detecting or mapping forces exerted on the shoe during the one or more golf-related movements or actions.

In some embodiments, the reference shoe may be the same as the target shoe. For example, the reference shoe may be a particular model that a subject likes or needs, and the target shoe may be a new or newer version of the same model. Alternatively, the reference shoe could be a standard shoe that is provided to the subject after the subject selects or identifies the target shoe of choice. The standard shoe may be structurally, functionally, and/or mechanically equivalent to or representative of the target shoe selected by the subject.

In some cases, the reference shoe may include an insert (e.g., a functional insert as described elsewhere herein). In other cases, the reference shoe may not or need not include an insert or any other internal structure integrated with or embedded in a midsole or a sole assembly of the reference shoe. In some embodiments, the target shoe may include an insert or an internal structure. The insert or internal structure may be customized according to any of the methods described below. The insert or internal structure may have any of the custom insert configurations disclosed herein, and any structural variations thereof to account for different anatomies and/or swing biomechanics for different subjects.

Figure 3A:
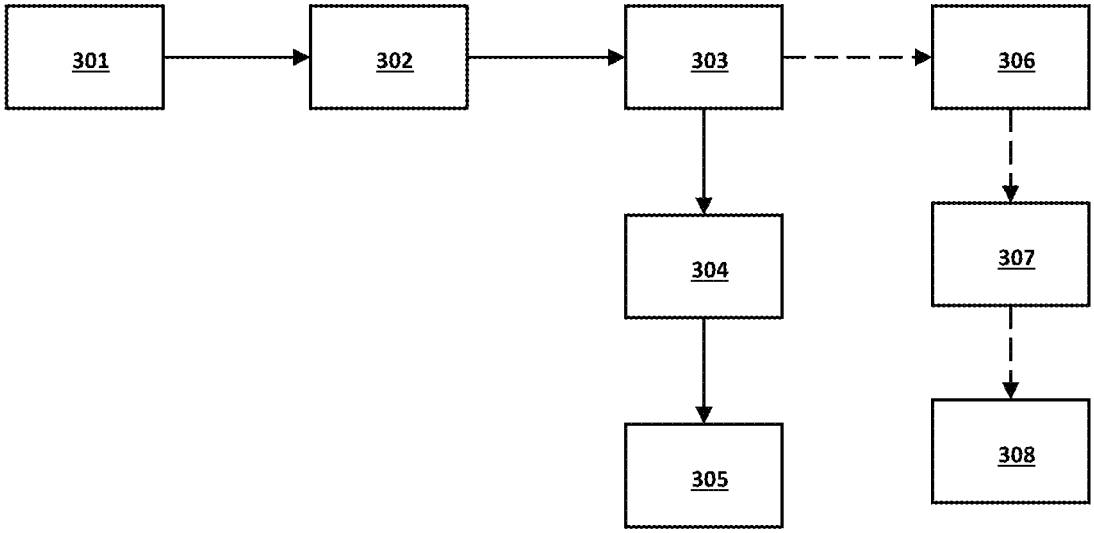
FIG. 3A schematically illustrates an exemplary method for customizing an insert for a shoe, in accordance with some embodiments.

FIG. 3A schematically illustrates a method for fabricating a custom insert for a shoe. The shoe may comprise a golf shoe or any other type of shoe that is usable on natural or artificial grass or turf to perform golf-related movements or actions. The method may comprise a step 301 of obtaining signals or data relating to a golf-related movement or action. The method may comprise another step 302 of processing the signals or data to derive information on (i) forces exerted on the reference shoe or a ground surface contacting the reference shoe, (ii) shoe movement or traction in response to forces exerted on the reference shoe or the ground surface, and/or (iii) ball carry distance or ball dispersion.

In some embodiments, the method may comprise another step 303 of selecting one or more target attributes for one or more tunable parameters of the insert or a shoe comprising the insert, based on the signals or data received. The one or more tunable parameters may correspond to a material property or a structural configuration of the insert or the shoe. In some embodiments, the method may comprise another step 304 of using a shoe insert customization algorithm to generate a model or a set of instructions for manufacturing a custom insert or a shoe comprising the custom insert. The custom insert may be configured to replicate or provide the one or more selected target attributes in order to enhance energy transfer, control, and stability during the subject's golf swing. In some embodiments, the method may comprise another step 305 of computing a shots gained metric to quantify a performance gain that is attributable to the custom insert or the shoe comprising the custom insert. The performance gain may be relative to the reference shoe or another shoe that is different than the target shoe with the custom insert.

In some embodiments, the method may comprise an optional step 306 of obtaining additional data associated with the subject's golf swing to verify or validate the one or more selected target attributes. In some cases, the additional data may be obtained after the initial data set obtained for the subject in step 301. In some cases, the additional data may be obtained after the processing of the initial data set in step 302. In some cases, the additional data may be obtained after the selection of target attributes in step 303. In some cases, the additional data may be obtained after the generation of an initial model or an initial set of instructions for manufacturing a custom insert (e.g., in step 304). In some cases, the additional data may be obtained after an initial computation of a shots gained metric (e.g., in step 305).

In some embodiments, the method may comprise an optional step 307 of updating the one or more target attributes selected in step 303 based on the additional data obtained in step 306. In some embodiments, the method may comprise using the one or more updated target attributes to generate a model or the set of instructions for manufacturing the insert or a shoe comprising the insert. The insert may be configured to replicate or provide the one or more updated target attributes in order to enhance energy transfer, control, and stability during the subject's golf swing. In some embodiments, the method may comprise an optional step 308 of computing a shots gained metric to quantify a performance gain that is attributable to the insert or the shoe comprising the insert.

Figure 3B:
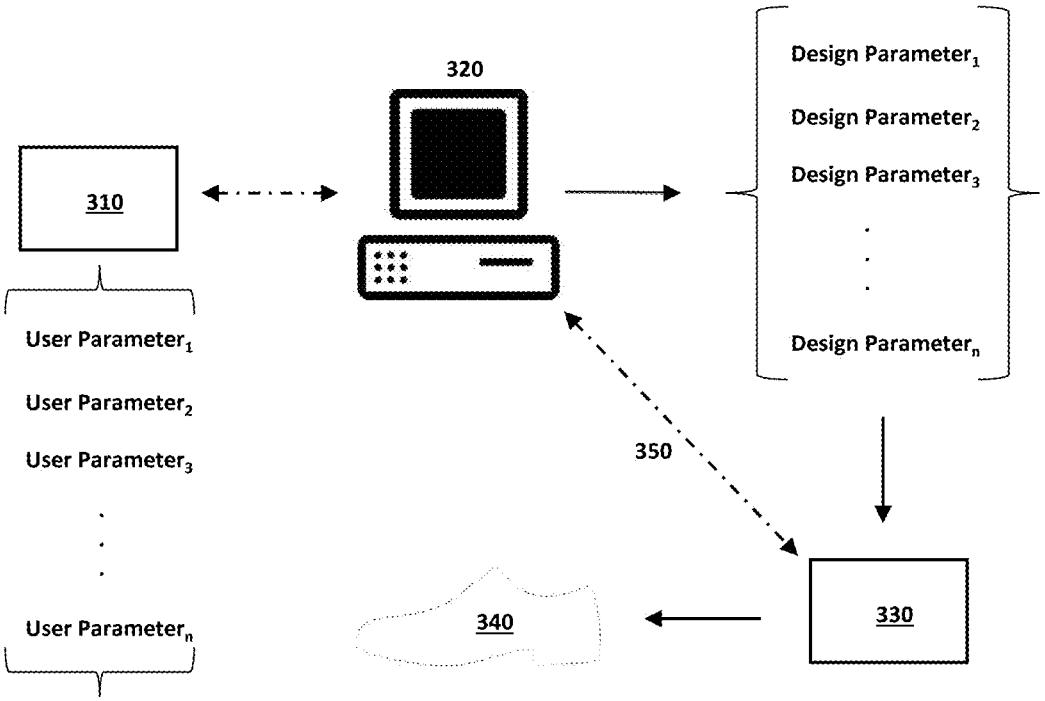
FIG. 3B schematically illustrates a system configured to implement and/or perform data processing and footwear analytics to determine one or more design parameters for a custom insert, in accordance with some embodiments.

FIG. 3B schematically illustrates a system 320 configured to implement and/or perform data processing and footwear analytics to determine one or more design parameters for a custom insert. The system 320 may be operatively coupled to a sensor or detection unit 310. The sensor or detection unit 310 may be configured to receive data or signals relating to a subject's anatomy and/or swing biomechanics. The data or signals relating to the subject's anatomy and/or swing biomechanics may be associated with one or more user parameters that can be interpreted and/or analyzed by the system 320 to derive one or more design parameters for a custom shoe assembly and/or a custom shoe insert for the subject. In some cases, the one or more design parameters may be provided to a machine or a piece of equipment 330 that is configured to manufacture the custom insert and/or a shoe 340 comprising the custom insert. The system 320 may be operatively coupled to the machine or a piece of equipment 330 via a physical connection or a network-based connection 350.

Signal Processing

In one aspect, the present disclosure provides a method for customizing an insert for a golf shoe. In some embodiments, the method may comprise processing one or more signals from a sensor-based tracking or detection system. In some cases, the sensor-based tracking or detection system may include an imaging device or a sensor that is configured to obtain data associated with one or more golf swings executed by a subject wearing a reference shoe. In some cases, the sensor may include a force plate, an inertial measurement unit (IMU), an accelerometer, a gyroscope, or a GPS unit. In some cases, the imaging device may include a camera or an optical detection unit. In some cases, the optical detection unit can be a charge-coupled device (CCD) or an active pixel sensor (APS), e.g., a complementary metal-oxide-semiconductor (CMOS) sensor.

Data

In some embodiments, the data obtained by the sensor-based tracking or detection system may include information on forces exerted on the reference shoe or a ground surface contacting the reference shoe. In some embodiments, the data may include information on a direction and/or a magnitude of the forces exerted on the reference shoe or the ground surface contacting the reference shoe. In some embodiments, the data may include information on a change in the direction and/or magnitude of the forces exerted on the reference shoe or the ground surface over a period of time. In some embodiments, the period of time may correspond to a length of time during which the subject executes one or more golf-related movements.

In some embodiments, the data may include information on shoe movement or traction in response to the forces exerted on the reference shoe or the ground surface. In some embodiments, the data may include information on a direction or path along which the subject's shoe moves during a golf-related action or movement. In some embodiments, the data may include information on how much the shoe moves relative to the ground surface during the golf-related action or movement. In some embodiments, the data may include information on how much the shoe moves relative to the ground surface when a certain amount of force is exerted on the shoe. In some embodiments, the data may include information on how much the shoe moves relative to the ground surface when a time-varying and/or spatially varying force is exerted on the shoe during a golf-related action or movement. In some embodiments, the data may include information on how well the shoe resists movement relative to the ground surface when a certain amount of force is exerted on the shoe.

In some embodiments, the data may include information on a position and/or a movement of one or more golf balls hits by the subject. In some embodiments, the data may include information on ball carry distance and/or ball dispersion. In some embodiments, the data may include information associated with or derived from ball speed, launch angle, launch direction, spin rate, spin axis, ball flight trajectory, carry distance, landing angle, roll distance, or roll speed.

In some embodiments, the data may include information on a position and/or a movement of a golf club held by the subject. In some embodiments, the data may include information associated with or derived from club speed, club path, club face angle, attack angle, swing plane, swing path, or swing direction.

In some embodiments, the data may include information on an anatomy of the subject. In some embodiments, the data may include information on the biomechanics of the subject's swing. In some embodiments, the data may include information on a movement of a subject's body or a set of movements executed by the subject during a golf-related movement or action. In some embodiments, the data may include information on a path along which the subject's body (or a portion thereof) moves during the golf-related movement or action. In some embodiments, the data may include information on a path along which a golf club held by the subject moves in three-dimensional space during the golf-related movement or action.

Tunable Parameters

In some embodiments, the data obtained for a particular subject may be used to adjust or optimize one or more tunable parameters of (i) the reference shoe and/or (ii) a target shoe. In some cases, the target shoe may be different than the reference shoe. In other cases, the target shoe and the reference shoe may comprise a same or similar shoe or type of shoe.

In some embodiments, the one or more tunable parameters may correspond to a material property or a structural configuration of the reference shoe or the target shoe. In some embodiments, the material property may correspond to a hardness, a stiffness, or a flexibility of one or more portions of the reference shoe or the target shoe. In some embodiments, the structural configuration may correspond to (i) a size or a shape of a functional element or layer within the reference shoe or the target shoe or (ii) a position or an orientation of the functional element or layer within the reference shoe or the target shoe. The functional element or layer may comprise any of the internal structures, endoskeletons, and/or custom inserts described and referenced in the present disclosure.

Target Attributes

In some embodiments, the method may comprise selecting one or more target attributes for the one or more tunable parameters of the reference shoe and/or the target shoe. The one or more target attributes may represent an optimal set of attributes for the one or more tunable parameters. In some cases, the optimal set of attributes may include one or more values, dimensions, physical configurations, and/or material compositions that impart various desirable sole properties or response characteristics that can impact the subject's golf-related movements and/or performance. In some cases, the optimal set of attributes may provide one or more sole properties or response characteristics that can control and/or enhance the subject's golf-related movements and/or performance. In some embodiments, the one or more target attributes may include a target material property or a target structural configuration that enhances energy transfer, control, and stability during the subject's golf swing. In some embodiments, the target attributes may be selected based on the data obtained in relation to the subject's golf swings.

Shoe Insert Customization Algorithm

In some embodiments, the method may comprise using a shoe insert customization algorithm to generate a model or a set of instructions for manufacturing a custom insert for the reference shoe or the target shoe. The custom insert may be configured to replicate or provide in the reference shoe or the target shoe the one or more selected target attributes in order to enhance energy transfer, control, and stability during the subject's golf swing. The custom insert may be configured to (i) adjust a biomechanical aspect or feature of the subject's golf swing and/or (ii) enhance a performance metric associated with the subject's golf swing.

Reference Insert Model

In some embodiments, the shoe insert customization algorithm may be configured to generate the model by modifying a reference insert model. In some embodiments, the reference insert model may comprise a model for a standardized baseline insert that is configured to accommodate a general range of foot or shoe sizes and/or shapes. The reference insert model may be modified in accordance with the methods disclosed herein to better suit a particular subject's anatomy and/or swing biomechanics.

In some embodiments, the reference insert model can be modified based on the one or more target attributes selected for the one or more tunable parameters of the reference shoe and/or the target shoe. In some embodiments, modifying the reference insert model can involve changing a shape, profile, material composition, or structural configuration of the reference insert model based on the data obtained for a subject and/or data obtained for a subject's golf swing. In some embodiments, modifying the reference insert model can involve changing a shape, profile, material composition, or structural configuration of the reference insert model based on an anatomy of the subject or a biomechanical aspect or feature of the subject's golf swing. In some embodiments, modifying the reference insert model can involve changing a shape, profile, material composition, or structural configuration of the reference insert model based on a size, a shape, a structural configuration, or a material composition of the target shoe. In some embodiments, the reference model can be modified based on a difference between (i) a size, a shape, a structural configuration, and/or a material composition of the reference shoe and (ii) a size, a shape, a structural configuration, and/or a material composition of the target shoe.

Instructions for Manufacturing

In some embodiments, the shoe insert customization algorithm may be configured to generate a set of instructions by modifying one or more reference instructions for manufacturing a reference insert. In some embodiments, the reference instructions may comprise a set of baseline instructions for manufacturing a standardized insert configured to accommodate a general range of foot or shoe sizes and/or shapes. The reference instructions may be modified in accordance with the methods disclosed herein to better suit a particular subject's anatomy and/or swing biomechanics.

In some embodiments, the one or more reference instructions can be modified based on the one or more target attributes selected for the one or more tunable parameters of the reference shoe and/or the target shoe. In some embodiments, the one or more reference instructions can be modified based on the data obtained for the one or more golf swings executed by the subject. In some embodiments, the one or more reference instructions can be modified based on an anatomical feature of the subject or a biomechanical aspect or feature of the subject's golf swing. In some embodiments, the one or more reference instructions can be modified based on a size, a shape, a structural configuration, or a material composition of the reference shoe and/or the target shoe. In some embodiments, the one or more reference instructions can be modified based on a difference between (i) a size, a shape, a structural configuration, and/or a material composition of the reference shoe and (ii) a size, a shape, a structural configuration, and/or a material composition of the target shoe.

Additional Data Capture/Processing

In some embodiments, the method may comprise obtaining additional data associated with the subject's golf swing. The additional data may be used to verify or validate the one or more target attributes selected for the one or more tunable parameters of the reference shoe and/or the target shoe. In some embodiments, the additional data may be obtained after the data initially captured for the subject. In some embodiments, the additional data may be obtained for one or more golf-related movements executed by the subject after an initial set of golf-related movements previously executed by the subject.

In some embodiments, the additional data may include information on forces exerted on the reference shoe or a ground surface contacting the reference shoe. In some embodiments, the additional data may include information on a direction and/or a magnitude of the forces exerted on the reference shoe or the ground surface contacting the reference shoe. In some embodiments, the additional data may include information on a change in the direction and/or magnitude of the forces exerted on the reference shoe or the ground surface over a period of time. In some embodiments, the period of time may correspond to a length of time during which the subject executes one or more golf-related movements.

In some embodiments, the additional data may include information on shoe movement or traction in response to the forces exerted on the reference shoe or the ground surface. In some embodiments, the additional data may include information on a direction or path along which the subject's shoe moves during a golf-related action or movement. In some embodiments, the additional data may include information on how much the shoe moves relative to the ground surface during the golf-related action or movement. In some embodiments, the additional data may include information on how much the shoe moves relative to the ground surface when a certain amount of force is exerted on the shoe. In some embodiments, the additional data may include information on how much the shoe moves relative to the ground surface when a time-varying and/or spatially varying force is exerted on the shoe during a golf-related action or movement. In some embodiments, the additional data may include information on how well the shoe resists movement relative to the ground surface when a certain amount of force is exerted on the shoe.

In some embodiments, the additional data may include information on a position and/or a movement of one or more golf balls hits by the subject. In some embodiments, the additional data may include information on ball carry distance and/or ball dispersion. In some embodiments, the additional data may include information associated with or derived from ball speed, launch angle, launch direction, spin rate, spin axis, ball flight trajectory, carry distance, landing angle, roll distance, or roll speed.

In some embodiments, the additional data may include information on a position and/or a movement of a golf club held by the subject. In some embodiments, the additional data may include information associated with or derived from club speed, club path, club face angle, attack angle, swing plane, swing path, or swing direction.

In some embodiments, the additional data may include information on an anatomy of the subject. In some embodiments, the additional data may include information on the biomechanics of the subject's swing. In some embodiments, the additional data may include information on a movement of a subject's body or a set of movements executed by the subject during a golf-related movement or action. In some embodiments, the additional data may include information on a path along which the subject's body (or a portion thereof) moves during the golf-related movement or action. In some embodiments, the additional data may include information on a path along which a golf club held by the subject moves in three-dimensional space during the golf-related movement or action.

Updated Target Attributes

In some non-limiting embodiments, the method may further comprise updating one or more previously selected target attributes based on the additional data. In some embodiments, the method may further comprise using the one or more updated target attributes to generate a model of the target shoe or a set of instructions for manufacturing the target shoe. In some embodiments, the method may further comprise fabricating the target shoe based on the model or the set of instructions. The target shoe may comprise a custom insert or internal structure/endoskeleton that is optimized for a particular subject's anatomy and/or swing biomechanics. The custom insert or internal structure/endoskeleton may be optimized or configured based at least in part on the additional data obtained for the subject.

Shots Gained Metric

In some embodiments, the method may further comprise computing a shots gained metric based on a comparison between a performance of the subject in the target shoe versus a performance of the subject in the reference shoe. The shots gained metric may represent a number of shots that the subject is able to gain due to the subject's enhanced performance in the target shoe with the custom insert. The number of shots gained by the subject may correspond to a reduction in the number of shots or strokes needed for the subject to hit a golf ball into one or more holes on a physical or virtual course.

In some embodiments, the custom inserts described herein may be configured to provide a subject with a positive shots gained metric (i.e., a reduction in the number of shots needed to complete one or more holes). In some embodiments, the positive shots gained metric may be driven by (i) the additional distance that the subject can hit the golf ball and/or (ii) the improved accuracy and/or consistency with which the subject can hit the golf ball due to the enhanced sole properties or response characteristics provided by the custom insert.

In some embodiments, the shots gained metric may be a function of a statistical probability of a golfer making a particular shot. In some cases, the statistical probability may be based on (i) the position of the golf ball relative to the hole and/or (ii) historical data on shots hit by the golfer and/or other players from a same or similar position.

Modular Shoe Construction

In some embodiments, the custom inserts described herein may be implemented in conjunction with a modular shoe construction. The modular shoe construction may allow for the placement of different inserts into different regions of the golf shoe, and the assembly of multiple golf shoes having different inserts with different configurations. In some cases, the modular shoe construction may comprise a modular sole assembly configured to receive or integrate with a plurality of different custom inserts. The plurality of different custom inserts may have different sizes, shapes, and/or dimensions. In some cases, the plurality of different custom inserts may be provided in different positions and/or orientations within the modular shoe construction. The modular shoe construction may provide a flexible, standardized platform that facilitates the production or manufacturing of multiple golf shoes having (i) one or more same or similar components, designs, structural features, and/or design aesthetics but (ii) different insert designs or configurations.

Spring Plate

In some embodiments, the insert may be configured as a spring plate. The spring plate may be configured to guide or facilitate a movement of the subject's body to enhance the biomechanics of the subject's golf swing. In some cases, the spring plate may be configured to provide an elastic response that can propel the subject's body (or any portion thereof) to facilitate one or more golf-related actions performed by the subject. In some cases, the enhanced biomechanics imparted by the spring plate can increase the carry distance of one or more golf balls hit by the subject.

Control Plate

In some embodiments, the insert may be configured as a control plate. In some cases, the control plate may be configured to moderate an eversion and/or inversion characteristic of the golf shoe to fine tune the biomechanics of a subject's golf swing. In some cases, the modified swing biomechanics imparted by the control plate can enhance a subject's shot consistency and/or dispersion.

Composite Plate

In some embodiments, the insert may comprise a composite plate. In some embodiments, the composite plate may extend from an anterior region to a posterior region of the midsole. In one embodiment, the composite plate can be positioned such that a first end of the composite plate is disposed in the forefoot region of the midsole and a second end of the composite plate is disposed in the rearfoot region of the midsole.

In some embodiments, the composite plate may comprise a fiber-reinforced composite plate. The fiber-reinforced composite plate may comprise a binding polymer matrix (e.g., in the form of a curable resin) and one or more reinforcing fibers. In some cases, the binding polymer can be a thermoset material such as epoxy or rubber. Thermoplastic resins such as polyesters, polyolefins, nylons, and/or polyurethanes also can be used. In some cases, carbon fiber such as graphite can be used as the reinforcing fibers for the composite plate. Other fibers such as aramids (for example, Kevlar™), aluminum, or glass fibers can be used in addition to or in place of the carbon fibers. In some cases, the fiber-reinforced composite plate can be manufactured using a process whereby the reinforcing fibers are impregnated with a resinous material, such as epoxy. The resinous material can be used as a matrix to bind the reinforcement fibers. In some cases, the impregnated fibers may be configured to form a laminate structure which can be cured (e.g., at specific temperature ranges or specific bands or wavelengths of light) to form a solid or rigid composite material. The resulting fiber-reinforced composite plate may be lightweight and may have excellent mechanical properties such as high stiffness, high tensile strength, and a high strength-to-weight ratio.

In some non-limiting embodiments, the composite plate may have a constant thickness. In other non-limiting embodiments, the composite plate may have a variable thickness.

In some optional embodiments, the composite plate may include a pocket. The pocket may be oriented towards the ground surface under the composite plate. In some cases, the pocket may correspond to a portion of the composite plate that is recessed relative to another portion of the composite plate. In some cases, the pocket may correspond to a portion of the composite plate that is positioned further away from the ground surface compared to one or more other portions of the composite plate. In some cases, the pocket may correspond to a portion of the composite plate with a thickness that is less than that of one or more other portions of the composite plate. In some cases, the pocket may correspond to a depression, an indentation, or a cavity that is provided within a portion of the composite plate.

In some embodiments, the pocket may be centered relative to the shoe or the sole assembly of the shoe. In other embodiments, the pocket may not or need not be centered relative to the shoe or the sole assembly of the shoe. In some embodiments, at least a portion of the pocket can mimic the outer shape of the composite plate. In other embodiments, the pocket may have any suitable shape that can provide additional stiffness in at least the rearfoot region of the shoe.

In some embodiments, the pocket may be configured to extend longitudinally across or through at least a rearfoot region of the shoe. In some embodiments, the pocket may not or need not extend into the forefoot region of the shoe.

In some embodiments, the pocket may have a length ($L_p$) that is at most about 40% of the length of the composite plate (L). In some embodiments, the pocket may have a length ($L_p$) that is about 20% to about 35% of the overall length of the composite plate (L).

In some embodiments, the composite plate may have a maximum width ($w_m$) and the pocket may have a maximum width ($w_p$). In some cases, the maximum width of the pocket ($w_p$) may be at least about 50% of the maximum width of the composite plate ($w_m$). In some cases, the maximum width of the pocket ($w_p$) may be between about 60% and about 80% of the maximum width of the composite plate ($w_m$). In some embodiments, the maximum width of the composite plate ($w_m$) and the pocket ($w_p$) may not or need not coincide with each other along a length of the composite plate. For example, they may be offset from each other along the length of the composite plate.

In some embodiments, the maximum depth (d) of the pocket may range from about 1 mm to about 5 mm. In some cases, the maximum width of the pocket ($w_p$) may be at least 50% of the maximum width of the composite plate ($w_m$). In some embodiments, the maximum width of the composite plate ($w_m$) and the pocket ($w_p$) may not or need not coincide with each other along the length of the composite plate. For example, the maximum width of the composite plate ($w_m$) and the maximum width of the pocket ($w_p$) may be offset from each other along a length of the composite plate.

In some non-limiting embodiments, the pocket may include one or more ridges. In some embodiments, the one or more ridges may provide additional stiffness to the composite plate and/or the sole assembly compared to other composite plates which may not include such ridges. In some embodiments, the pocket and the one or more ridges can collectively enhance a stiffness of the rear foot region of the shoe.

In some cases, the one or more ridges may be configured to extend along a dimension of the composite plate. In some cases, the one or more ridges may be configured to extend across a length and/or a width of the composite plate. In some cases, the one or more ridges may correspond to a portion of the composite plate that is raised above one or more other portions of the composite plate. In some cases, the one or more ridges may correspond to a portion of the composite plate that extends upwards and/or above one or more other portions of the composite plate. In some cases, the one or more ridges may be configured to extend or slope upwards towards an upper portion of the sole assembly. In some cases, an uppermost portion of the one or more ridges may have a flat or substantially flat shape or profile. In other cases, the uppermost portion of the one or more ridges may have an angled profile.

In some embodiments, the one or more ridges may extend along a dimension of the composite plate. In some embodiments, the one or more ridges may be configured to extend along or through a longitudinal center region of the pocket. In some cases, the shape or profile of the one or more ridges may correspond to a shape or profile of the composite plate or the pocket. In other cases, the shape or profile of the one or more ridges may not or need not correspond to the shape or profile of the composite plate or the pocket.

In some embodiments, the pocket and/or the one or more ridges may be located in a forefoot region, a midfoot region, and/or a rearfoot region of the shoe. In some embodiments, the pocket and/or the one or more ridges may be located at or near a posterior end of the composite plate. The posterior end of the composite plate may be located at or near the rearfoot region of the shoe.

In some embodiments, the composite plates described herein may have at least one ridge formed in the composite plate. In some cases, the width of the at least one ridge ($w_r$) may be much smaller than the maximum width of the composite plate ($w_m$). In some cases, the maximum depth (d) of the at least one ridge may range from about 1 mm to about 5 mm. In some non-limiting embodiments, the at least one ridge may be disposed on a portion of the composite plate that is located at or near the posterior end of the midsole to enhance the stiffness of the rear foot region of the shoe.

In some embodiments, the composite plate may have two or more ridges molded in the composite plate. In some cases, the two or more ridges may be adjacent to one another. In some cases, the two or more ridges may be substantially parallel along their length. In some cases, the total width of the ridges ($w_r$) may span at least 50% of the maximum width of the composite plate ($w_m$). In some cases, the total width of the ridges ($w_r$) may span about 60% to about 80% of the maximum width of the composite plate ($w_m$). In some cases, the maximum depth (d) of the two or more ridges may range from about 1 mm to about 5 mm. In some cases, at least one of the two or more ridges may be provided in a pocket formed in the composite plate, as described elsewhere herein.

In some embodiments, the pocket may include a plurality of sidewalls. In some embodiments, the sidewalls may form or define at least a side or portion of the one or more ridges. In some cases, the sidewalls may be substantially perpendicular to a main surface of the composite plate. In other cases, the sidewalls may be angled or sloped relative to the main surface of the composite plate.

In some embodiments, the composite plate may have a molded pocket with sidewalls that are substantially perpendicular to the main surface of the carbon plate. In some embodiments, the molded pocket and/or the ridges described herein may have sidewalls that are substantially perpendicular to the main surface of the molded composite plate. In other embodiments, the sidewalls may be sloped at an angle ranging from about 1 degree to about 90 degrees or more.

Insert Structure

In some embodiments, the insert may comprise a structure that can be integrated with or embedded in a sole assembly of a shoe. In some embodiments, the structure may comprise one or more structural members. The one or more structural members may comprise an element of the structure that is sized and shaped to distribute or redirect a load exerted on a shoe (e.g., during a golf-related action) to different portions of the structure, the sole assembly, or the overall shoe. In some cases, the one or more structural members may comprise a beam, a column, a brace, a strut, a rod, a post, a bar, a plate, a truss, a frame, a lattice, a support, or any other type of rigid or flexible component or construct that is capable of distributing or redirecting forces (compressive, rotational/torsional, etc.) exerted on a sole assembly of a shoe. In some cases, the one or more structural members may comprise a torsion bar, an arm, a wing, or an arch structure, as described in greater detail below.

Size/Shape

In some embodiments, the one or more structural members may comprise a cross-section. In some cases, the cross-section may comprise a lateral cross-section along a plane that extends through a portion of the member(s). In some cases, the cross-section may comprise a lateral cross-section along a plane that extends vertically or horizontally through a portion of the member(s). In any of the embodiments described herein, the plane may be oriented at an angle relative to a surface of the structural members. In some cases, the angle may range from about 1 degree to about 179 degrees. In some non-limiting embodiments, the plane may be normal, orthogonal, or perpendicular to a surface of the one or more structural members.

In some embodiments, the cross-section may comprise a cross-sectional shape. The cross-sectional shape may correspond to a lateral or vertical cross-section of the structural members. In some cases, the cross-sectional shape may comprise a circular shape or a polygonal shape. In some cases, the cross-sectional shape may comprise, for example, a circle, an ellipse, or any polygon having three or more sides. The cross-sectional shape may comprise a regular shape (e.g., a shape having two or more sides with a same length) or an irregular shape (e.g., a shape having two or more sides with different lengths). In some cases, the cross-sectional shape may comprise at least one linear portion or section. In some cases, the cross-sectional shape may comprise at least one curved or non-linear portion or section. In some cases, the cross-sectional shape may comprise at least one linear portion or section and at least one curved or non-linear portion or section.

In some embodiments, the one or more structural members may comprise a cross-sectional shape that changes along a dimension of the structural member. In some cases, the dimensions of the cross-sectional shape may also vary along a portion of the structural member. The dimension may include, for example, a length, a width, and/or a height of the cross-sectional shape.

In some embodiments, the member may comprise a solid cross-section. The solid cross-section may comprise a single material or a plurality of materials that are layered next to or on top of each other. In other cases, the member may comprise a hollow cross-section. The hollow cross-section may comprise a material or a plurality of materials having an opening, a gap, a void, or a channel within an inner volume of the material.

In some embodiments, the one or more structural members and/or the overall structure itself may be flat or substantially flat. In other embodiments, the structural members and/or the overall structure may have multiple regions with different heights (relative to a surface of the midsole, a surface of the outsole, or the ground surface on which the shoe is provided). In some cases, the structure may comprise a three-dimensional frame or endoskeleton that spans a width, a length, and/or a height of the insole (e.g., the insole footbed or the insole board) or the midsole. In some cases, the structure may comprise one or more members that extend or slope upwards (e.g., towards a top of the midsole). In some cases, the structure may comprise one or more members that extend or slope downwards (e.g., towards a bottom of the midsole). In some cases, the structure may comprise a plurality of members that extend or slope upwards and/or downwards. In some embodiments, the structure may comprise a plurality of members that extend or slope upwards or downwards towards different portions of the midsole. In other embodiments, the structure may comprise a plurality of members that extend or slope upwards or downwards towards a same portion of the midsole. In some cases, the structure may comprise a plurality of members that converge at a same portion or region of the midsole. In other cases, the structure may comprise a plurality of members that diverge towards multiple different regions of the midsole.

Unitary Structure

In some embodiments, the structure may comprise a plurality of members that are integrally formed as a single, continuous structure for distributing or redirecting loads. In some embodiments, the plurality of members may have a fixed position and orientation relative to each other. In other embodiments, the plurality of members may be configured to move (e.g., flex or bend) relative to each other under load. In some cases, the structure comprising the plurality of members may be fabricated as a single, unitary piece. In some cases, the structure may not or need not comprise separate subcomponents that need to be joined or coupled together. In some cases, the structure may not or need not comprise any joints or hinges, or any rotating or articulating components or structural features that are mechanically linked, fastened, or joined.

In some embodiments, the structure may be integrally formed as a single, unitary structure. The single, unitary structure may not or need not comprise any separate or distinct subcomponents that are (i) coupled to each other (e.g., using fasteners) and/or (ii) joined to form a mechanical connection (e.g., a hinge, a joint, a slide, or any other type of connection that permits a translation and/or a rotation of one subcomponent relative to another subcomponent).

In some embodiments, the structure may comprise a spineless structure. In some cases, the spineless structure may not or need not comprise an elongate member that extends between a forefoot region and a rearfoot region of the midsole or sole assembly. In some cases, the spineless structure may not or need not comprise rib members that are coupled or secured to an elongate member extending between a forefoot region and a rearfoot region of the midsole or sole assembly. In some embodiments, the single, unitary structure may comprise a plurality of structural members extending between the medial side and the lateral side of the midsole or the sole assembly. The plurality of structural members may not or need not be connected to any elongate member extending between the forefoot and rearfoot regions of the midsole or sole assembly.

In some embodiments, a portion of the structural members may have a fixed position and/or a fixed orientation relative to (i) another portion of the structure and/or (ii) a portion of the midsole or sole assembly in which or to which the structural members are integrated or embedded. In some embodiments, a portion of the structural members may be configured to flex or deform when a force is exerted on the members. In some cases, a portion of the midsole or sole assembly that is adjacent or proximal to the structural members may be configured to flex or deform in response to the flexing or deformation of the structural members. In some cases, the portion of the member that is flexing or deforming may remain in a relatively fixed position and orientation relative to the portion of the midsole or sole assembly that is flexing or deforming in response to the flexing or deformation of the member. In some cases, a portion of the members may be configured to move relative to a surface of the midsole or sole assembly that is adjacent or proximal to the movable portion of the members. In some cases, the portion of the members that is configured to move relative to the midsole or sole assembly may be positioned in or near one or more windows, cavities, or voids within the foam material surrounding or encapsulating the structure. In some cases, the foam material surrounding or encapsulating the structure may not or need not comprise any windows, cavities, or voids to accommodate a movement or deformation of the members (e.g., a flexing, a bending, a twisting, a stretching, or a compressing of the members) under load.

In some embodiments, the structure may comprise a structural shape or profile that is different than a shape or profile of a bottom of a user's foot. In one example, the structure may have a cylindrical shape with a curved upper surface that slopes downwards towards the bottom of the sole assembly, similar to the structural configuration shown in FIGS. 4A and 4B. The curvature of the upper surface can have a different radius of curvature than a bottom surface or an arch of a subject's foot. In another example, the structure may comprise an arched profile that curves downwards towards the medial and lateral sides of the sole assembly, similar to the exemplary structural configurations shown in FIGS. 5A and 5B. The arched profile may not or need not conform to a shape or a profile of the subject's foot. As shown in FIG. 5C, in some cases, the upper portion of the structure may include fixed members that extend towards the lateral and medial sides of the sole assembly, and in some optional embodiments, wings that conform to a shape or a profile of (i) the lateral or medial side of the sole assembly and/or (ii) a sidewall of a mold used to fabricate the sole assembly. In some embodiments (e.g., as shown in FIGS. 6A and 6B), the upper portion of the structure may be shaped to provide torsional stiffness in the midfoot region of the sole assembly. The shape or profile of the upper portion may be different than the shape or profile of the bottom surface of a subject's foot in order to provide an optimal balance between cushioning (e.g., between the top and bottom of the midsole) and support (e.g., arch support). In other embodiments (e.g., as shown in FIGS. 7 and 8A-8E), the upper portion of the structure may be curved upwards or downwards to provide a suspension effect. In some cases, the curvature of the upper portion of the structure may not or need not conform to a shape or a profile of a bottom surface of a subject's foot.

Positioning

In some embodiments, the one or more members may extend between a first region of the sole assembly and a second region of the sole assembly. The first region or the second region of the sole assembly may include a lateral side or a medial side of the sole assembly. The first region or the second region of the sole assembly may include a forefoot region, a midfoot region, or a rearfoot region of the sole assembly.

In some embodiments, the one or more members may be configured to extend between the lateral side and the medial side of the sole assembly. In some embodiments, the one or more members may extend between the lateral side and the medial side of the midsole or the sole assembly. The extension of the one or more members between the lateral side and the medial side of the midsole or the sole assembly may enhance the stiffness and support provided by the midsole or the sole assembly.

In some embodiments, the one or more members may be configured to extend between (1) a central region of the midsole or sole assembly and (2) a medial side and/or a lateral side of the midsole or the sole assembly to enhance a lateral support and a torsional strength or stiffness of the midsole or the sole assembly. In some embodiments, the one or more members may be configured to extend through the central region of the midsole or sole assembly to both the medial and lateral sides of the midsole or the sole assembly.

In some non-limiting embodiments, the central region of the midsole or the sole assembly may correspond to a midfoot region of the midsole or the sole assembly (e.g., as shown in FIG. 2A). In other alternative embodiments, the central region of the midsole or the sole assembly may correspond to a portion of the midsole or the sole assembly that is along or proximal to the central axis 200 or the curved axis 201 (e.g., as shown in FIGS. 2B and 2C). In some cases, the central region of the midsole or the sole assembly may be located in the forefoot, midfoot, and/or rearfoot region of the midsole or sole assembly, so long as the central axis 200 or the curved axis 201 is used as a point or frame of reference to approximately indicate the central region of the midsole or the sole assembly. In some embodiments, the central region of the midsole or the sole assembly may correspond to a midfoot region of the midsole or the sole assembly that further coincides with or is proximal to the central axis 200 or the curved axis 201 extending through or across the midsole or the sole assembly.

3D Structures

In some embodiments, the structure may comprise a three-dimensional (3D) structure. In some cases, the 3D structure may comprise an additively manufactured part. The additively manufactured part may be produced using, for example, 3D printing, laser sintering, welding, molding, or any other type of additive manufacturing process.

In some embodiments, the structure may comprise a machined part. In some embodiments, the structure may comprise a part that is fabricated using one or more subtractive manufacturing processes (e.g., milling, turning, laser cutting, electrical discharge machining (EDM), carving, etc.).

Figure 4A:
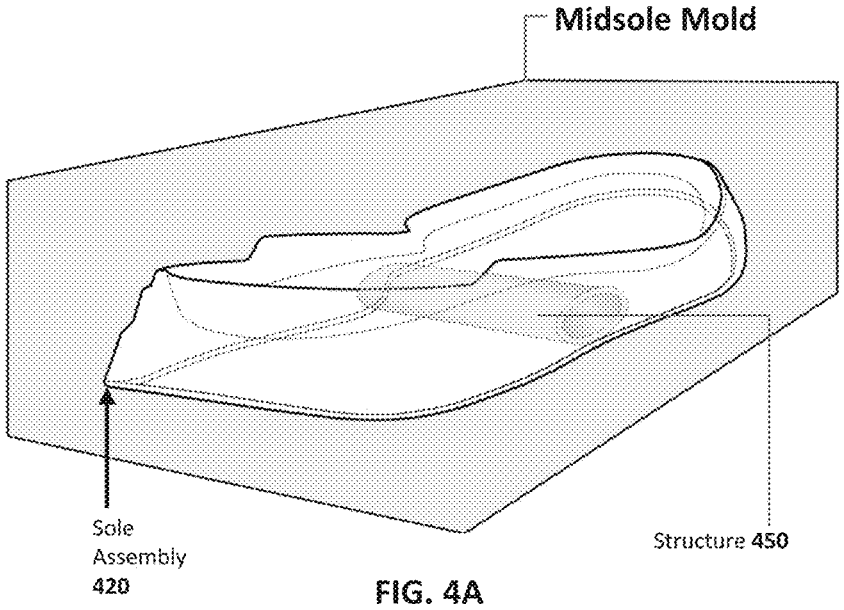
FIGS. 4A and 4B depict an example of a sole assembly comprising a structure for internal midsole reinforcement, in accordance with some embodiments.
Figure 4B:
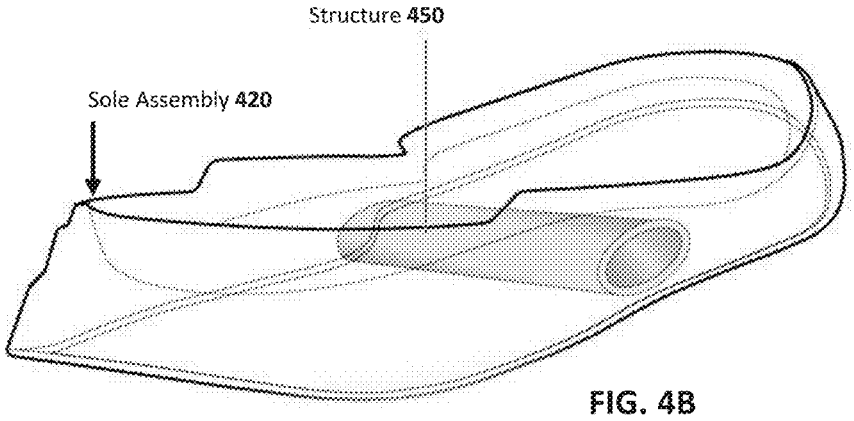

FIGS. 4A and 4B depict an exemplary sole assembly 420 comprising a structure 450 that can be embedded in or integrated with the sole assembly 420. The sole assembly 420 may comprise a midsole or an outsole as described above. In some embodiments, the structure 450 can be stock fit within the midsole or between the midsole and the outsole. In some embodiments, the structure 450 can be placed inside a mold, and the sole assembly 420 can be formed using the mold. In some cases, the sole assembly 420 may be formed around the structure 450.

In some embodiments, the structure 450 may comprise a reinforcement part. The reinforcement part may be configured for internal midsole reinforcement. In some cases, the reinforcement part may be configured to stiffen the midsole so that the midsole resists deformation under torsion or shear stress (e.g., when a golfer is executing a golf swing and shifts his/her weight or pivots his/her feet).

In some non-limiting embodiments, the structure 450 may comprise a rod or a tube that extends between a medial side and a lateral side of the sole assembly. In some cases, the rod or tube may comprise a hollow inner region. In some cases, an inner region of the rod or tube may be hollowed to reduce a total weight or mass of the structure 450. In some cases, the hollow inner region may be filled with a filler material (e.g., a foam material as described elsewhere herein) to optimize a stiffness of the structure or the sole assembly in which the structure is embedded.

Figure 4C:
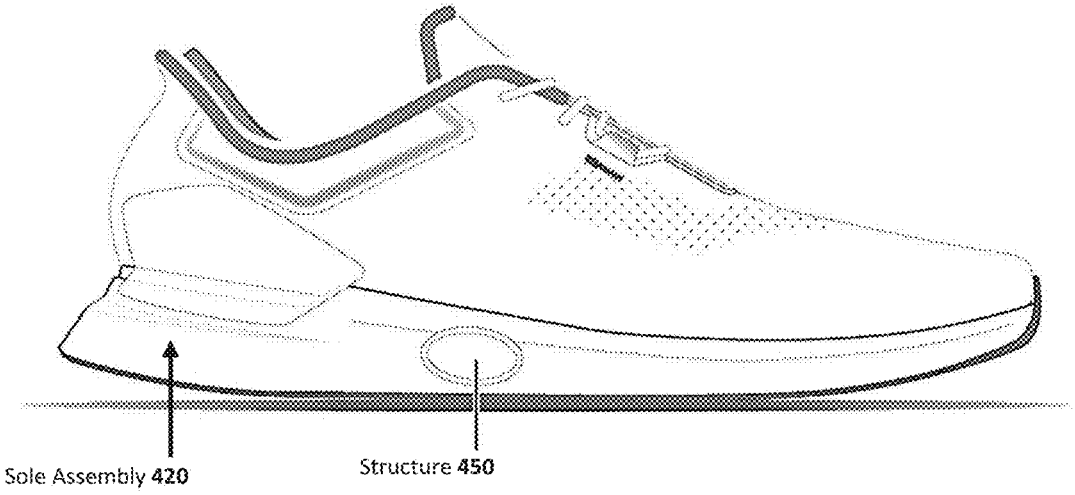
FIG. 4C depicts an example of an internal structure that can be visible through the sole assembly, in accordance with some embodiments.

Referring to FIG. 4C, in some cases, the structure 450 that is embedded in the sole assembly 420 may be at least partially visible through the sole assembly 420. In some cases, the structure 450 may be visible on both the medial and lateral sides of the sole assembly. In some cases, the visible structure 450 may indicate that the shoe includes a reinforcement part embedded in or integrated with the sole assembly 420.

Figure 5A:
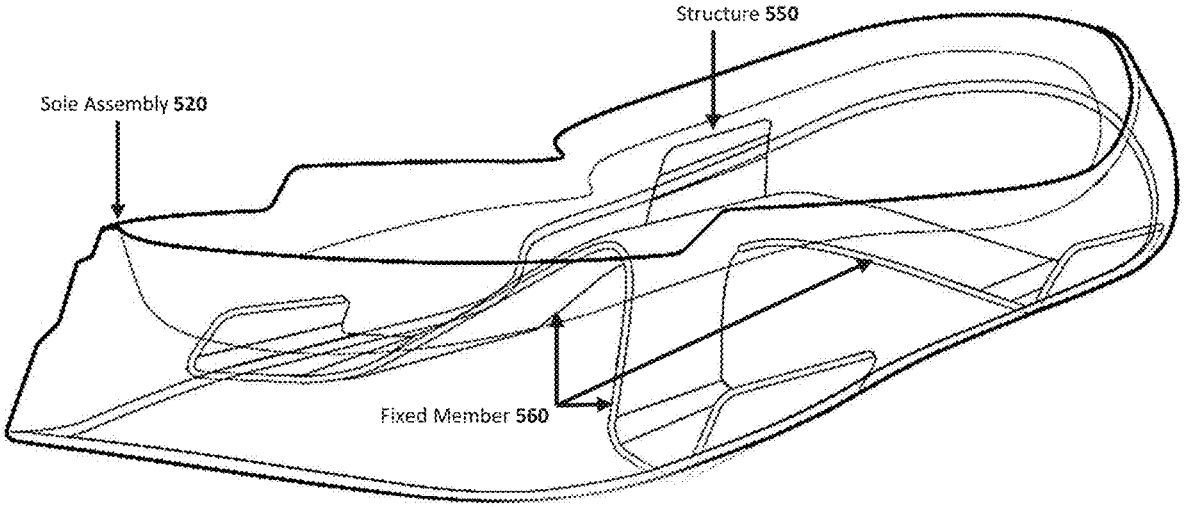
FIGS. 5A-5C depict various exemplary configurations of three-dimensional structures that can act as an internal torsion bar for a midsole or sole assembly, in accordance with some embodiments.
Figure 5B:
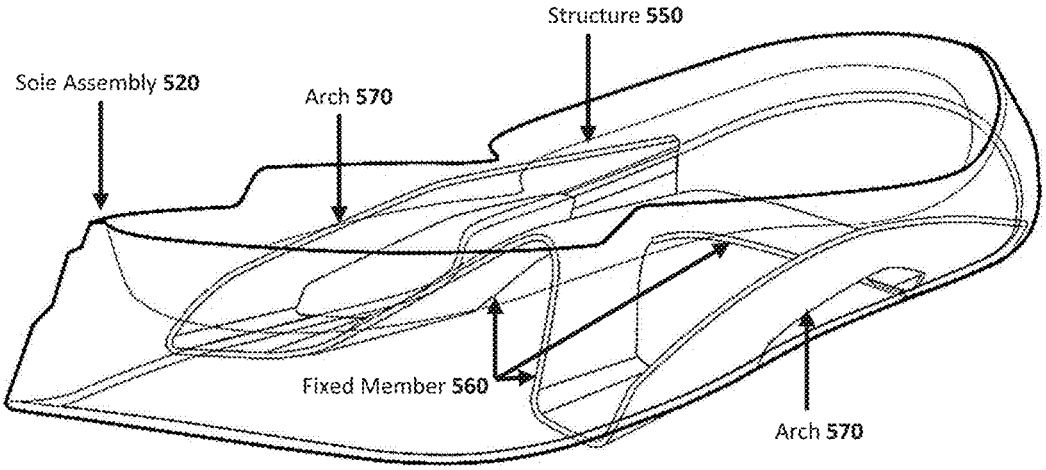
Figure 5C:
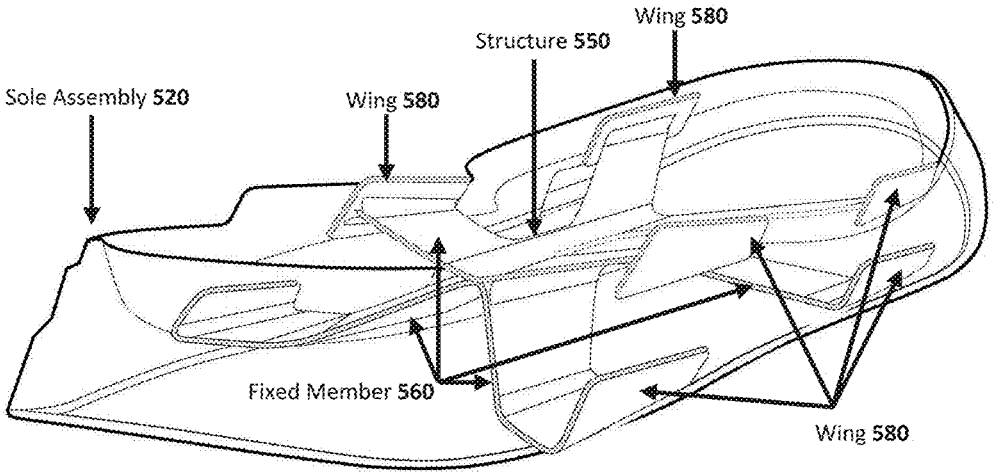
Figure 6A:
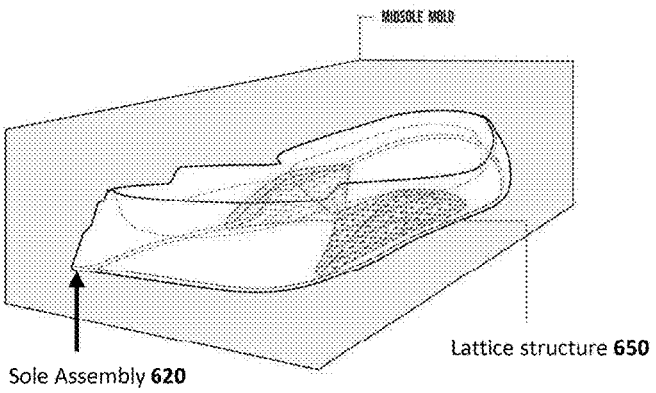
FIGS. 6A and 6B depict an exemplary sole assembly comprising a lattice structure, in accordance with some embodiments.

FIGS. 5A, 5B, and 5C illustrate various examples of a structure 550 that can act as an internal torsion bar for a sole assembly 520 of a shoe. In some cases, the structure 550 may be integrated with a midsole and/or an outsole portion of the sole assembly 520. In some cases, the structure 550 may be positioned between the midsole portion and the outsole portion of the sole assembly 520.

In some embodiments, the structure 550 may comprise one or more members 560. The one or more members 560 may extend between a medial side and a lateral side of the sole assembly 520. In some cases, the one or more members 560 may extend from a center region of the sole assembly 520 to a lateral or medial side of the sole assembly. In some cases, the one or more members 560 may contact the medial and lateral sides of the sole assembly 520.

In some cases, the structure 550 and/or the one or more members 560 may comprise a straight or linear section. In some cases, the structure 550 and/or the one or more members 560 may comprise a curved or arched section. In some cases, the structure 550 and/or the one or more members 560 may comprise one or more straight or linear sections and one or more curved or arched sections.

In some embodiments, the structure 550 and/or the one or more members 560 may curve or slope upwards and/or downwards. In some cases, the structure 550 and/or the one or more members 560 may curve or slope upwards as the structure 550 or the one or more members 560 extend from (i) a medial or lateral side of the sole assembly 520 to (ii) a center region of the sole assembly 520. In some cases, the structure 550 and/or the one or more members 560 may curve or slope downwards as the structure 550 or the one or more members 560 extend from (i) a center region of the sole assembly 520 to (ii) a medial or lateral side of the sole assembly 520. In some cases, the structure 550 and/or the one or more members 560 may curve or slope upwards at the medial and/or lateral side(s) of the sole assembly 520.

In some cases, the curvature of the structure 550 and/or the one or more members 560 at the medial and/or lateral side(s) of the sole assembly 520 may correspond to a curvature of a surface of the mold used to fabricate the sole assembly 520 with the embedded structure 550. In some cases, the shape or curvature of the structure 550 and/or the one or more members 560 may be configured to secure the structure 550 to the mold used to fabricate the sole assembly 520. The one or more members 560 may be configured to secure the structure 550 in a predetermined position or orientation within the mold used to fabricate the sole assembly 520.

In some embodiments, the one or more members 560 may extend from a center region of the sole assembly 520 to different medial or lateral regions of the sole assembly 520. In some cases, the one or more members 560 may comprise a member extending towards a lateral forefoot, midfoot, or rearfoot region of the sole assembly 520. In some cases, the one or more members 560 may comprise a member extending towards a medial forefoot, midfoot, or rearfoot region of the sole assembly 520.

In any of the embodiments described herein, the structure 550 may comprise a unitary structure comprising the one or more members 560. In some embodiments, the unitary structure 550 comprising the one or more members 560 may be formed from a single continuous piece of material. In some embodiments, the one or more members 560 may be connected to each other either directly or via an intermediary connecting region that spans a dimension (e.g., a length, a width, or a height) of the sole assembly 520. The intermediary connecting region may be, for example, a central structure from which the members 560 can extend (or any other type of structure that can function as a central hub for the members 560). In some embodiments, the intermediary connecting region may comprise a curved surface with one or more local maxima or minima from which the members 560 can extend. In some embodiments, the intermediary connecting region and the one or more members 560 may be formed from a single continuous piece of material.

Referring to FIG. 5B, in some embodiments, the structure 550 may further comprise one or more arches 570. The one or more arches 570 may be positioned at or near a medial side and/or a lateral side of the sole assembly 520. In some cases, the one or more arches 570 may extend from a forefoot region of the sole assembly 520 to a midfoot or rearfoot region of the sole assembly 520. In some cases, the one or more arches 570 may extend from a midfoot region of the sole assembly 520 to a rearfoot region of the sole assembly 520. The one or more arches 570 may span a dimension (e.g., a length, a width, or a height) of the sole assembly 520. In any of the embodiments described herein, the one or more arches 570 may be configured to provide additional structural support to further stiffen and/or reinforce the sole assembly 520.

Referring to FIG. 5C, in some embodiments, the structure 550 may comprise a plurality of members 560 extending from a central region of the sole assembly 520 to a lateral and/or medial side of the sole assembly 520. In some embodiments, the plurality of members 560 may comprise (i) a first set of members extending towards the lateral and/or medial side(s) of a first portion of the sole assembly 520 and (ii) a second set of members extending towards the lateral and/or medial side(s) of a second portion of the sole assembly 520. In some cases, the first portion of the sole assembly 520 and/or the second portion of the sole assembly 520 may correspond to a forefoot region, a midfoot region, and/or a rearfoot region of the sole assembly 520.

In some embodiments, the structure 550 may comprise one or more wings 580. In some cases, the one or more wings 580 may be disposed on a distal end of the one or more members 560. In some cases, the shape and/or curvature of the one or more wings 580 may correspond to a curvature of a mold used to fabricate the sole assembly 520. In some cases, the one or more wings 580 may be configured to secure the structure 550 to the mold used to fabricate the sole assembly 520. In some cases, the wings 580 may be configured to secure the structure 550 in a predetermined position or orientation within the mold used to fabricate the sole assembly 520.

In some embodiments, the one or more wings 580 may comprise (1) a first wing extending towards an upper region of a lateral or medial side of the sole assembly and (2) a second wing extending towards a lower region of a lateral or medial side of the sole assembly. The first wing may be disposed at an angle relative to the second wing. In some non-limiting embodiments, the angle between the first wing and the second wing may range from about 5 degrees to about 45 degrees or more. In some embodiments, the structure may comprise an upper wing and a lower wing disposed under or below the upper wing. In some cases, the angle between the upper wing and the lower wing may range from about 5 degrees to about 45 degrees or more.

Material Properties

In any of the embodiments described herein, the structure may have one or more desirable properties that allow the structure to support a subject's foot and optimally distribute forces or loads to different regions of the shoe to enhance traction, grip, stability, and comfort. In some embodiments, the structure may be configured to control a distribution of forces or loads on the midsole of the shoe and divert said forces or loads to one or more optimal locations or zones within the shoe or on a ground surface in order to assist a subject with executing an optimal golf-related motion (e.g., a golf swing). In some embodiments, the structure may be configured to control a distribution of forces or loads on the midsole of the shoe and divert said forces or loads to one or more optimal locations or zones within the shoe or on a ground surface in order to at least partially compensate for any deviations or variations between (i) an actual motion path or swing trajectory by the subject and (ii) an optimal motion path or swing trajectory for the subject.

In some cases, the one or more desirable properties may comprise a strength of the overall structure or the various members of the structure. The strength may include, for example, a compressive strength, a tensile strength, or a shear strength. As used herein, compressive strength may refer to the ability of a structure or material to withstand compressive loads. As used herein, tensile strength may refer to an amount of stress that a structure or material can withstand while being stretched or pulled before deforming or breaking. As used herein, shear strength may refer to the strength of a material or component against yields or structural failures that can occur when a material or structure experiences shear loads. A shear load may comprise a force that can produce a sliding failure in a material along a plane that is parallel to the direction of the force (e.g., by causing a portion of the internal structure of the material to slide against itself). In some cases, the structure may have a compressive strength ranging from about 10 Megapascals (MPa) to about 100 MPa or more. In some cases, the structure may have a tensile strength ranging from about 10 Megapascals (MPa) to about 100 MPa or more. In some cases, the structure may have a shear strength ranging from about 10 Megapascals (MPa) to about 100 MPa or more.

In some cases, the one or more desirable properties may comprise a stiffness of the overall structure or the various members of the structure. In some cases, the stiffness may include, for example, a flexural stiffness or a torsional stiffness. As used herein, flexural stiffness (also known as flexural rigidity) may refer to a force couple required to bend a structure or a material by a unit of curvature. The flexural stiffness may correspond to the resistance offered by the structure or material while undergoing a bending or flexing motion about an axis. As used herein, torsional stiffness may refer to the amount of torque required to twist an object or a material by a unit radian or degree. The torsional stiffness may be represented as a ratio of torque to the angular twist experience by a material. In some cases, the structure may have a flexural stiffness ranging from about 10 Newton-centimeters (N-cm) to about 100 N-cm or more. In some cases, the structure may have a torsional stiffness ranging from about 10 Newton-centimeters per degree (N-cm/deg) to about 100 N-cm/deg or more.

Lattice Structure

In some non-limiting embodiments, the structure may comprise a lattice structure. The lattice structure may comprise a collection or network of topologically ordered, three-dimensional open-celled structures comprising one or more unit cells. The one or more unit cells may be arranged in three-dimensional (3D) space based on a cell map. In some cases, the cell map may define or outline a relative position and orientation for each cell relative to one or more other cells of the lattice.

In some embodiments, the lattice may comprise a surface-based lattice that can be generated or modeled using one or more mathematical equations or expressions. In other embodiments, the lattice may comprise a strut-based lattice comprising one or more structural members (e.g., rods or beams) that intersect at one or more nodes. In some alternative embodiments, the lattice may comprise a planar lattice that can be created in a two-dimensional plane and extruded to create a 3D structure.

In some embodiments, the lattice may comprise a periodic lattice, a non-periodic lattice, or a stochastic lattice. In some embodiments, the lattice can be a beam lattice, a plate lattice, a honeycomb lattice, or a TPMS (triply periodic minimal surface) lattice. In some embodiments, the lattice structure may comprise a triangular lattice, a square lattice, a rectangular lattice, a rhombic lattice, an oblique lattice, or a hexagonal lattice.

In some embodiments, the lattice may comprise a homogeneous lattice structure with uniform lattice properties across the lattice structure. In other embodiments, the lattice may comprise a heterogenous lattice structure with lattice properties that vary across different regions or sections of the lattice structure.

In some embodiments, the structural members of the lattice may comprise a cross-section having a cross-sectional shape. The cross-sectional shape may correspond to a lateral or vertical cross-section of the structural members. In some cases, the cross-sectional shape may comprise a circular shape or a polygonal shape. In some cases, the cross-sectional shape may comprise, for example, a circle, an ellipse, or any polygon having three or more sides. The cross-sectional shape may comprise a regular shape (e.g., a shape having two or more sides with a same length) or an irregular shape (e.g., a shape having two or more sides with different lengths). In some cases, the cross-sectional shape may comprise at least one linear portion or section. In some cases, the cross-sectional shape may comprise at least one curved or non-linear portion or section. In some cases, the cross-sectional shape may comprise at least one linear portion or section and at least one curved or non-linear portion or section.

In some embodiments, the structural members of the lattice may comprise a cross-section having a cross-sectional shape that changes or varies along a dimension of the structural member. In some embodiments, different structural members of the lattice may comprise different cross-sectional shapes. In any of the embodiments described herein, the dimensions of the cross-sectional shape of the structural members may change along a length, a width, or a height of the structural members.

In some embodiments, the cross-sectional shape may comprise a plurality of dimensions. In some cases, a dimensional ratio between (i) a length or a width of the cross-sectional shape and (ii) a height of the cross-sectional shape may range from about 10:1 to about 1:10. In some embodiments, the cross-sectional shape may comprise one or more diagonal lengths or widths. The one or more diagonal lengths or widths may correspond to a distance between two or more sides or vertices of the cross-sectional shape. In some cases, a dimensional ratio between (i) a diagonal length or width of the cross-sectional shape and (ii) a height of the cross-sectional shape may range from about 10:1 to about 1:10. In some embodiments, the cross-sectional shape may comprise a plurality of diagonal lengths or widths. In some cases, the plurality of diagonal lengths or widths may comprise a first diagonal length or width and a second diagonal length or width. The first diagonal length may correspond to a first distance between a first set of sides or vertices of the cross-sectional shape, and the second diagonal length may correspond to a second distance between a second set of sides or vertices of the cross-sectional shape. The first set of sides or vertices may be different than the second set of sides or vertices. In some non-limiting embodiments, a dimensional ratio between (i) a first diagonal length or width of the cross-sectional shape and (ii) a second diagonal length or width of the cross-sectional shape may range from about 10:1 to about 1:10.

In some embodiments, the cross-sectional shape of the structural members of the lattice may comprise one or more dimensions. The one or more dimensions may correspond to a length, a width, or a height of the structural members. In some embodiments, the length of the structural members may range from about 1 mm to about 10 mm or more. In some embodiments, the width of the structural members may range from about 1 mm to about 10 mm or more. In some embodiments, the height of the structural members may range from about 1 mm to about 10 mm or more.

In some embodiments, the entire lattice structure may span a length, a width, or a height of the midsole. In some embodiments, the lattice structure may span a first distance corresponding to the length of the midsole. The first distance may range from about 1 cm to about 30 cm. In some embodiments, the lattice structure may span a second distance corresponding to the width of the midsole. The second distance may range from about 1 cm to about 10 cm. In some embodiments, the lattice structure may span a third distance corresponding to the height of the midsole. The third distance may range from about 1 cm to about 5 cm.

Figure 6C:
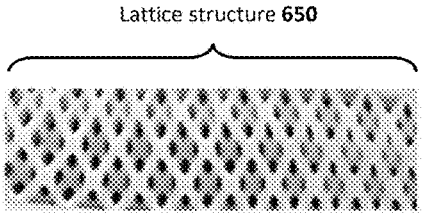
FIG. 6C depicts an exemplary lattice structure that can be incorporated into or integrated with a portion of a sole assembly, in accordance with some embodiments.
Figure 6B:
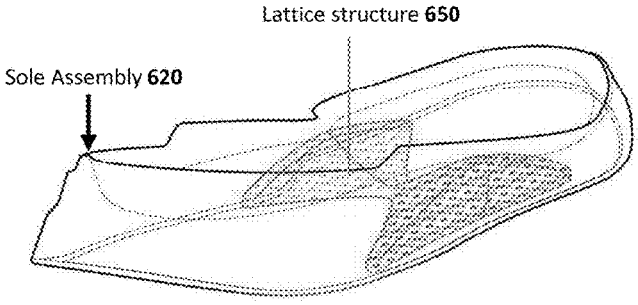

FIGS. 6A, 6B, and 6C illustrate various examples of lattice structures 650 that can be embedded in or integrated with a midsole of a sole assembly 620. In some embodiments, the lattice structure 650 may be positioned at or near a midfoot region of the sole assembly 620 to internally reinforce and stiffen the sole assembly 620 (e.g., to resist deformation, flex, or wear due to torsional or shear forces).

In some embodiments, the lattice structure 650 may extend through a central portion or region of the sole assembly 620. In some embodiments, the lattice structure 650 may comprise one or more sides that fan out and span a length of the medial and lateral sides of the sole assembly 620. The one or more sides may be sized and/or shaped to provide arch support. In some cases, the sides of the lattice may span a greater length of the sole assembly 620 than a medial region of the lattice that extends between the medial and lateral sides of the sole assembly 620. In some non-limiting embodiments, the thickness of the lattice structure 650 can gradually increase as the lattice extends from a central region of the sole assembly 620 to a lateral or medial side of the sole assembly 620. In some cases, the thickness of the lattice structure 650 may correspond to a vertical height of the sole assembly 620. In some non-limiting embodiments, the volume of the lattice structure 650 can gradually increase as the lattice extends from a central region of the sole assembly 620 to a lateral or medial side of the sole assembly 620.

Lattice Properties

In some embodiments, the lattice structure may comprise a first region having a first lattice property and a second region having a second lattice property. In some cases, the first lattice property and the second lattice property may provide or impart different material properties to different portions or regions of the shoe. The first lattice property and/or the second lattice property may be selected from the group consisting of a lattice geometry, a lattice density, and a lattice material composition. The different material properties imparted to the different portions of the shoe may include, for example, a strength (e.g., a compressive strength, a tensile strength, or a shear strength) or a stiffness (e.g., a flexural or torsional stiffness) of a forefoot, midfoot, or rearfoot region of the upper or the sole assembly (or any portion or layer thereof). In some embodiments, the different material properties imparted to the different portions of the shoe may include, for example, a strength (e.g., a compressive strength, a tensile strength, or a shear strength) or a stiffness (e.g., a flexural or torsional stiffness) of an insole component of the shoe or a midsole of the shoe sole assembly.

In some embodiments, the first and second lattice property may include a lattice strength. The lattice strength may comprise a compressive strength, a tensile strength, or a shear strength. As used herein, compressive strength may refer to the ability of a structure or material to withstand compressive loads. As used herein, tensile strength may refer to an amount of stress that a structure or material can withstand while being stretched or pulled before deforming or breaking. As used herein, shear strength may refer to the strength of a material or component against yields or structural failures that can occur when a material or structure experiences shear loads. A shear load may comprise a force that produces a sliding failure in a material along a plane that is parallel to the direction of the force (e.g., by causing a portion of the internal structure of the material to slide against itself). In some cases, the structure may have a compressive strength ranging from about 10 Megapascals (MPa) to about 100 MPa or more. In some cases, the structure may have a tensile strength ranging from about 10 Megapascals (MPa) to about 100 MPa or more. In some cases, the structure may have a shear strength ranging from about 10 Megapascals (MPa) to about 100 MPa or more.

In some embodiments, the first and second lattice property may include a lattice stiffness. The lattice stiffness may comprise a flexural stiffness or a torsional stiffness. As used herein, flexural stiffness (also known as flexural rigidity) may refer to a force couple required to bend a structure or a material by a unit of curvature. The flexural stiffness may correspond to the resistance offered by the structure or material while undergoing a bending or flexing motion about an axis. As used herein, torsional stiffness may refer to the amount of torque required to twist an object or a material by a unit radian or degree. The torsional stiffness may be represented as a ratio of torque to the angular twist experience by a material. In some cases, the structure may have a flexural stiffness ranging from about 10 Newton-centimeters (N-cm) to about 100 N-cm or more. In some cases, the structure may have a torsional stiffness ranging from about 10 Newton-centimeters per degree (N-cm/deg) to about 100 N-cm/deg or more.

ADDITIONAL EMBODIMENTS

Figure 7:
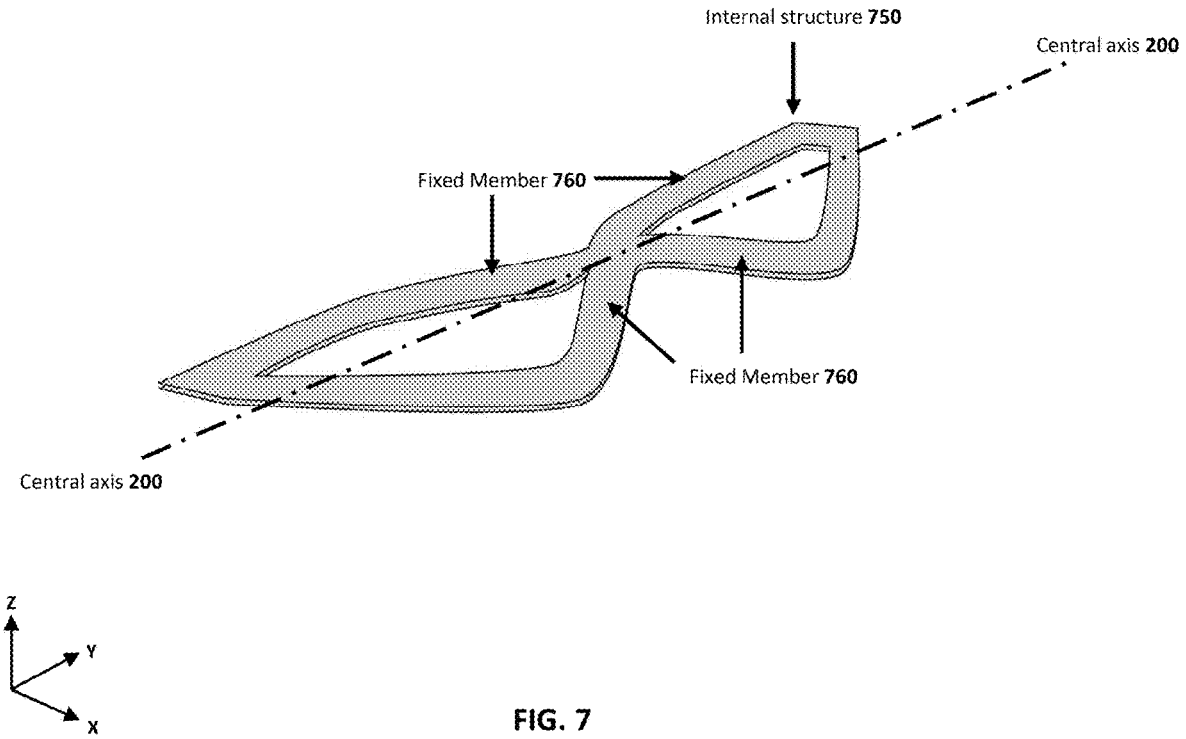
FIG. 7 depicts an example of a structure that can be embedded in or integrated with a midsole or sole assembly, in accordance with some embodiments.

In some embodiments, (e.g., as shown in FIG. 7), the structure 750 embedded in or integrated with the sole assembly may comprise a plurality of members 760 extending from a central region of the sole assembly to a plurality of different lateral and/or medial regions of the sole assembly. In some cases, the central region of the sole assembly may be aligned with a central axis 200 of the sole assembly. In some cases, the plurality of members 760 may extend from a central region of the sole assembly to a plurality of different lateral and/or medial regions of the sole assembly. The plurality of different lateral and/or medial regions may be located at or near a forefoot, midfoot, or rearfoot region of the sole assembly. In some non-limiting embodiments, the plurality of members 760 may be joined at the posterior and/or anterior ends of the structure 750 to form a closed shape. In some cases, the closed shape may approximate the shape of a lemniscate (co) or a figure-8. In some cases, the closed shape may comprise one or more curved sections and/or one or more linear or angled sections. In some cases, the one or more linear or angled sections may diverge at or near a central portion of the structure 750. In some cases, the one or more linear or angled sections may converge at or near an anterior or posterior end of the structure 750.

Figure 8A:
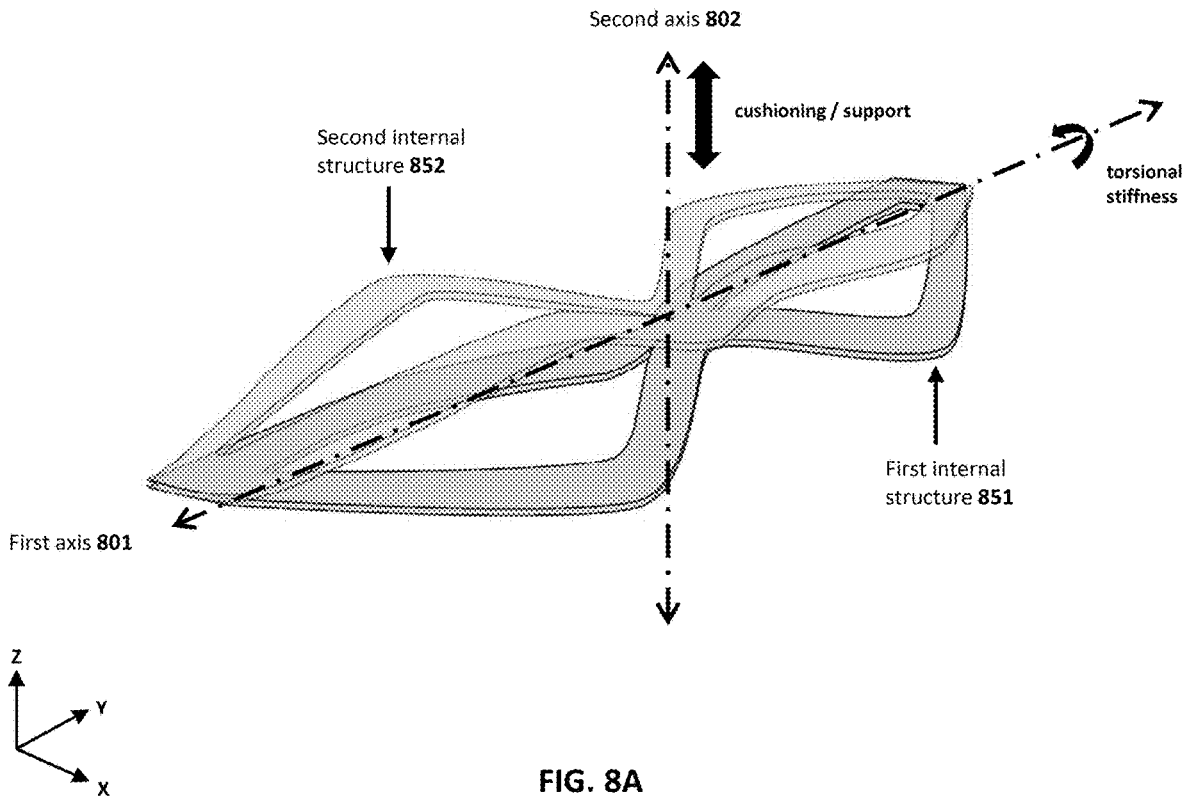
FIGS. 8A-8E depict various examples of a structure that can be embedded in or integrated with a midsole or a sole assembly to (i) enhance cushioning/support in or along a first axis and (ii) optimize torsional stiffness in or along a second axis, in accordance with some embodiments.
Figure 8B:
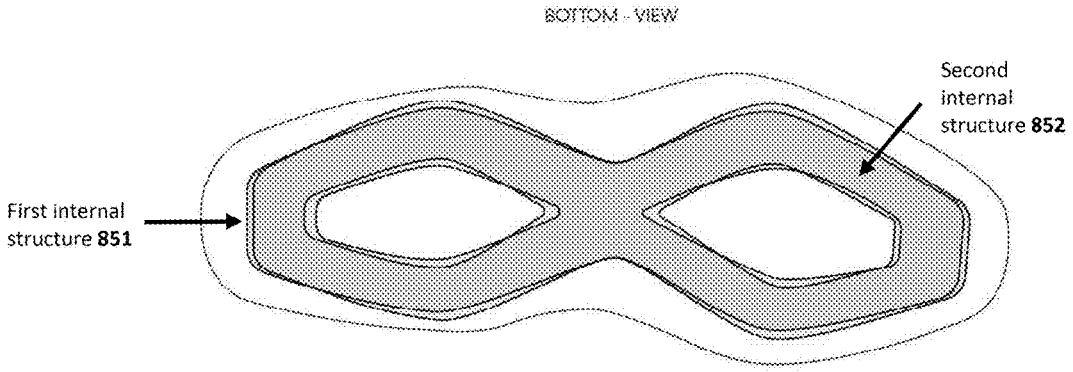
Figure 8C:
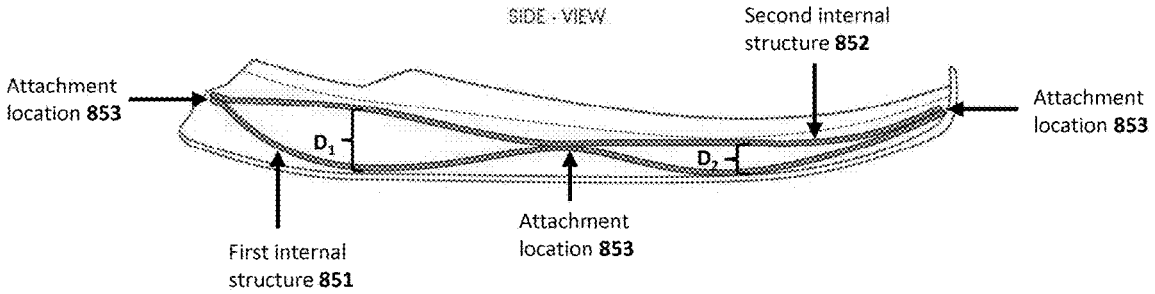

In some embodiments (e.g., as shown in FIG. 8A), the structure embedded in or integrated with the sole assembly may comprise a first internal structure 851 and a second internal structure 852 that is flexibly coupled or attached to the first internal structure 851. The first internal structure 851 and/or the second internal structure 852 may be provided in or as part of the midsole or the sole assembly. In some cases (e.g., as shown in FIGS. 8B and 8C), the second internal structure 852 may be positioned above the first internal structure 851. In some alternative embodiments, the first internal structure 851 may be positioned above the second internal structure 852.

In some embodiments, the first internal structure 851 and the second internal structure 852 may be attached at one or more locations 853 as shown in FIG. 8C. In some cases, the one or more attachment locations 853 may be located at or near a forefoot, midfoot, and/or rearfoot region of the sole assembly. In some embodiments, the first internal structure 851 and the second internal structure 852 may be joined at the one or more attachment locations 853. In some cases, the first internal structure 851 and the second internal structure 852 may be sized, shaped, positioned, and/or oriented such that the first internal structure 851 and the second internal structure 852 are separated by an adjustable distance at a first section within the sole assembly. In some cases, the first internal structure 851 and the second internal structure 852 may be sized, shaped, positioned, and/or oriented such that the first internal structure 851 and the second internal structure 852 are separated by an adjustable distance $D_2$ at a second section within the sole assembly. In any of the embodiments described herein, distance $D_1$ and/or distance $D_2$ can change as forces are exerted on the sole assembly and the first internal structure 851 and/or the second internal structure 852 flex or move relative to each other in response to the forces exerted on the sole assembly.

In some embodiments, the structure embedded in or integrated with the sole assembly may comprise a first internal structure 851 and a second internal structure 852. In some embodiments, the first internal structure 851 and the second internal structure 852 may be configured to collectively and synergistically control a deformation or a flex of the sole assembly in or along two or more axes. For example, in some cases, the first internal structure 851 may be configured to provide torsional strength in or along a first axis 801, and the second internal structure 852 may be configured to provide cushioning or suspension support in or along a second axis 802.

In some embodiments, the first axis 801 may correspond to the central axis 200 schematically illustrated in the preceding figures. In some embodiments, the first axis 801 may be offset relative to the central axis 200. The offset may comprise, for example, an angular offset and/or an offset distance.

In some embodiments, the second axis 802 may correspond to a vertical or substantially vertical axis that is normal or substantially normal to a surface of the sole assembly. In some cases, the second axis 802 may intersect a midline axis extending between a lateral side and a medial side of the sole assembly. In other cases, the second axis 802 may not or need not intersect a midline axis extending between the lateral and medial sides of the sole assembly. The midline axis may, in some cases, intersect the central axis 200 of the sole assembly at a distance halfway or approximately halfway between the anterior and posterior ends of the shoe.

In some embodiments, the first axis 801 and the second axis 802 may form a plane comprising the first axis 801 and the second axis 802. Within the plane, the first axis 801 and the second axis 802 may be disposed at an angle relative to each other. In some cases, the angle may range from about 5 degrees to about 10 degrees, about 10 degrees to about 15 degrees, about 15 degrees to about 20 degrees, about 20 degrees to about 25 degrees, about 25 degrees to about 30 degrees, about 30 degrees to about 35 degrees, about 35 degrees to about 40 degrees, about 40 degrees to about 45 degrees, about 45 degrees to about 50 degrees, about 50 degrees to about 55 degrees, about 55 degrees to about 60 degrees, about 60 degrees to about 65 degrees, about 65 degrees to about 70 degrees, about 70 degrees to about 75 degrees, about 75 degrees to about 80 degrees, about 80 degrees to about 85 degrees, or about 85 degrees to about 90 degrees. In some cases, the angle may be greater than or equal to about 90 degrees.

Figure 8D:
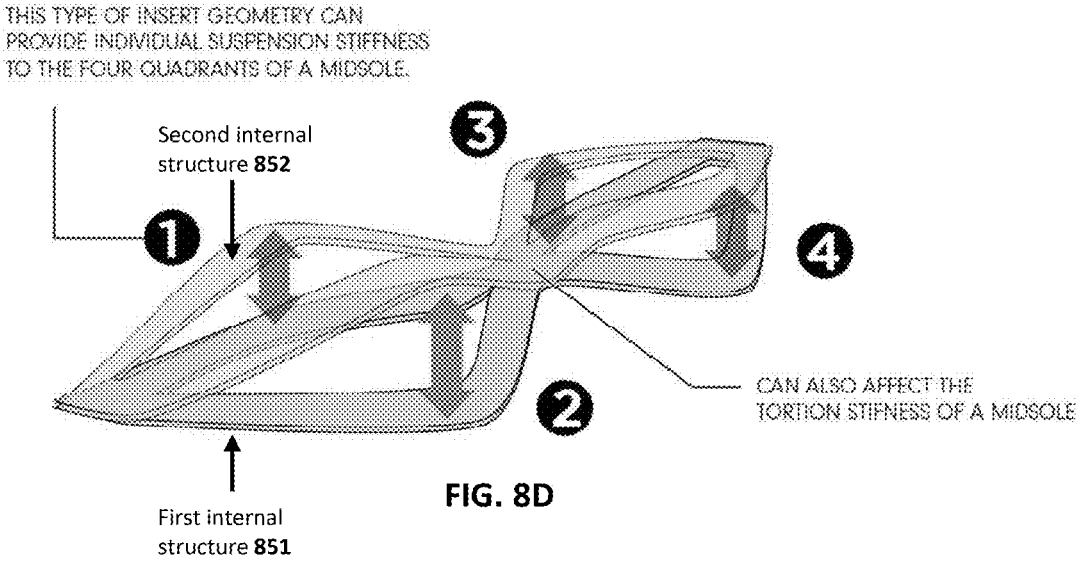

Referring to FIG. 8D, in some embodiments, the second internal structure 852 may be configured to flex or move relative to the first internal structure 851 positioned below the second internal structure 852. In some non-limiting embodiments, the flexing or movement of the second internal structure 852 may be in or along a vertical or substantially vertical axis (e.g., the second axis 802 shown in FIG. 8A). In other non-limiting embodiments, the flexing or movement of the second internal structure 852 may not or need not be in or along a vertical or substantially vertical axis. In some cases, the first internal structure 851 and/or the second internal structure 852 may be configured to provide suspension stiffness to various portions or quadrants of the sole assembly. In some cases, the first internal structure 851 and/or the second internal structure 852 may be further configured to enhance a torsional stiffness of the sole assembly.

Figure 8E:
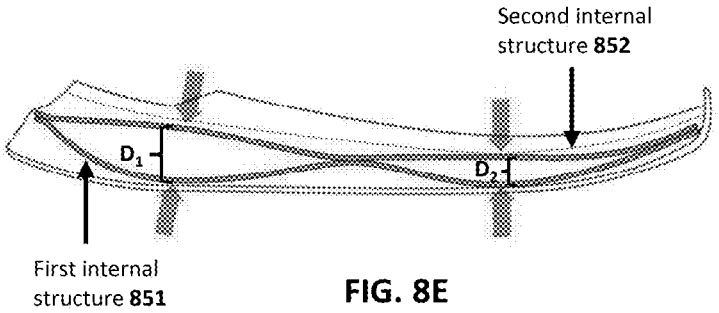

Referring to FIG. 8E, in some cases, the first internal structure 851 and/or the second internal structure 852 may be configured to flex towards each other when a force is exerted on the sole assembly. The force exerted on the sole assembly may include a compressive force and/or a torsional or shear force. In some embodiments, the flexing of the first internal structure 851 and/or the second internal structure 852 may help to cushion and support a subject's foot (e.g., during a golf-related action) and absorb or distribute forces exerted on the sole assembly to different components or sections of the shoe or sole assembly. In some cases, the flexing of the first internal structure 851 and/or the second internal structure 852 may change the gap distance D 1 and $D_2$ between the first internal structure 851 and/or the second internal structure 852.

In some embodiments, the arrangement and coupling of the first internal structure 851 and the second internal structure 852 may yield a structure with a vertical spring force constant. In some cases, the vertical spring force constant may range from about 0.01 N/m to about 10 N/m or more.

Dimensions

The structure embedded in or integrated with the midsole or the sole assembly may have various dimensions. In some cases, the structure may be sized and shaped to fit entirely within the midsole or the sole assembly. In some cases, the structure may be sized and shaped such that only a select portion of the structure is exposed or visible past the outer contours of the midsole or the sole assembly.

In some embodiments, the structure may have a width spanning at least a portion of the width of the midsole or the sole assembly. The width of the structure may vary depending on the width of the midsole or the sole assembly between the medial and lateral sides of the midsole or sole assembly. In some cases, the structure may have a width of at least about 5%, 10%, 15%, 20%, 25%, 30%, 35%, 40%, 45%, 50%, 55%, 60%, 65%, 70%, 75%, 80%, 85%, 90%, 95% or more of the width of the midsole or the sole assembly.

In some embodiments, the structure may have a length spanning at least a portion of the length of the midsole or the sole assembly. The length of the midsole or the sole assembly may correspond to a distance between the anterior and posterior ends of the midsole or sole assembly. In some cases, the structure may have a length of at least about 5%, 10%, 15%, 20%, 25%, 30%, 35%, 40%, 45%, 50%, 55%, 60%, 65%, 70%, 75%, 80%, 85%, 90%, 95% or more of the length of the midsole or the sole assembly.

In some embodiments, the structure may have a height spanning at least a portion of the height of the midsole or the sole assembly. The height of the midsole may correspond to (i) a distance between a portion of the midsole contacting the outsole and (ii) a portion of the midsole contacting the insole or the upper. The height of the sole assembly may correspond to (i) a distance between a portion of the outsole proximal to the ground and (ii) a portion of the sole assembly contacting the insole or the upper. In some cases, the structure may have a height of at least about 5%, 10%, 15%, 20%, 25%, 30%, 35%, 40%, 45%, 50%, 55%, 60%, 65%, 70%, 75%, 80%, 85%, 90%, 95% or more of the height of the midsole or the sole assembly.

In some embodiments, the structure may comprise one or more structural members extending through a portion of the midsole or sole assembly. The one or more structural members may comprise a cross-section having a cross-sectional shape as described elsewhere herein. The cross-sectional shape may comprise one or more dimensions. In some cases, the one or more dimensions may correspond to a length, a width, and/or a height of the one or more structural members. In some embodiments, the length or width of the cross-sectional shape may range from about 1 cm to about 10 cm or more. In some embodiments, the height of the cross-sectional shape may range from about 1 cm to about 5 cm or more.

In some embodiments, the cross-sectional shape may comprise a plurality of dimensions. In some cases, a dimensional ratio between (i) a length or a width of the cross-sectional shape and (ii) a height of the cross-sectional shape may range from about 10:1 to about 1:10. In some embodiments, the cross-sectional shape may comprise one or more diagonal lengths or widths. The one or more diagonal lengths or widths may correspond to a distance between two or more sides or vertices of the cross-sectional shape. In some cases, a dimensional ratio between (i) a diagonal length or width of the cross-sectional shape and (ii) a height of the cross-sectional shape may range from about 10:1 to about 1:10. In some embodiments, the cross-sectional shape may comprise a plurality of diagonal lengths or widths. In some cases, the plurality of diagonal lengths or widths may comprise a first diagonal length or width and a second diagonal length or width. The first diagonal length may correspond to a first distance between a first set of sides or vertices of the cross-sectional shape, and the second diagonal length may correspond to a second distance between a second set of sides or vertices of the cross-sectional shape. The first set of sides or vertices may be different than the second set of sides or vertices. In some non-limiting embodiments, a dimensional ratio between (i) a first diagonal length or width of the cross-sectional shape and (ii) a second diagonal length or width of the cross-sectional shape may range from about 10:1 to about 1:10.

In some embodiments, the entire structure may span a length, a width, or a height of the midsole. In some embodiments, the structure may span a first distance corresponding to the length of the midsole. In some cases, the first distance may range from about 1 cm to about 30 cm. In some embodiments, the structure may span a second distance corresponding to the width of the midsole. The second distance may range from about 1 cm to about 10 cm. In some embodiments, the structure may span a third distance corresponding to the height of the midsole. The third distance may range from about 1 cm to about 5 cm.

True to Size

In any of the embodiments, the structure may comprise a true to size structure that can be integrated with or inserted or embedded in a midsole or sole assembly. As used herein, the term "true to size" may refer to a structure that is sized and shaped according to one or more predetermined dimensions such that the size and shape of the structure when placed in a mold (to directly produce a midsole or sole assembly comprising a custom integrated or embedded structure) is the same size and shape needed for the structure to support and stabilize the final production midsole or sole assembly. In some cases, the size and shape of the structure when placed in a mold may be the approximate size and shape needed to support and stabilize the final production midsole or sole assembly. In some cases, the size and shape of the structure when placed in a mold may be the exact size and shape needed to support and stabilize the final production midsole or sole assembly.

As described in further detail below, the use of true to size structures, in combination with molding techniques such as 1:1 scale molding, can greatly simplify and expedite the manufacturing process for golf shoes with sole assemblies comprising embedded or integrated structures or inserts. Compared to conventional methods, the presently disclosed methods leverage 1:1 scale molding and true to size structures to simultaneously or concurrently (i) fabricate a foam midsole or sole assembly and (ii) integrate or embed the true to size structures within the foam midsole or sole assembly, in a single molding process (in some cases using a single mold). The methods of the present disclosure can effectively enable high throughput manufacturing and production of golf shoes with midsoles or sole assemblies having embedded or integrated internal structures by simplifying the process for integrating internal structures in foam midsoles or sole assemblies (and avoiding the need to wait for a foam material to fully expand before integrating the internal structure with the midsole or sole assembly, which is traditionally required for conventional EVA foaming methods).

Materials

In some embodiments, the structure and/or the one or more members of the structure may comprise a rigid or semi-rigid material. In some embodiments, the structure and/or the one or more members of the structure may comprise a deformable or elastic material. In some embodiments, the structure and/or the one or more members of the structure may be configured to bend or flex in response to a force exerted on the shoe by a subject (e.g., a golfer) during a golf-related movement or action.

In some embodiments, the structure and/or the one or more members of the structure may comprise a metallic material. The metallic material may include one or more of aluminum, calcium, magnesium, barium, scandium, titanium, vanadium, chromium, manganese, iron, cobalt, nickel, copper, zinc, yttrium, niobium, molybdenum, ruthenium, rhodium, silver, cadmium, actinium, and/or gold. In some cases, the metallic material may comprise a rare earth element. The rare earth element may include scandium, yttrium, or elements of the lanthanide series having atomic numbers 57-71.

In some embodiments, the structure and/or the one or more members of the structure may comprise an intermetallic material. The intermetallic material may be a solid-state compound exhibiting metallic bonding, defined stoichiometry and ordered crystal structure (i.e., alloys). The intermetallic material may include, for example, brass (copper and zinc), bronze (copper and tin), duralumin (aluminum, copper, manganese, and/or magnesium), gold alloys (gold and copper), rose-gold alloys (gold, copper, and zinc), nichrome (nickel and chromium), and stainless steel (iron, carbon, and additional elements including manganese, nickel, chromium, molybdenum, boron, titanium, silicon, vanadium, tungsten, cobalt, and/or niobium). In some cases, the intermetallic material may include superalloys. The superalloys may be based on elements including iron, nickel, cobalt, chromium, tungsten, molybdenum, tantalum, niobium, titanium, and/or aluminum.

In some embodiments, the structure and/or the one or more members of the structure may comprise a ceramic material. The ceramic material may comprise a metal (e.g., aluminum, titanium, etc.), a non-metal (e.g., oxygen, nitrogen, etc.), and/or a metalloid (e.g., germanium, silicon, etc.) having atoms primarily held in ionic and/or covalent bonds. Examples of the ceramic materials may include, for example, an aluminide, boride, beryllia, carbide, chromium oxide, hydroxide, sulfide, nitride, mullite, kyanite, ferrite, titania zirconia, yttria, and/or magnesia.

In some embodiments, the structure and/or the one or more members of the structure may comprise a composite material. The composite material may include, for example, a carbon composite material, a fiberglass composite material, a thermoplastic composite material, or any other material that can provide additional structural rigidity to the midsole or the sole assembly of a shoe.

In some embodiments, the structure and/or the one or more members of the structure may comprise a binding polymer matrix and reinforcing fiber. The binding polymer can include, for example, a thermoset material such as polyester, polyolefin, nylon, or polyurethane. In some cases, the reinforcing fiber may comprise one or more carbon fibers. The carbon fibers may comprise a material such as graphite. Other fibers, such as aramids (e.g., Kevlar™), aluminum, or glass fibers can also be used in addition to or in place of the carbon fibers.

In some embodiments, the structure and/or the one or more members of the structure may comprise a plastic material. The plastic material may include, for example, thermoplastic polyurethane (TPU), polyethylene terephthalate (PET), polypropylene (PP), polycarbonate (PC), polyvinyl chloride (PVC), and the like.

Material Properties

As described elsewhere herein, the structure comprising the one or more members may be integrated with or embedded in a foam material. The foam material and the structure embedded in or integrated with the foam material may collectively form a midsole or sole assembly of a golf shoe as presently described.

The structure and the foam material surrounding or encapsulating the structure may comprise various different materials. In some cases, the structure and the foam material may have different material properties. In some embodiments, the structure may have a higher melting temperature than the foam material, which can help to prevent the structure from melting or otherwise deforming when the foam material is being formed or processed (e.g., physically, chemically, thermally, or optically using one or more electromagnetic waves) in a mold. In some embodiments, the structure may have a greater flexural and/or torsional stiffness or rigidity than the foam material. In other embodiments, the structure may have a greater compressive strength, tensile strength, or shear strength than the foam material.

In any of the embodiments described herein, the structure integrated with or embedded in the midsole may have multiple regions with different material properties. The different material properties may include, for example, a hardness, a softness, a stiffness, a rigidity, a tensile strength, or any of the other material properties described elsewhere herein. In some cases, the multiple regions of the internal structure may have a same or similar material composition. In other cases, the multiple regions of the internal structure may have different material compositions.

In some non-limiting embodiments, the structure may comprise a first portion and a second portion. In some cases, the first portion and the second portion may be located in different regions of the midsole. The different regions of the midsole may include, for instance, a forefoot region, a midfoot region, a rearfoot region, a medial side, a lateral side, an anterior end, and/or a posterior end of the midsole. In some cases, the first portion and the second portion may be located in different subregions of the midsole. The different subregions of the midsole may include, for instance, different sections or locations within the various regions (e.g., forefoot, midfoot, rearfoot, lateral, medial, anterior, posterior, etc.) of the midsole. In any of the embodiments described herein, the first portion of the structure and the second portion of the structure may have a different hardness, softness, stiffness, rigidity, and/or tensile strength in order to enhance the overall comfort, fit, and/or performance of the shoes described herein.

In some embodiments, the material properties of various portions of the structure may change or vary depending on the material properties of the respective sections of the midsole in which the structure is embedded or integrated. In some embodiments, a first portion of the structure may be located in a first region of the midsole, and a second portion of the structure may be located in a second region of the midsole. In some embodiments, the first portion of the structure may have a greater hardness, stiffness, rigidity, and/or tensile strength than the second portion of the structure in order to increase or enhance the hardness, stiffness, rigidity, and/or tensile strength of the first region of the midsole relative to the second region of the midsole. In other embodiments, the second portion of the structure may have a greater hardness, stiffness, rigidity, and/or tensile strength than the first portion of the structure in order to increase or enhance the hardness, stiffness, rigidity, and/or tensile strength of the second region of the midsole relative to the first region of the midsole. In any of the embodiments described herein, the material properties of the various portions of the structure may be optimized or adjusted to complement or enhance the material properties of the various regions of the midsole, thereby improving the overall comfort, fit, and/or performance of the shoes described herein.

Movement of Structure

In some embodiments, the structures described herein may be configured to move (e.g., flex, bend, twist, or otherwise deform along or about one or more axes in three-dimensional space) relative to the midsole or sole assembly as a subject exerts one or more forces on the midsole or sole assembly during a golf-related movement. In some cases, the structures may be configured to flex, bend, twist, or otherwise deform in a controlled manner when forces are exerted on the midsole or sole assembly, in order to provide one or more desired performance characteristics that can aid the subject in performing various golf-related movements.

Lateral Support

In some embodiments, the structures may be configured to deform in a controlled manner in order to provide cushioning and/or lateral support for a golf-related action. For example, when a subject is walking, running, or swinging a golf club, the structures may be configured to flex to absorb the impact forces exerted on the midsole or sole assembly. In some cases, a first member of the structure may flex or bend towards a second member of the structure. In other cases, the first member of the structure may flex or bend away from the second member of the structure. In some cases, one or more members of the structure may be configured to flex or bend towards a forefoot, midfoot, and/or rearfoot region of the midsole or sole assembly. In some cases, one or more members of the structure may be configured to flex or bend towards an upper or lower region of the midsole. In some cases, the one or more members of the structure may be configured to flex or bend towards a lateral and/or medial side of the midsole or sole assembly. In some cases, the flexing or bending of the structures or the members may provide an elastic spring force that promotes a rolling or a transition of the subject's foot during a golf-related motion. The rolling or transition may occur in a direction between a rearfoot region and a forefoot region of the subject's foot. In some cases, the rolling or transition may occur in a direction between a lateral side and a medial side of the subject's foot.

In some embodiments, the structures disclosed herein may be embedded in or integrated with a midsole or a sole assembly of a golf shoe to enhance a lateral support characteristic of the midsole or the sole assembly. In some cases, the structure embedded in or integrated with the midsole or sole assembly may be configured to enhance a lateral support characteristic of the midsole or the sole assembly. The lateral support characteristic may be associated with a level of cushioning or an amount of elastic energy that can be provided by the midsole or the sole assembly and the structure integrated with or embedded in the midsole or sole assembly.

Stiffness/Rigidity

In some embodiments, the structures may be configured to resist deformation in order to enhance a torsional strength, stiffness, or rigidity of the midsole or sole assembly. In some cases, the structures may be configured to resist a deformation due to forces exerted on the midsole or sole assembly. The forces exerted on the midsole or sole assembly may comprise, for example, lateral or vertical forces and/or torsional or shear forces. Such forces may be exerted on the midsole or sole assembly during a golf-related action (e.g., a golf swing). In some cases, the forces exerted on the midsole or sole assembly may be associated with a weight shift or a pivoting of the subject's foot during a backswing or a downswing.

In some embodiments, the structures may be configured to resist a deformation due to compression in one or more directions in three-dimensional space. In some embodiments, the structures may be configured to resist a deformation due to a twisting or a sliding motion along one or more axes in three-dimensional space. In some cases, the structures may be configured to resist deformation in a plurality of directions and/or along one or more axes.

In some cases, the structures may be configured to (i) resist deformation in a first set of directions and/or along a first set of axes and (ii) deform more easily in a second set of directions and/or along a second set of axes (e.g., when a force profile that is exerted on the midsole or sole assembly changes). In some instances, when a subject is walking on a green or crouching down to line up a shot or, a portion of the structure may be configured to deform or bend in order to allow the subject to comfortably flex various regions of the shoe (e.g., the forefoot and/or midfoot regions of the midsole or sole assembly) relative to each other. However, when the subject is executing a golf swing and exerting compressive and/or shear stresses on the midsole or sole assembly, the structures may be configured to resist deformation due to such stresses, thereby stiffening and stabilizing the shoe for maximum performance and control.

In some embodiments, the structures disclosed herein may be embedded in or integrated with a midsole or a sole assembly to enhance a flexural and/or torsional strength, stiffness, or rigidity of the midsole or the sole assembly. In some cases, the structure embedded in or integrated with the midsole or sole assembly may be configured to enhance a flexural and/or torsional strength or rigidity of the midsole or the sole assembly. In some cases, the midsole or sole assembly may have a flexural rigidity ranging from about 10 Newton-centimeters (N-cm) to about 100 N-cm or more. In some cases, the midsole or sole assembly may have a flexural strength ranging from about 100 megapascals (MPa) to about 500 MPa or more. In some cases, the midsole or sole assembly may have a flexural modulus ranging from about 5,000 MPa to about 10,000 MPa or more. In some cases, the midsole or sole assembly may have a torsional rigidity ranging from about 10 Newton-centimeters (N-cm) to about 100 N-cm or more. In some cases, the midsole or sole assembly may have a torsional stiffness ranging from about 10 Newton-centimeters per degree (N-cm/deg) to about 100 N-cm/deg or more. In some cases, the midsole or sole assembly may have a torsional shear modulus ranging from at least about 0.1 MPa to at least about 100 MPa or more.

Force Distribution

In some embodiments, the structures may be configured to absorb and distribute forces exerted on the midsole or sole assembly during a golf-related action or movement in order to stabilize and control a subject's foot while maximizing traction and grip. In some cases, the one or more members of the presently disclosed structures may be configured to distribute forces exerted on the sole assembly or a portion thereof to a plurality of regions of the golf shoe, thereby enhancing a stability and a traction of the golf shoe. The plurality of regions may comprise, for example, a lateral forefoot, midfoot, or rearfoot region of the golf shoe and/or a medial forefoot, midfoot, or rearfoot region of the golf shoe. In some cases, the one or more members may be configured to distribute forces exerted on the sole assembly or a portion thereof to two or more different sides, sections, or quadrants of the golf shoe. In some cases, the one or more members may be configured to selectively distribute the forces exerted on the sole assembly or a portion thereof to one or more traction elements of the golf shoe. In some cases, the traction elements may be aligned with a vector corresponding to a direction in which a force is exerted or distributed or redirected by the members of the structure.

Spring Plate Structures

As described elsewhere herein, an insert can be customized for a shoe based on a subject's anatomy and/or swing biomechanics. In some cases, the physical shape and/or configuration of the insert can be customized. In other cases, the position and/or orientation of the insert within a sole assembly can be customized (e.g., to optimize the subject's swing biomechanics).

Figure 9:
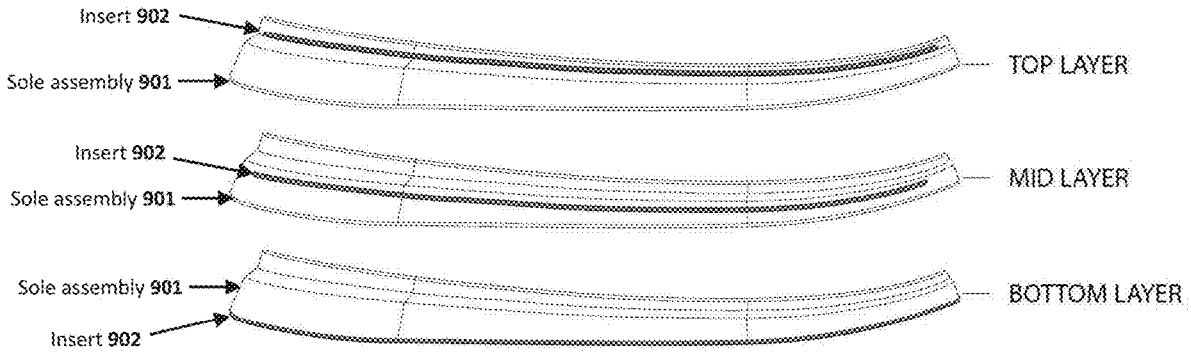
FIG. 9 schematically illustrates various sole regions in which a custom insert can be provided, in accordance with some embodiments.

FIG. 9 illustrates a plurality of different locations in which a custom insert 902 may be provided within a sole assembly 901. The sole assembly 901 may include a midsole that is designed or optimized for golf-related actions or movements. The custom insert 902 may be placed in different portions or regions of the sole assembly 901 based on the anatomy and/or swing biomechanics of the subject. The custom insert 902 may comprise different structural members which can be placed in different portions or regions of the sole assembly 901 based on the anatomy and/or swing biomechanics of the subject. In some cases, the position of the custom insert 902 relative to the rest of the sole assembly 901 may be customized by changing or adjusting the height of the custom insert 902 within a cavity of a mold before the mold is used to form a sole assembly 901 around the custom insert 902 (or a portion thereof). In some cases, the height of the custom insert 902 may be customized based on the anatomy of a subject wearing the shoe, or based on the biomechanical characteristics of the subject's golf swing. In some cases, one or more adjustable pin structures may be used to control the height of the custom insert 902 within the cavity of the mold. In some cases, the one or more adjustable pin structures may be translatable up and/or down in a positive and/or negative Z-direction. In some cases, the one or more adjustable pin structures may be configured to extend or retract when turned or rotated (e.g., clockwise or counterclockwise).

In some embodiments, the custom insert can be placed at or near a middle portion of the sole assembly. In some cases, the middle portion of the sole assembly may correspond to a section or layer of the shoe that is approximately equidistant from a top portion and a bottom portion of the sole assembly. The top and bottom portions of the sole assembly may be above and below the middle portion of the sole assembly, respectively.

In some embodiments, the custom insert can be placed at or near a top portion of the sole assembly. In some cases, the top portion of the sole assembly may correspond to a portion of the sole assembly that is above the middle portion of the sole assembly. In some cases, the top portion of the sole assembly may be adjacent to an upper or an insole component of the shoe.

In some embodiments, the custom insert can be placed at or near a bottom portion of the sole assembly. In some cases, the bottom portion of the sole assembly may correspond to a portion of the sole assembly that is below the middle portion of the sole assembly. In some cases, the bottom portion of the sole assembly may be adjacent to an outsole of the shoe.

Examples of Custom Insert Structures

Figure 10:
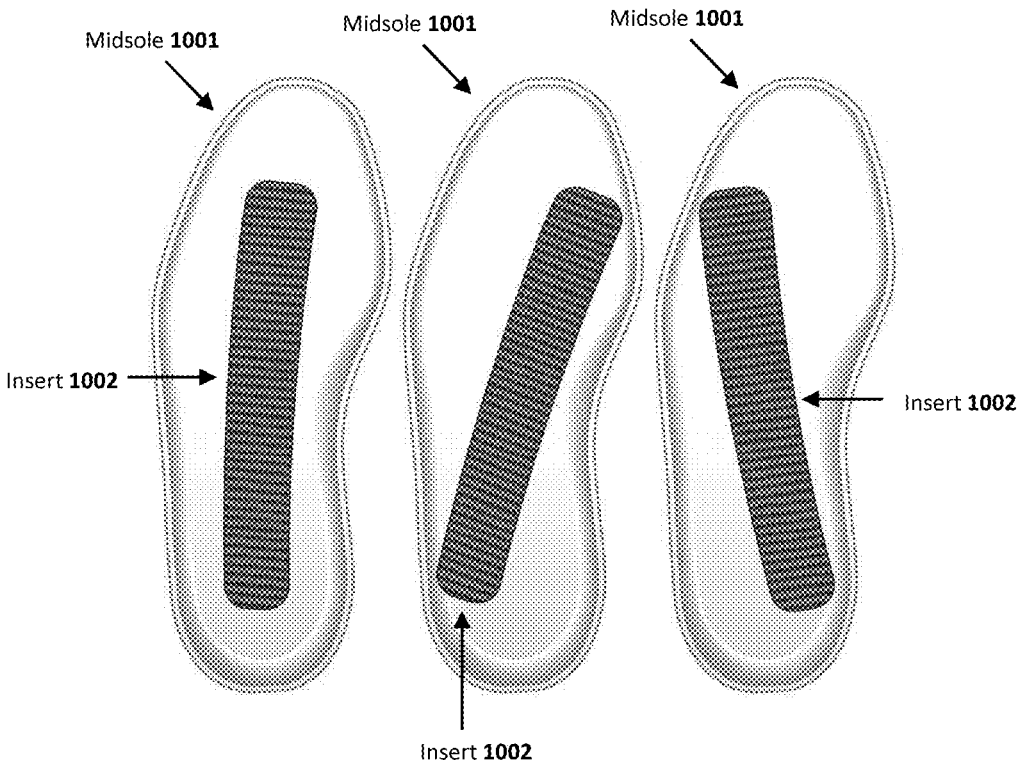
FIG. 10 schematically illustrates various examples of custom inserts, in accordance with some embodiments.

FIG. 10 illustrates various examples of custom inserts 1002 in accordance with embodiments of the present disclosure. The custom inserts 1002 may be provided within or as part of a midsole 1001 of a golf shoe. In some embodiments, the custom inserts 1002 may be substantially planar. In some cases, the custom inserts 1002 may be flat or substantially flat. In other cases, the custom inserts 1002 may be curved or slightly curved.

In some embodiments, the substantially planar insert may extend between a forefoot region and a rearfoot region of the sole assembly. In some cases, the substantially planar insert may extend from a medial forefoot region of the sole assembly to a lateral rearfoot region of the sole assembly. In other cases, the substantially planar insert may extend from a lateral forefoot region of the sole assembly to a medial rearfoot region of the sole assembly.

Figure 11A:
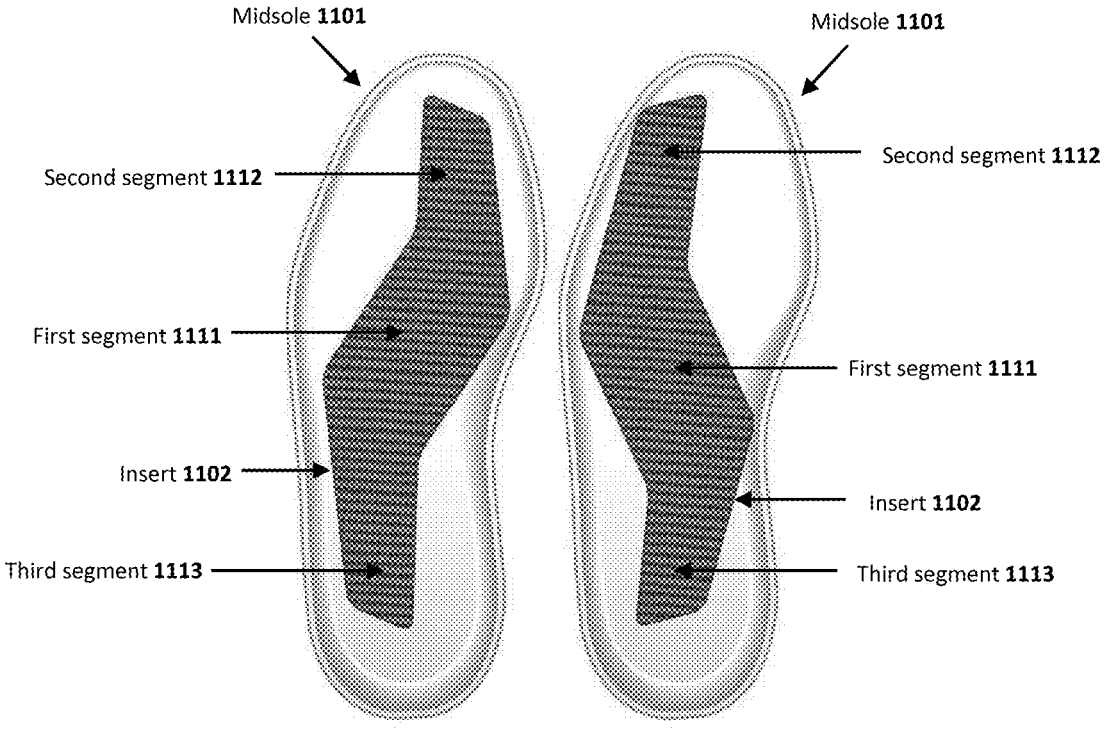
FIGS. 11A-11C schematically illustrate additional examples of custom inserts, in accordance with some embodiments.
Figure 11B:
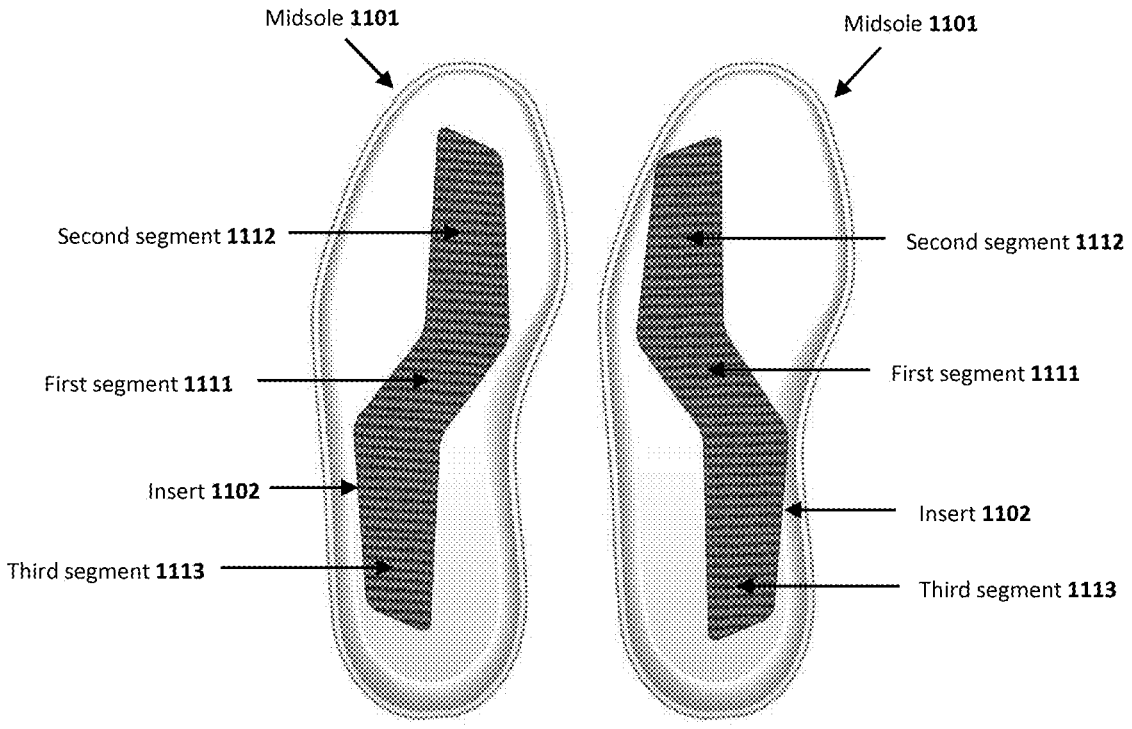
Figure 11C:
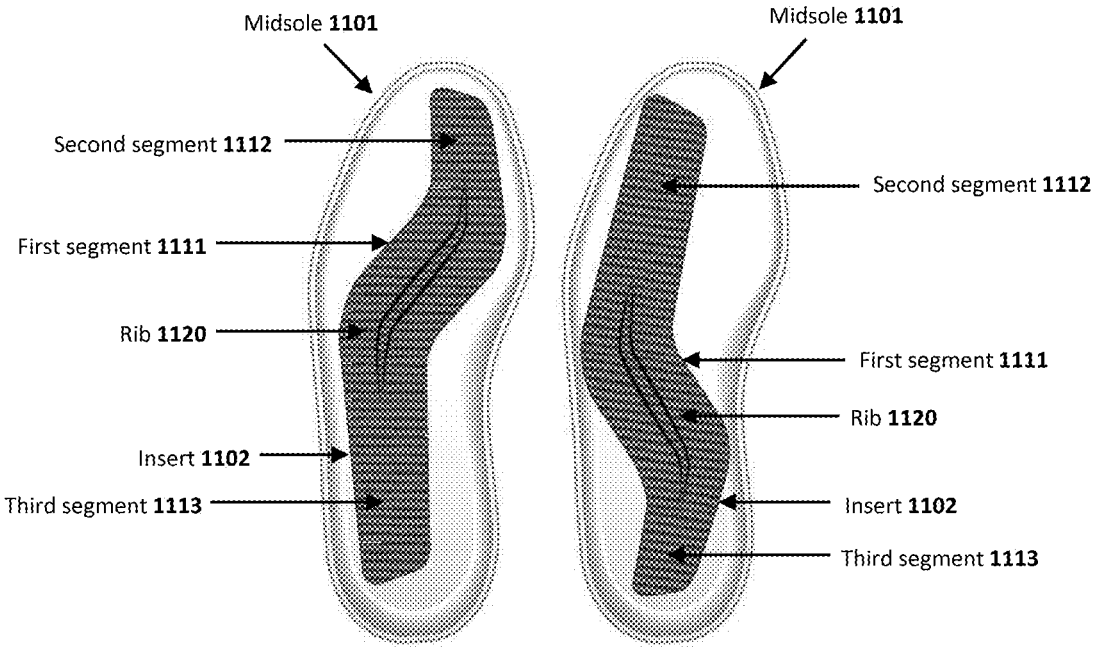

FIGS. 11A, 11B, and 11C illustrate various examples of custom inserts 1102 comprising a plurality of segments extending across, along, or through different regions of the sole assembly. In some embodiments, the sole assembly may comprise a midsole 1101 with a custom insert 1102 integrated therein.

In some embodiments, the insert 1102 may comprise a continuous structure extending between (i) a medial or lateral side of a forefoot region of the sole assembly and (ii)

a lateral or medial side of a rearfoot region of the sole assembly to stiffen the forefoot and rearfoot regions of the shoe. In some embodiments, the continuous structure may comprise a first segment 1111 extending diagonally across a midfoot region of the sole assembly to stiffen the midfoot region of the shoe. In some embodiments, the continuous structure may comprise a second segment 1112 extending from an upper midfoot portion of the first segment towards the medial or lateral side of the forefoot region of the sole assembly. In some embodiments, the continuous structure may comprise a third segment 1113 extending from a lower midfoot portion of the first segment towards the lateral or medial side of the rearfoot region of the sole assembly.

In some embodiments, the second segment 1112 may be configured to extend from the first segment 1111 towards the anterior end of the shoe. In some embodiments, the third segment 1113 may be configured to extend from the first segment 1111 towards the posterior end of the shoe. In some embodiments, the first segment 1111 may be disposed between the second segment 1112 and the third segment 1113.

In some embodiments, the first segment 1111 and the second segment 1112 may be disposed at an angle relative to each other. In some cases, the angle may range from about 90 degrees to about 135 degrees. In some embodiments, the first segment 1111 and the third segment 1113 may be disposed at an angle relative to each other. In some cases, the angle may range from about 90 degrees to about 135 degrees.

In some non-limiting embodiments, the second segment 1112 and/or the third segment 1113 can have a width that varies along a length of the second or third segment. In some embodiments, the width of the second segment 1112 and/or the third segment 1113 can increase towards an anterior or posterior end of the sole assembly. In other embodiments, the width of the second segment 1112 and/or the third segment 1113 can decrease towards an anterior or posterior end of the sole assembly.

In some embodiments, the continuous structure may comprise a plurality of straight edges forming or defining a shape of the continuous structure. In some embodiments, the shape of the continuous structure may not or need not include any curved edges or sides. In some embodiments, the second segment 1112 and/or the third segment 1113 may comprise one or more angular or pointed ends.

In some embodiments, a first end of the continuous structure and a second end of the continuous structure may be oriented in different directions. In some embodiments, the first end and the second end of the continuous structure may be flat or substantially flat. In some embodiments, the first end of the continuous structure may correspond to a portion of the second segment that is proximal to and oriented towards an anterior end of the shoe. In some embodiments, the second end of the continuous structure may correspond to a portion of the third segment that is proximal to and oriented towards a posterior end of the shoe.

Referring to FIG. 11C, in some embodiments, the continuous structure may comprise one or more ribs 1120. In some cases, the one or more ribs 1120 may extend along a length or a width of the structure. In some embodiments, the one or more ribs 1120 may be configured to provide additional structural support or rigidity to the structure. In other embodiments, the one or more ribs 1120 may be configured to enhance or modify a flex characteristic of the structure. The flex characteristic may include, for example, a bending stiffness of the structure.

In some alternative embodiments, the continuous structure may comprise one or more grooves or cutouts. The one or more grooves or cutouts may be configured to enhance the flex characteristics of different portions or segments of the structure.

Figure 12:
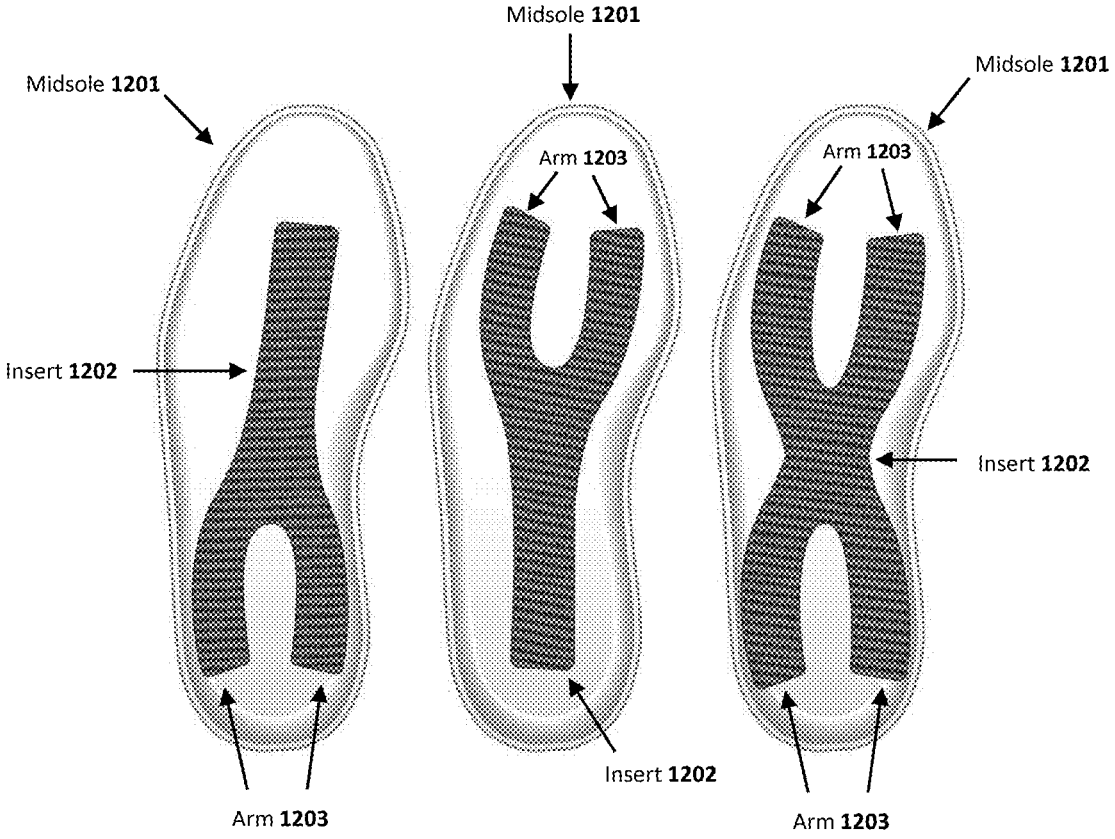
FIG. 12 schematically illustrates other non-limiting examples of custom inserts, in accordance with some embodiments.

FIG. 12 illustrates various examples of midsoles 1201 comprising custom inserts 1202. In some embodiments, the custom inserts 1202 may comprise a continuous structure extending between (i) a medial or lateral side of a forefoot region of the sole assembly and (ii) a lateral or medial side of a rearfoot region of the sole assembly to stiffen the forefoot and rearfoot regions of the shoe.

In some embodiments, the continuous structure may comprise one or more arms 1203 extending across, along, or through different regions of the midsole 1201. In some embodiments, the continuous structure may comprise one or more sets of arms extending from the midfoot region of the sole assembly to a forefoot region and/or a rearfoot region of the sole assembly. The one or more sets of arms may comprise two or more arms that converge. The point of convergence for the two or more arms may be located in a forefoot region, a midfoot region, or a rearfoot region of the midsole 1201.

In some embodiments, the continuous structure may comprise a set of symmetric arms extending from the midfoot region of the sole assembly to a forefoot region and/or a rearfoot region of the sole assembly. In some embodiments, the continuous structure may comprise a first set of symmetric arms extending between a midfoot region of the sole assembly and the forefoot region of the sole assembly and a second set of symmetric arms extending between the midfoot region of the sole assembly and the rearfoot region of the sole assembly. In some embodiments, the continuous structure may comprise one or more sets of asymmetric arms.

In some embodiments, the first set of arms may comprise a first arm and a second arm that extend away from each other to provide a longitudinally flexible forefoot region between the first arm and the second arm. In some embodiments, the second set of arms may comprise a third arm and a fourth arm that extend away from each other to provide a longitudinally flexible rearfoot region between the third arm and the fourth arm.

In some embodiments, the first arm and the second arm may comprise one or more curved segments extending along the lateral or medial side of the forefoot region. In some embodiments, the third arm and the fourth arm may comprise one or more curved segments extending along the lateral or medial side of the rearfoot region. In some non-limiting embodiments, the first and second sets of arms may collectively form an X-shaped member. In some cases, the X-shaped member may comprise one or more curved arms. In some cases, the X-shaped member may comprise one or more sets of symmetric arms. In other cases, the X-shaped member may comprise one or more sets of asymmetric arms.

In some embodiments, the first arm and the second arm may comprise one or more straight segments extending along the lateral or medial side of the forefoot region. In some embodiments, the third arm and the fourth arm may comprise one or more straight segments extending along the lateral or medial side of the rearfoot region. In some non-limiting embodiments, the first and second sets of arms may collectively form an X-shaped member. In some cases, the X-shaped member may comprise one or more straight arms.

Figure 13:
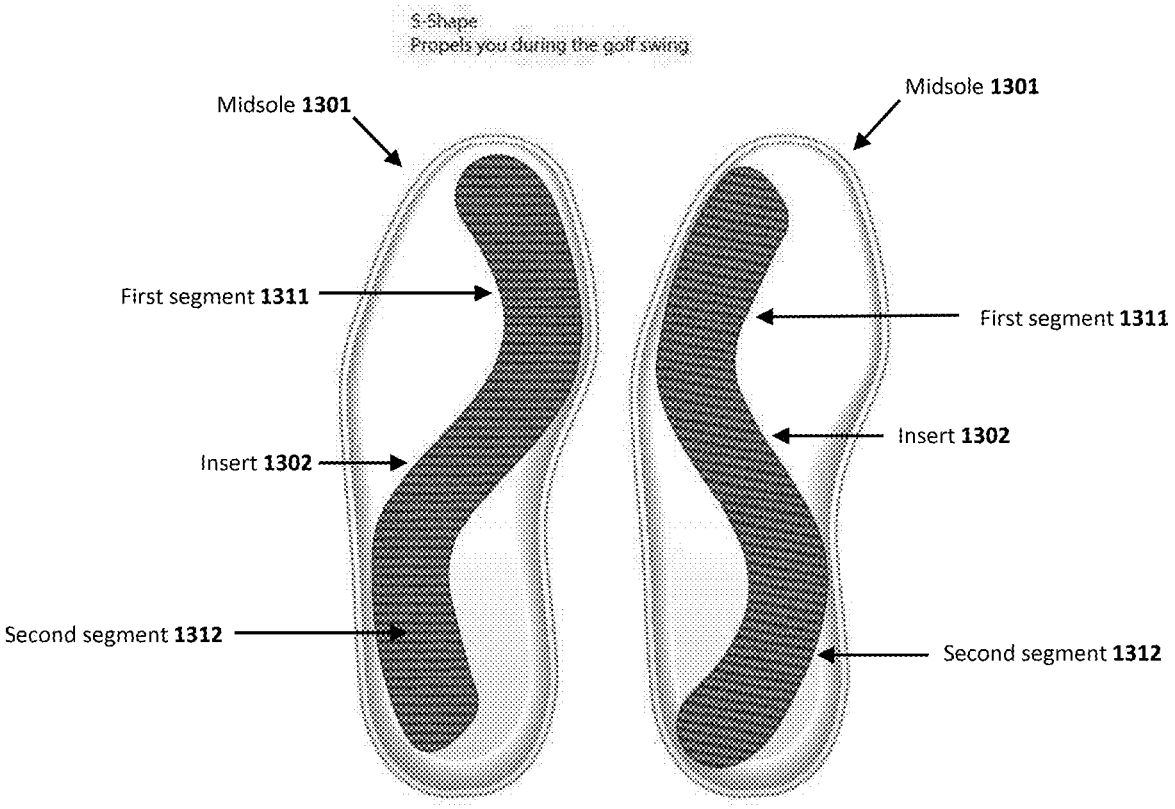
FIG. 13 schematically illustrates various examples of inserts with an S-shaped configuration, in accordance with some embodiments.

FIG. 13 illustrates various other non-limiting examples of midsoles 1301 comprising custom inserts 1302. In some embodiments, the custom inserts 1302 may comprise a continuous structure extending between (i) a medial or lateral side of a forefoot region of the sole assembly and (ii) a lateral or medial side of a rearfoot region of the sole assembly to stiffen at least the forefoot and rearfoot regions of the shoe.

In some embodiments, the continuous structure may comprise a first curved segment 1311 extending along the medial or lateral side or edge of the forefoot region and a second curved segment 1312 extending along the lateral or medial side of the rearfoot region. In some cases, the first curved segment 1311 and the second curved segment 1312 may form an S-shaped member configured to provide an elastic response during one or more golf-related movements executed by a subject wearing the golf shoe.

In some embodiments, a first end of the continuous structure may be positioned towards a medial side of the forefoot region of the shoe, and a second end of the continuous structure may be positioned towards a lateral side of the rearfoot region of the shoe. In some embodiments, a first end of the continuous structure may be positioned towards a lateral side of the forefoot region of the shoe, and a second end of the continuous structure may be positioned towards a medial side of the rearfoot region of the shoe.

Figure 14A:
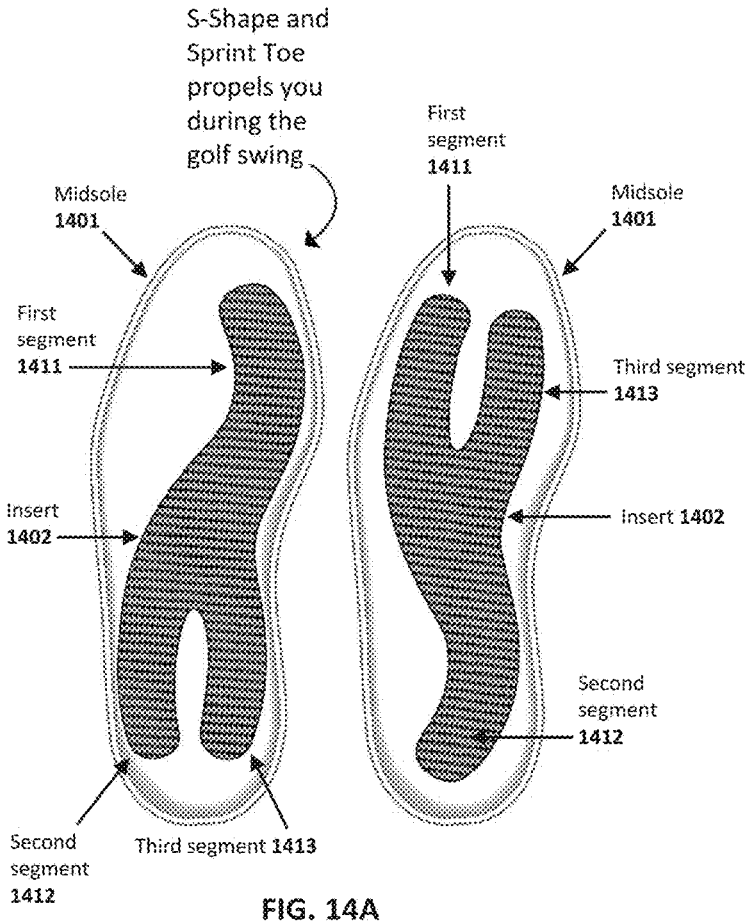
FIGS. 14A and 14B schematically illustrate additional examples of inserts with an S-shaped configuration, in accordance with some embodiments.
Figure 14B:
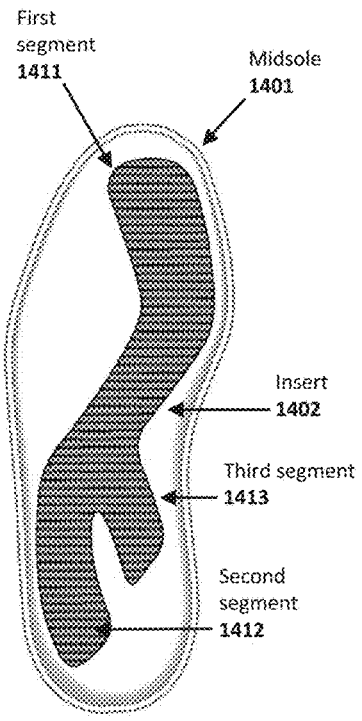

FIGS. 14A and 14B illustrate different variations of the custom inserts 1402 that can be provided in or integrated with a midsole 1401. In some embodiments, the custom inserts 1402 may comprise a continuous structure extending between (i) a medial or lateral side of a forefoot region of the sole assembly and (ii) a lateral or medial side of a rearfoot region of the sole assembly to stiffen the forefoot and rearfoot regions of the shoe. In some embodiments, the continuous structure may comprise a first curved segment 1411 extending along the medial or lateral side or edge of the forefoot region and a second curved segment 1412 extending along the lateral or medial side of the rearfoot region. In some cases, the first curved segment 1411 and the second curved segment 1412 may form an S-shaped member configured to provide an elastic response during one or more golf-related movements executed by a subject wearing the golf shoe.

In some embodiments, the continuous structure may comprise a third segment 1413 extending from the first curved segment or the second curved segment towards the forefoot region of the shoe. In other embodiments, the continuous structure may comprise a third segment 1413 extending from the first curved segment or the second curved segment towards the rearfoot region of the shoe. In some embodiments, the third segment 1413 may extend away from the first segment 1411 or the second segment 1412 to provide a longitudinally flexible region between the third segment 1413 and either the first segment 1411 or the second segment 1412.

In some embodiments, the continuous structure may comprise a first concave curvature formed by the first curved segment and a second concave curvature formed by the second curved segment. In some cases, the first concave curvature may be oriented towards the medial side of the shoe. In some cases, the second concave curvature may be oriented towards the lateral side of the shoe. In some cases, the first concave curvature may be oriented towards the lateral side of the shoe, and the second concave curvature may be oriented towards the medial side of the shoe.

Figure 15A:
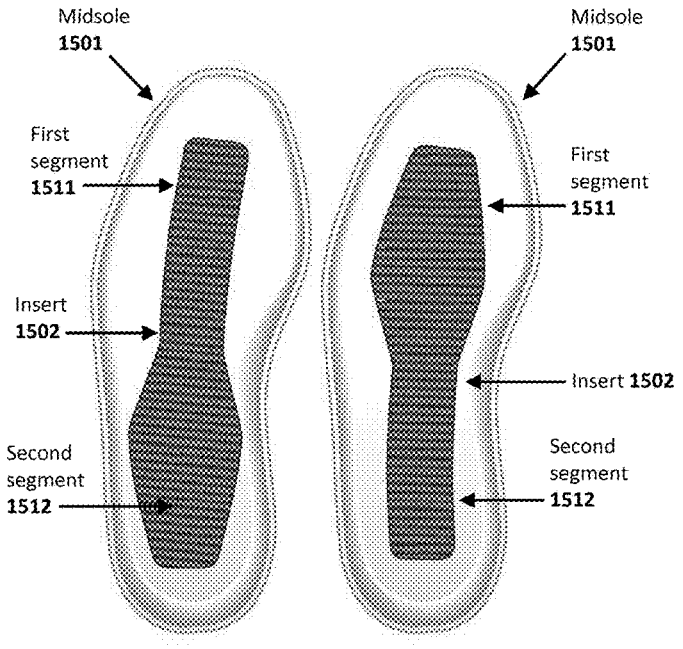
FIGS. 15A and 15B schematically illustrate other alternative examples of custom inserts, in accordance with some embodiments.

FIG. 15A illustrates various non-limiting examples of custom inserts 1502 that can be provided within a midsole 1501 of a shoe. In some embodiments, the custom inserts 1502 may comprise a first segment 1511 and a second segment 1512. In some cases, the first segment 1511 may be provided in a forefoot, midfoot, or rearfoot region of the sole assembly. In some cases, the second segment 1512 may be provided in a forefoot, midfoot, or rearfoot region of the sole assembly. In some embodiments, the first segment 1511 may be configured to extend from the second segment 1512 to the anterior or posterior end of the sole assembly. In some embodiments, the second segment 1512 may be configured to extend from the first segment 1511 to the anterior or posterior end of the sole assembly.

In some embodiments, the first segment 1511 may comprise a planar or substantially planar segment having a rectangular shape or profile. In some cases, the first segment 1511 may have a constant width. In other cases, the first segment 1511 may have a variable width.

In some embodiments, the second segment 1512 may comprise a planar or substantially planar segment having a polygonal shape or profile. The polygonal shape or profile may have three or more sides. In some non-limiting embodiments, the polygonal shape or profile may include a triangle, a square, a parallelogram, a rectangle, a rhombus, a diamond, a trapezoid, a hexagon, or an octagon.

In some cases, the second segment 1512 may have a width that varies along a length of the second segment 1512. In some cases, a first portion of the second segment 1512 may have a width that varies along a first length of the second segment 1512. In some cases, a second portion of the second segment 1512 may have a constant width along a second length of the second segment 1512.

Figure 15B:
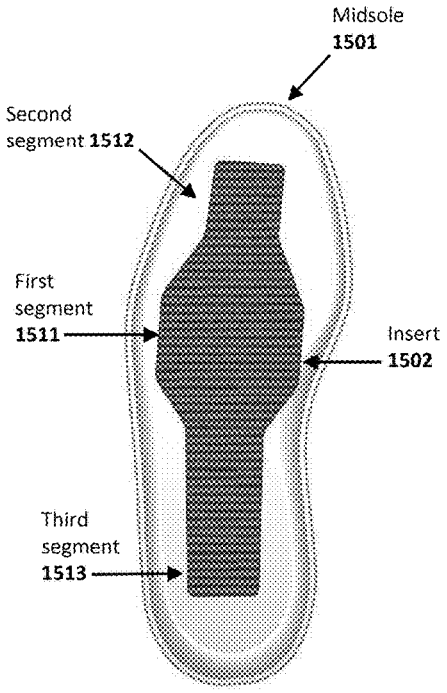

FIG. 15B illustrates additional non-limiting examples of custom inserts 1502 that can be provided within a midsole 1501 of a shoe. In some embodiments, the custom inserts 1502 may comprise a first segment 1511, a second segment 1512, and a third segment 1513. In some cases, the first segment 1511 may be provided in a forefoot, midfoot, or rearfoot region of the sole assembly. In some cases, the second segment 1512 may be provided in a forefoot, midfoot, or rearfoot region of the sole assembly. In some cases, the third segment 1513 may be provided in a forefoot, midfoot, or rearfoot region of the sole assembly. In some embodiments, the first segment 1511 may be positioned between the second segment 1512 and the third segment 1513. In some embodiments, the second segment 1512 and/or the third segment 1513 may be configured to extend from the first segment 1511 to the anterior and/or posterior ends of the sole assembly.

In some embodiments, the first segment 1511 may be positioned in a midfoot region of the sole assembly. In some embodiments, the first segment 1511 may comprise a planar or substantially planar segment having a polygonal shape or profile. The polygonal shape or profile may have three or more sides. In some non-limiting embodiments, the polygonal shape or profile may include a triangle, a square, a parallelogram, a rectangle, a rhombus, a diamond, a trapezoid, a hexagon, or an octagon.

In some cases, the first segment 1511 may have a width that varies along a length of the first segment 1511. In some cases, a first portion of the first segment 1511 may have a width that varies along a first length of the first segment 1511. In some cases, a second portion of the first segment 1511 may have a constant width along a second length of the first segment 1511.

In some embodiments, the second segment 1512 may be positioned in a forefoot region of the sole assembly. In some embodiments, the second segment 1512 may comprise a planar or substantially planar segment having a rectangular shape or profile. In some cases, the second segment 1512 may have a constant width. In other cases, the second segment 1512 may have a variable width.

In some embodiments, the third segment 1513 may be positioned in a rearfoot region of the sole assembly. In some embodiments, the third segment 1513 may comprise a planar or substantially planar segment having a rectangular shape or profile. In some cases, the third segment 1513 may have a constant width. In other cases, the third segment 1513 may have a variable width.

Figure 16A:
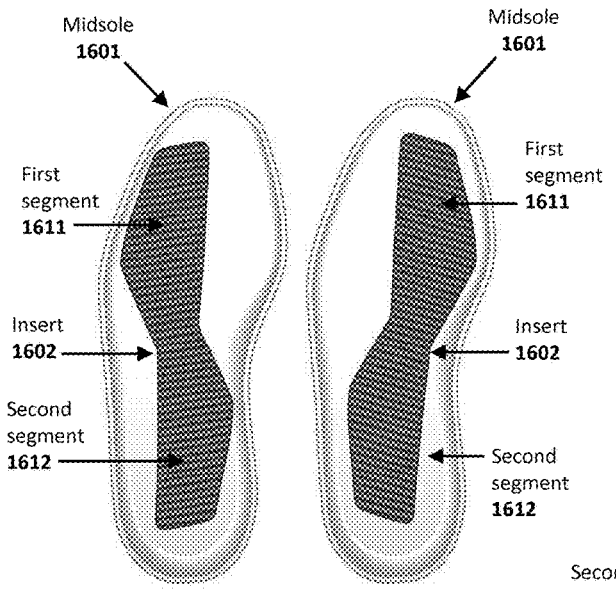
FIGS. 16A and 16B schematically illustrate other non-limiting examples of custom inserts, in accordance with some embodiments.

FIG. 16A illustrates various non-limiting examples of custom inserts 1602 that can be provided within a midsole 1601 of a shoe. In some embodiments, the custom inserts 1602 may comprise a first segment 1611 and a second segment 1612. In some cases, the first segment 1611 may be provided in a forefoot, midfoot, or rearfoot region of the sole assembly. In some cases, the second segment 1612 may be provided in a forefoot, midfoot, or rearfoot region of the sole assembly. In some embodiments, the first segment 1611 may be configured to extend from the second segment 1612 to the anterior or posterior end of the sole assembly. In some embodiments, the second segment 1612 may be configured to extend from the first segment 1611 to the anterior or posterior end of the sole assembly.

In some embodiments, the first segment 1611 may be positioned in a forefoot region of the sole assembly. In some embodiments, the first segment 1611 may comprise a planar or substantially planar segment having a polygonal shape or profile. The polygonal shape or profile may have three or more sides. In some non-limiting embodiments, the polygonal shape or profile may include a triangle, a square, a parallelogram, a rectangle, a rhombus, a diamond, a trapezoid, a hexagon, or an octagon.

In some embodiments, the second segment 1612 may be positioned in a forefoot region of the sole assembly. In some embodiments, the second segment 1612 may comprise a planar or substantially planar segment having a polygonal shape or profile. The polygonal shape or profile may have three or more sides. In some non-limiting embodiments, the polygonal shape or profile may include a triangle, a square, a parallelogram, a rectangle, a rhombus, a diamond, a trapezoid, a hexagon, or an octagon.

In some embodiments, the first segment 1611 and the second segment 1612 may have a same or similar shape. For example, in some cases, the first segment 1611 may have a first shape and the second segment 1612 may have a second shape that is a mirrored, reflected, or inverted version of the first shape. The first shape and the second shape may be mirrored, reflected, or inverted along an axis extending through or along the custom insert 1602.

Figure 16B:
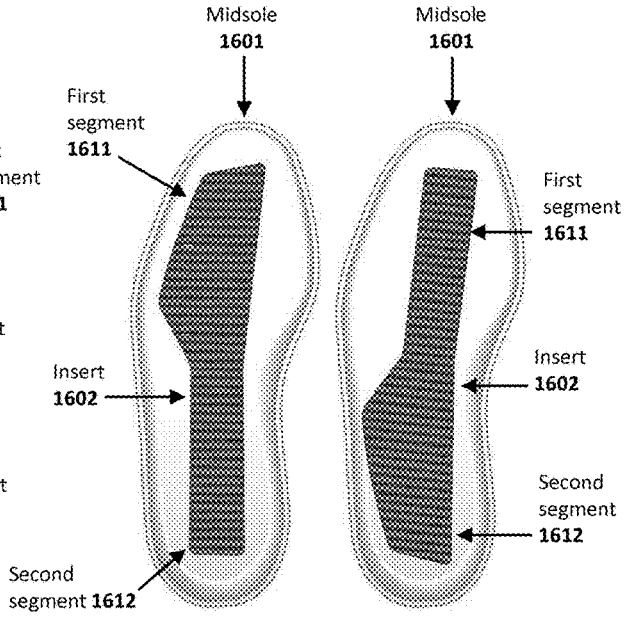

FIG. 16B illustrates additional non-limiting examples of custom inserts 1602 that can be provided within a midsole 1601 of a shoe. In some embodiments, the custom inserts 1602 may comprise a first segment 1611 and a second segment 1612. In some cases, the first segment 1611 may be provided in a forefoot, midfoot, or rearfoot region of the sole assembly. In some cases, the second segment 1612 may be provided in a forefoot, midfoot, or rearfoot region of the sole assembly. In some embodiments, the first segment 1611 may be configured to extend from the second segment 1612 to the anterior or posterior end of the sole assembly. In some embodiments, the second segment 1612 may be configured to extend from the first segment 1611 to the anterior or posterior end of the sole assembly.

In some embodiments, the first segment 1611 may be positioned in a forefoot region of the sole assembly. In some embodiments, the second segment 1612 may be positioned in a rearfoot region of the sole assembly.

In some embodiments, the first segment 1611 and/or the second segment 1612 may comprise a planar or substantially planar segment having a rectangular shape or profile. In some cases, the first segment 1611 and/or the second segment 1612 may have a constant width. In other cases, the first segment 1611 and/or the second segment 1612 may have a variable width.

In some embodiments, the first segment 1611 and/or the second segment 1612 may comprise a planar or substantially planar segment having a polygonal shape or profile. The polygonal shape or profile may have three or more sides. In some non-limiting embodiments, the polygonal shape or profile may include a triangle, a square, a parallelogram, a rectangle, a rhombus, a diamond, a trapezoid, a hexagon, or an octagon.

Carbon Fibers or Strands with Custom Curvatures

Figure 17:
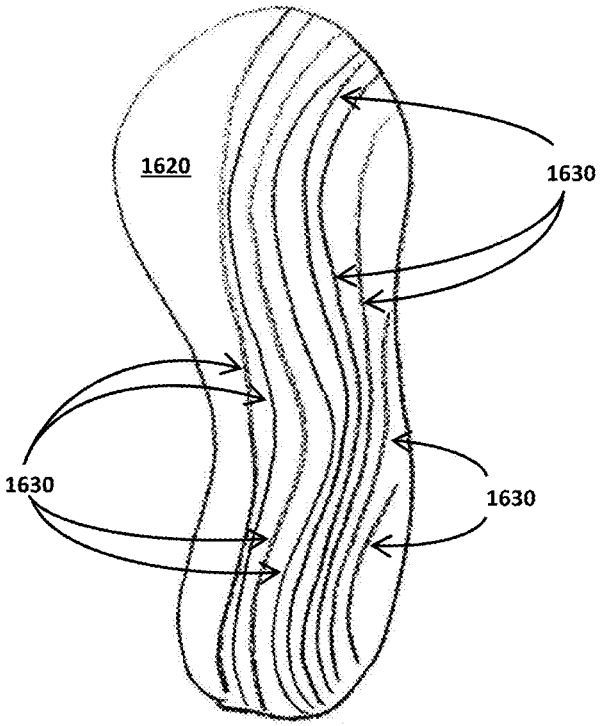
FIG. 17 schematically illustrates an example of a carbon plate comprising one or more strands or fibers with a customized curvature, in accordance with some embodiments.

Referring now to FIG. 17, in some embodiments, a custom insert 1620 may be integrated with a sole assembly of a golf shoe. In some cases, the custom insert 1620 may comprise a plurality of fibers or strands 1630. In some cases, the fibers or strands 1630 may comprise a carbon fiber or composite material.

In some embodiments, the fibers or strands 1630 may be laid out along a customizable pathway with one or more curved sections or segments. In some cases, the curvature of the curved sections or segments may be customized based on a subject's anatomy (e.g., the subject's arch shape or profile). In some cases, the curvature of the curved sections or segments may be customized based on the biomechanical characteristics or properties of the subject's golf swing. In some cases, the pathway and curvature of the fibers or strands 1630 may be optimized to manage the stresses or loads exerted on the custom insert when a force is applied to the sole assembly (e.g., during a golf-related action or movement).

In some cases, the fibers or strands 1630 may have a unidirectional configuration. In some cases, the unidirectional fibers or strands may comprise a plurality of non-woven fibers that run parallel to each other in a single direction.

In some cases, the fibers or strands 1630 may have a multi-directional configuration. In some cases, the multi-directional configuration may be formed by orienting multiple sections or segments of the fibers or strands 1630 in two or more different directions.

In some embodiments, the fibers or strands 1630 forming the custom insert 1620 may be parallel to each other. In other embodiments, the fibers or strands 1630 forming the custom insert 1620 may not or need not be parallel to each other. In some alternative embodiments, the fibers or strands 1630 forming the custom insert 1620 may be parallel with each other along one or more select portions of the custom insert 1620. In other alternative embodiments, the fibers or strands 1630 forming the custom insert 1620 may not or need not be parallel with each other along one or more select portions of the custom insert 1620.

In some embodiments, the fibers or strands 1630 may have a same or similar curvature. In other embodiments, the fibers or strands 1630 may have different curvatures with different lengths and/or different radii of curvature. In some embodiments, the fibers or strands 1630 may include a first fiber or strand with a first curvature and a second fiber or strand with a second curvature. In some cases, the first curvature and the second curvature may have different shapes or profiles, and may span different portions or sections of the custom insert 1620.

In some embodiments, the fibers or strands 1630 may extend along a length of the custom insert 1620 with a same or similar orientation. In other embodiments, the fibers or strands 1630 may extend along a length of the custom insert 1620 with different orientations.

In some cases, the fibers or strands 1630 may be configured to extend along a planar arc. In some cases, the curvature of the planar arc may correspond to a shape or a profile of a subject's foot. In some cases, the curvature of the planar arc may correspond to a shape or a profile of a perimeter or edge portion of the custom insert 1620. In some cases, one or more sections or segments of the curvature of the planar arc may be aligned with or oriented along one or more directions in which a force or load can be exerted on or across the sole assembly or a portion of the custom insert 1620 (e.g., during a golf-related action or movement).

In some cases, the fibers or strands 1630 may be oriented such that the fibers or strands 1630 are aligned along a full length of the planar arc. In other cases, the fibers or strands 1630 may not or need not be oriented in alignment with the full length of the planar arc. For example, in some cases, the fibers or strands 1630 may be oriented such that only a select portion of the fiber or strands 1630 is aligned along a section or a segment of the planar arc. In some cases, the fibers or strands 1630 may not or need not extend tangentially along an entire length of the curvature of the planar arc. In some cases, only a select portion of the fibers or strands 1630 may extend tangentially along a section or a segment of the planar arc.

In some alternative cases, the fibers or strands 1630 may be configured to extend along a nonplanar arc. In some cases, the nonplanar arc may comprise one or more curved sections that extend along or span two or more planes in three-dimensional (3D) space. In some cases, the fibers or strands 1630 may be configured to extend along a three-dimensional (3D) contour of the custom insert 1620 that is not confined to a single plane in 3D space. In some cases, the 3D contour may correspond to a shape or a profile of a subject's longitudinal and/or medial arches.

In some cases, the fibers or strands 1630 forming the custom insert 1620 may have a curvature that extends along an entire length of the fibers or strands 1630. In some cases, the fibers or strands 1630 may not or need not include any straight or substantially straight segments in the forefoot, midfoot, and/or rearfoot regions of the custom insert 1620.

In some cases, the fibers or strands 1630 may be arranged and laid out to provide a constant or near-constant density or concentration of fibers per unit area. In some cases, the constant or near-constant density or concentration of fibers per unit area may impart a uniform or near-uniform material property (e.g., hardness, stiffness, rigidity, tensile strength, etc.) across the entire custom insert 1620. In other cases, the fibers or strands 1630 may be laid out and arranged to provide different densities or concentrations of fibers per unit area across different regions of the custom insert 1620. In some cases, the different densities or concentrations of fibers in the different regions of the custom insert 1620 may impart different material properties (e.g., hardness, stiffness, rigidity, tensile strength, etc.) to the different regions of the custom insert 1620.

In some cases, the fibers or strands 1630 forming the custom insert 1620 may be arranged in a parallel configuration. In such cases, adjacent fibers or strands 1630 may be generally parallel to each other, and may not or need not converge or diverge. In other cases, the fibers or strands 1630 forming the custom insert 1620 may not or need not be arranged in a parallel configuration. In such cases, the fibers or strands 1630 may converge towards a select region on the custom insert 1620, or may diverge away from a select region on the custom insert 1620.

In some cases, the custom insert 1620 may be formed by attaching one or more fibers or strands 1630 to a substrate layer. In some cases, the substrate layer may comprise a carbon or composite material. In some cases, the one or more fibers or strands 1630 may be attached to the substrate layer without using any stitches. In some cases, the one or more fibers or strands 1630 may be attached to the substrate layer using an adhesive material or a resin-based material (e.g., an epoxy resin). In some cases, the one or more fibers or strands 1630 may be arranged to form one or more layers that can be laminated together (e.g., using a wet lay-up process, a prepreg lamination process, or a resin transfer molding process).

In some cases, the custom insert 1620 may comprise a plurality of layers each comprising a plurality of fibers or strands 1630. In some cases, the plurality of layers may comprise a first layer comprising a first set of fibers or strands and a second layer comprising a second set of fibers or strands. In some cases, the first and second sets of fibers or strands may be configured to extend in or along different directions across the custom insert. In some cases, the first set of fibers or strands may have a different pathway or curvature than the second set of fibers or strands. In some cases, the first set of fibers or strands may have a different orientation or directional bias than the second set of fibers or strands. In some alternative cases, the first set of fibers or strands and the second set of fibers or strands may have a same or similar pathway, curvature, orientation, or directional bias.

In some non-limiting embodiments, the custom insert may rest on top of the midsole of the golf shoe. In other non-limiting embodiments, the custom insert may be molded within the midsole of the golf shoe. In some embodiments, the custom insert may be positioned at or near the bottom of the midsole. In other embodiments, the custom insert may be positioned at or near the middle or the top of the midsole. In some cases, the custom insert may be top loaded or bottom loaded into the midsole structure of the shoe. In some cases, the custom insert may be positioned within a portion of the midsole structure. In some cases, a portion of the midsole structure may at least partially cover a top surface, a bottom surface, a front surface, a rear surface, and/or one or more side surfaces of the custom insert. In some embodiments, the midsole structure may comprise one or more foam(ed) materials as described in further detail elsewhere herein.

In some embodiments, the custom insert may be molded into a shape that corresponds to a shape or a profile of a subject's foot. In some embodiments, the custom insert may be molded into a shape that corresponds to the shape or profile of the midsole and/or the outsole of the golf shoe. In some cases, the custom insert may have a flat or substantially flat shape or profile. In other cases, the custom insert may have a three-dimensional shape or profile that is nonplanar or substantially nonplanar.

Soles with Multiple Zones

In some embodiments, the shoes of the present disclosure may comprise multiple zones having different material properties. The materials providing these different material properties may be selected and/or optimized for both walking and/or running and golf-related actions or movements.

Figure 18A:
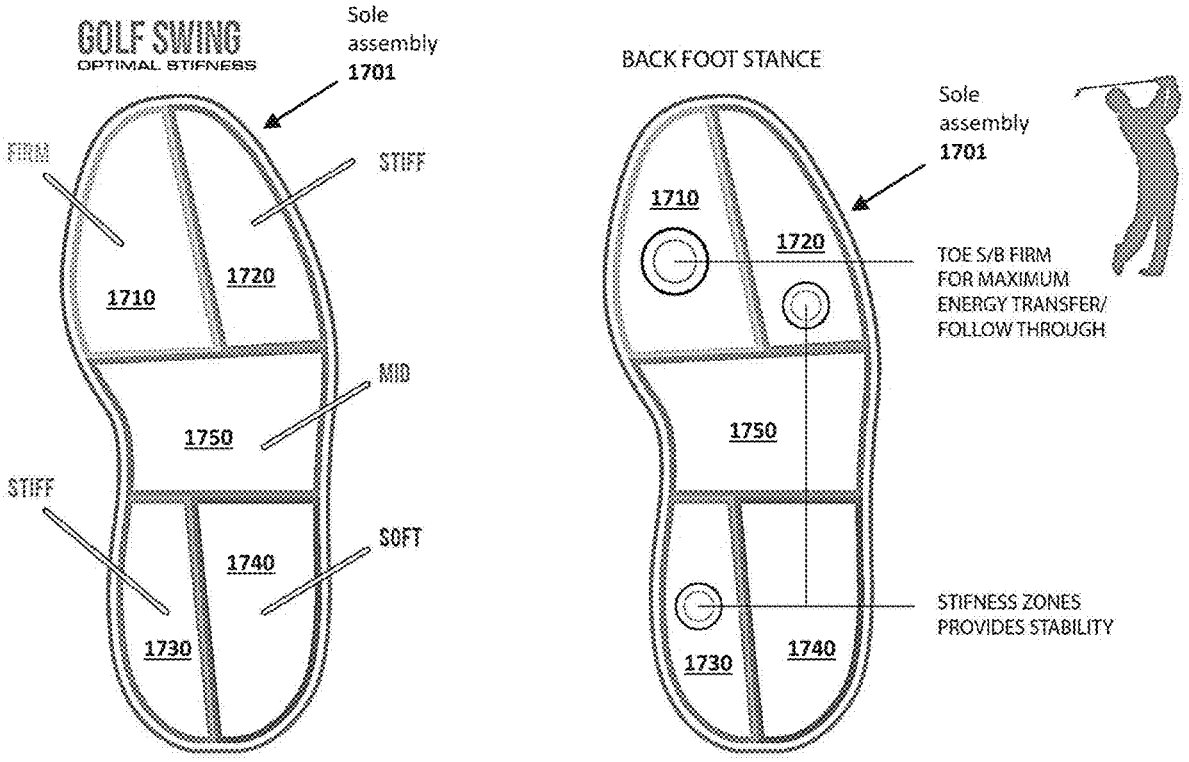
FIG. 18A schematically illustrates an example of a sole assembly that can be optimized for golf-related actions or movements, in accordance with some embodiments.

FIG. 18A illustrates an exemplary sole assembly 1701 that is optimized for golf-related actions or movements. The sole assembly 1701 may comprise a first region 1710, a second region 1720, a third region 1730, a fourth region 1740, and a fifth region 1750. The first region 1710 may be located in a medial forefoot region of the shoe. In some cases, the first region 1710 may correspond to a medial plantar region of the shoe. The second region 1720 may be located in a lateral forefoot region of the shoe. In some cases, the second region 1720 may correspond to a lateral plantar region of the shoe. The third region 1730 may be located in a medial rearfoot region of the shoe. In some cases, the third region 1730 may correspond to a medial tibial region of the shoe. The fourth region 1740 may be located in a lateral rearfoot region of the shoe. In some cases, the fourth region 1740 may correspond to a lateral tibial region of the shoe. The fifth region 1750 may be located in a midfoot region of the shoe. In some cases, the fifth region 1750 may correspond to a shank area of the shoe.

In some embodiments, the first region 1710 may be relatively firm compared to the second region 1720, the third region 1730, the fourth region 1740, and/or the fifth region 1750. The relative firmness of the first region 1710 may enhance or maximize support and/or energy transfer during a golf-related movement.

In some embodiments, the second region 1720 and/or the third region 1730 may be relatively stiff compared to the first region 1710, the fourth region 1740, and/or the fifth region 1750. The relative stiffness of the second region 1720 and/or the third region 1730 may provide additional control and/or stability during a golf-related movement.

In some embodiments, the fourth region 1740 may be relatively soft compared to the first region 1710, the second region 1720, the third region 1730, and/or the fifth region 1750. The relative softness of the fourth region 1740 may provide a comfortable sole response/feel as a subject walks along a variety of different ground surfaces.

In some embodiments, the fifth region 1750 may be configured as a transition zone of the sole assembly 1701. In some embodiments, the transition zone may be configured to divide the sole assembly 1701 into a forefoot region and a rearfoot region. In some embodiments, the forefoot region may include the first region 1710 and/or the second region 1720. In some embodiments, the rearfoot region may include the third region 1730 and/or the fourth region 1740.

Figure 18B:
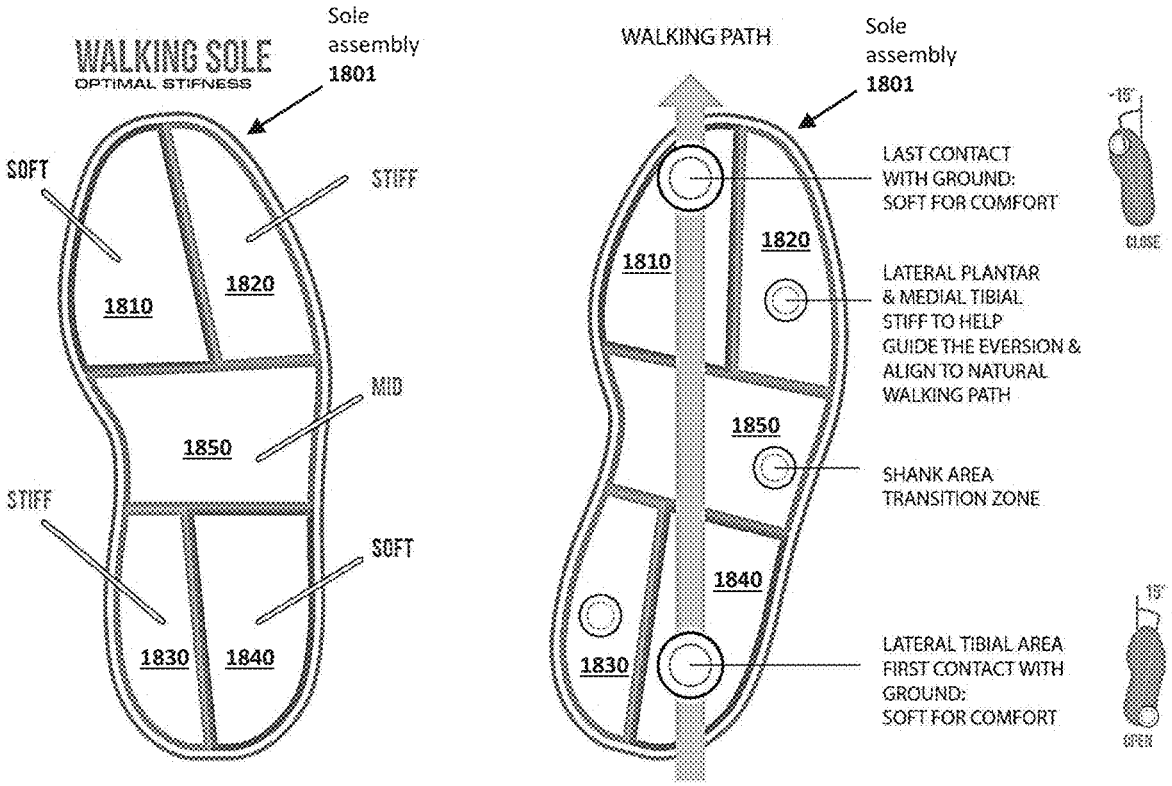
FIG. 18B schematically illustrates an example of a sole assembly that can be optimized for walking, in accordance with some embodiments.

FIG. 18B illustrates an exemplary sole assembly that is optimized for walking and/or running. The sole assembly 1801 may comprise a first region 1810, a second region 1820, a third region 1830, a fourth region 1840, and a fifth region 1850. The first region 1810 may be located in a medial forefoot region of the shoe. In some cases, the first region 1810 may correspond to a medial plantar region of the shoe. The second region 1820 may be located in a lateral forefoot region of the shoe. In some cases, the second region 1820 may correspond to a lateral plantar region of the shoe. The third region 1830 may be located in a medial rearfoot region of the shoe. In some cases, the third region 1830 may correspond to a medial tibial region of the shoe. The fourth region 1840 may be located in a lateral rearfoot region of the shoe. In some cases, the fourth region 1840 may correspond to a lateral tibial region of the shoe. The fifth region 1850 may be located in a midfoot region of the shoe. In some cases, the fifth region 1850 may correspond to a shank area of the shoe.

In some embodiments, the first region 1810 and/or the fourth region 1840 may be relatively soft compared to the second region 1820, the third region 1830, and/or the fifth region 1750. The relative softness of the first region 1810 (typically the last portion of the sole to contact the ground when walking or running) and/or the fourth region 1840 (typically the first portion of the sole to contact the ground when walking or running) may provide a comfortable sole response and feel as a subject traverses a variety of different ground surfaces.

In some embodiments, the second region 1820 and/or the third region 1830 may be relatively stiff compared to the first region 1810, the fourth region 1840, and/or the fifth region 1850. The relative stiffness of the second region 1820 and/or the third region 1830 may help to guide inversion and/or eversion and to align a subject's feet and/or gait with his or her natural walking path.

In some embodiments, the fifth region 1850 may be configured as a transition zone of the sole assembly 1801. In some embodiments, the transition zone may be configured to divide the sole assembly 1801 into a forefoot region and a rearfoot region. In some embodiments, the forefoot region may include the first region 1810 and/or the second region 1820. In some embodiments, the rearfoot region may include the third region 1830 and/or the fourth region 1840.

Foam with Adaptive Material Properties

Given the different desirable material response characteristics for the medial plantar/medial forefoot region of the sole assembly, especially when considering both (1) golf-related actions or movements and (2) walking and/or running applications, it would be advantageous to include a material in the medial plantar/medial forefoot region of the sole assembly that can provide multiple different material response characteristics optimized for different use cases.

In one aspect, the present disclosure provides various examples of shoes comprising a midsole. In some embodiments, the midsole may include a medial plantar region, a lateral plantar region, a medial tibial region, and a lateral tibial region.

In some embodiments, the lateral plantar region or the medial tibial region may have a greater hardness or stiffness than a lateral tibial region of the midsole. In some embodiments, the lateral tibial region of the midsole may be softer than the lateral plantar region and/or the medial tibial region of the midsole.

In some embodiments, the medial plantar region may include a foam material. In some embodiments, the foam material may comprise an open cell foam comprising one or more open or partially open cells. In other cases, the foam material may comprise a closed cell foam comprising one or more closed or partially closed cells. In some non-limiting embodiments, the foam material may comprise an elastic foam. The elastic foam may include, for example, ethylene vinyl acetate copolymer (EVA), an elasticized closed-cell foam with rubber-like softness and flexibility. In other non-limiting embodiments, the foam material may comprise a viscous foam. The viscous foam may include, for example, a polyurethane or polyethylene foam. In some alternate embodiments, the foam material may comprise a viscoelastic foam. The viscoelastic foam may have the elastic properties of an elastic foam and the viscous properties of a viscous foam. In some cases, the viscoelastic foam may comprise a memory foam or a memory foam-like material. In any of the embodiments described herein, the midsole may comprise a plurality of different foam materials (e.g., foamed ethylene vinyl acetate copolymer (EVA) and/or foamed polyurethane compositions).

Figure 19A:
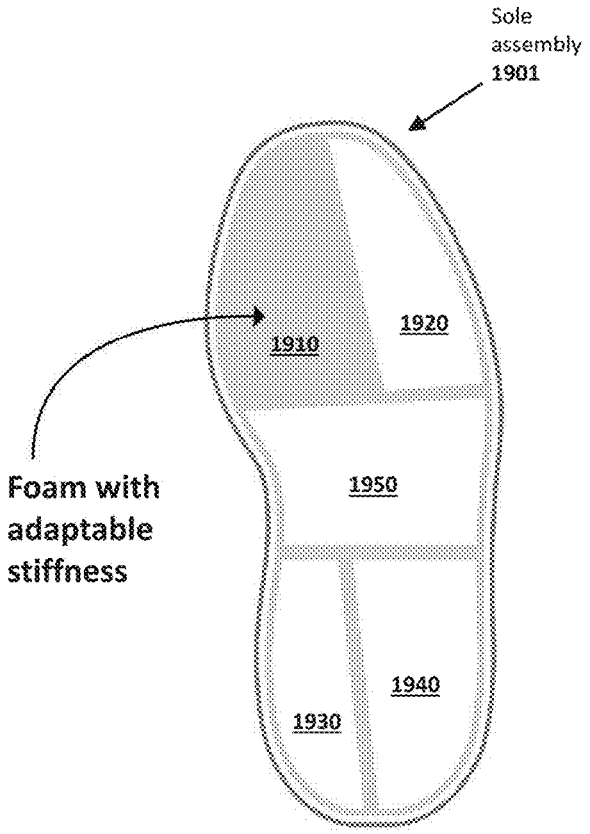
FIGS. 19A and 19B schematically illustrate various examples of sole assemblies comprising a foam material with an adaptable material property, in accordance with some embodiments.
Figure 19B:
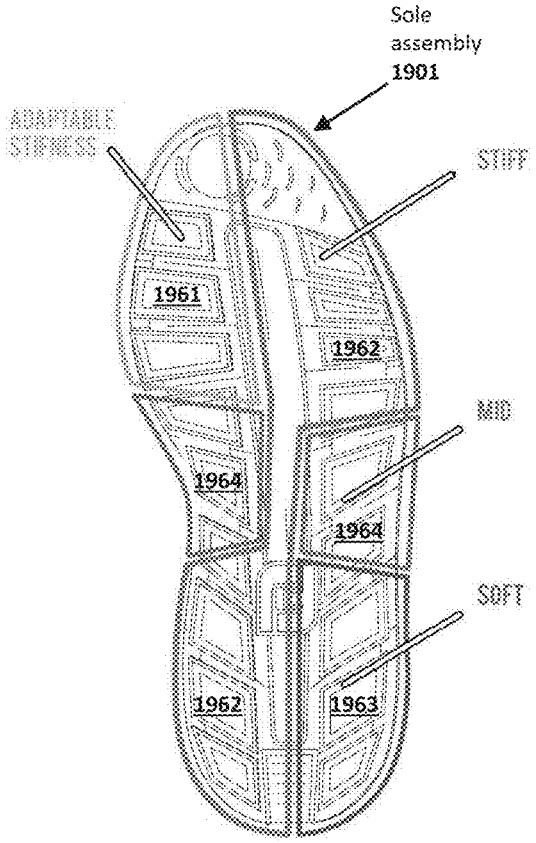
Figure 20:
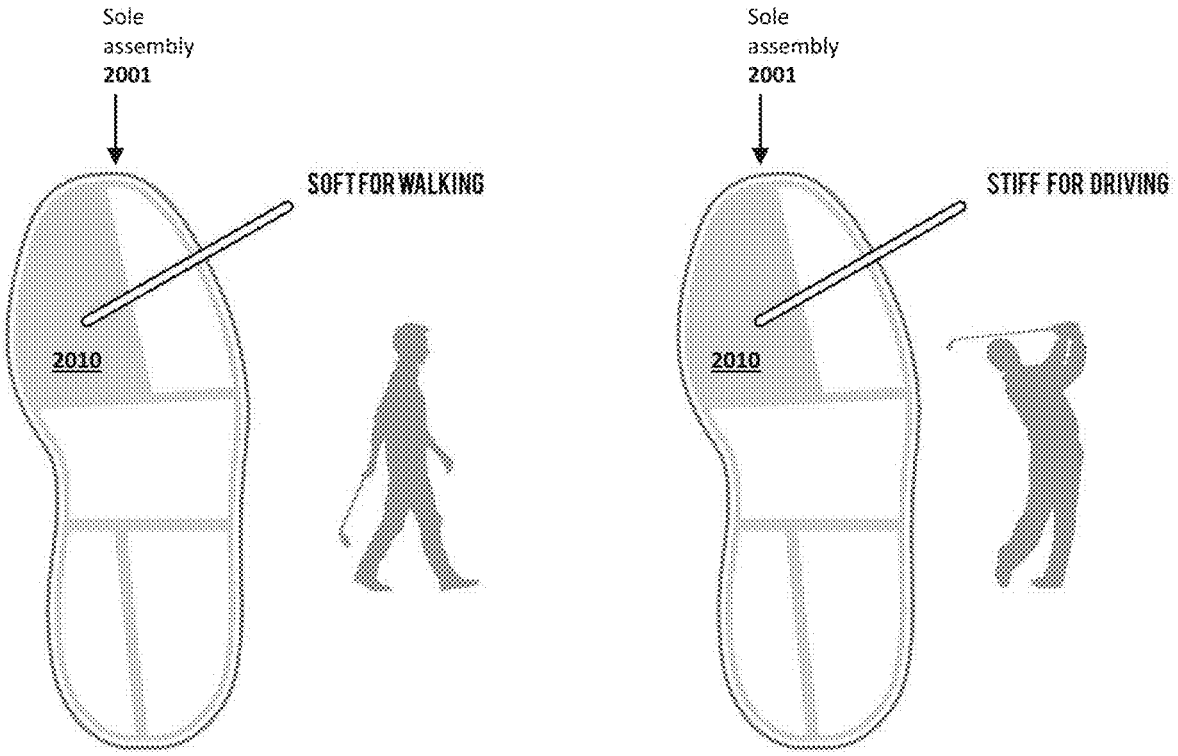
FIG. 20 schematically illustrates an exemplary sole assembly comprising an adaptable foam material provided in a plantar region of the sole assembly, in accordance with some embodiments.

Referring to FIGS. 19A-19B and FIG. 20, in some embodiments, the foam material of the medial plantar region (1910, 1960, 2010) may have an adaptable material property that varies based on a force exerted on the sole assembly. In some embodiments, the adaptable material property may include a hardness, a softness, a stiffness, a rigidity, and/or a level of cushioning of the foam material.

In some embodiments, the foam material may be configured to provide a first hardness or stiffness in response to a first force exerted on the foam material and a second hardness or stiffness in response to a second force exerted on the foam material. In some cases, the first force may be less than a threshold force. In some cases, the second force may be greater than the threshold force. In some cases, the threshold force may range from about 800 pounds of force (lbs-force) to about 1200 lbs-force. In some cases, the first hardness or stiffness may be less than the second hardness or stiffness. In other cases, the first hardness or stiffness may be greater than the second hardness or stiffness.

FIGS. 19A and 19B illustrate an exemplary sole assembly 1901 according to various embodiments of the present disclosure. The sole assembly 1901 may comprise a first region 1910, a second region 1920, a third region 1930, a fourth region 1940, and a fifth region 1950. The first region 1910 may be located in a medial forefoot region of the shoe. In some cases, the first region 1910 may correspond to a medial plantar region of the shoe. The second region 1920 may be located in a lateral forefoot region of the shoe. In some cases, the second region 1920 may correspond to a lateral plantar region of the shoe. The third region 1930 may be located in a medial rearfoot region of the shoe. In some cases, the third region 1930 may correspond to a medial tibial region of the shoe. The fourth region 1940 may be located in a lateral rearfoot region of the shoe. In some cases, the fourth region 1940 may correspond to a lateral tibial region of the shoe. The fifth region 1950 may be located in a midfoot region of the shoe. In some cases, the fifth region 1950 may correspond to a shank area of the shoe.

Referring to FIG. 19B, in some embodiments, the sole assembly 1901 may comprise a first zone 1961 having an adaptable material property. In some non-limiting embodiments, the first zone 1961 may correspond to the medial plantar region of the shoe. In some embodiments, the sole assembly 1901 may comprise a second zone 1962. In some non-limiting embodiments, the second zone 1962 may correspond to the lateral plantar region of the shoe and/or the medial tibial region of the shoe. In some non-limiting embodiments, the second zone 1962 may extend across a midfoot region of the shoe between the lateral plantar region and the medial tibial region of the shoe. In some embodiments, the sole assembly 1901 may comprise a third zone 1963. In some non-limiting embodiments, the third zone 1963 may correspond to the lateral tibial region of the shoe. In some embodiments, the sole assembly 1901 may comprise a fourth zone 1964. In some non-limiting embodiments, the fourth zone 1964 may correspond to a midfoot region of the shoe. In some non-limiting embodiments, the fourth zone 1964 may be divided into two or more zones located in or near the midfoot region of the shoe. In some non-limiting embodiments, the two or more zones located in or near the midfoot region of the shoe may be divided by the second zone 1962.

In some embodiments, the first zone 1961 may have an adaptable material property. The adaptable material property may include, for example, a hardness, a softness, a stiffness, a rigidity, and/or a level of cushioning of the material in the first zone 1961. In some embodiments, the second zone 1962 may be relatively stiff compared to the first zone 1961, the third zone 1963, and/or the fourth zone 1964. In some embodiments, the third zone 1963 may be relatively soft compared to the first zone 1961, the second zone 1962, and/or the fourth zone 1964. In some embodiments, the fourth zone 1964 may be configured as a transition zone that divides the sole assembly 1901 into various regions each having different material properties and/or response characteristics.

In some embodiments, the sole assembly 1901 may comprise a custom insert as described elsewhere herein. The custom insert may be tailored to a particular subject's anatomy, swing biomechanics, and/or play style. In some embodiments, the custom insert may be positioned and/or oriented to provide one or more desirable material characteristics or functional benefits to the second zone 1962. In some embodiments, the custom insert may be sized and/or shaped to extend across at least a portion of the second zone 1962. In some embodiments, the custom insert may span or cover the second zone 1962 or at least a portion thereof.

FIG. 20 illustrates an exemplary sole assembly 2001 having the configuration(s) shown in FIGS. 19A and/or 19B. The sole assembly 2001 may have a medial plantar region 2010 that includes a foam material with an adaptable material property. The adaptable material property may include, for example, a hardness, a softness, a stiffness, a rigidity, and/or a level of cushioning of the material. The adaptable material property may change or vary based on a magnitude and/or a direction associated with a force exerted on a portion of the sole assembly 2001 comprising the foam material. In some embodiments, the foam material may be relatively soft for walking and/or running, and relatively firm/stiff for golf-related actions or movements.

Figure 21:
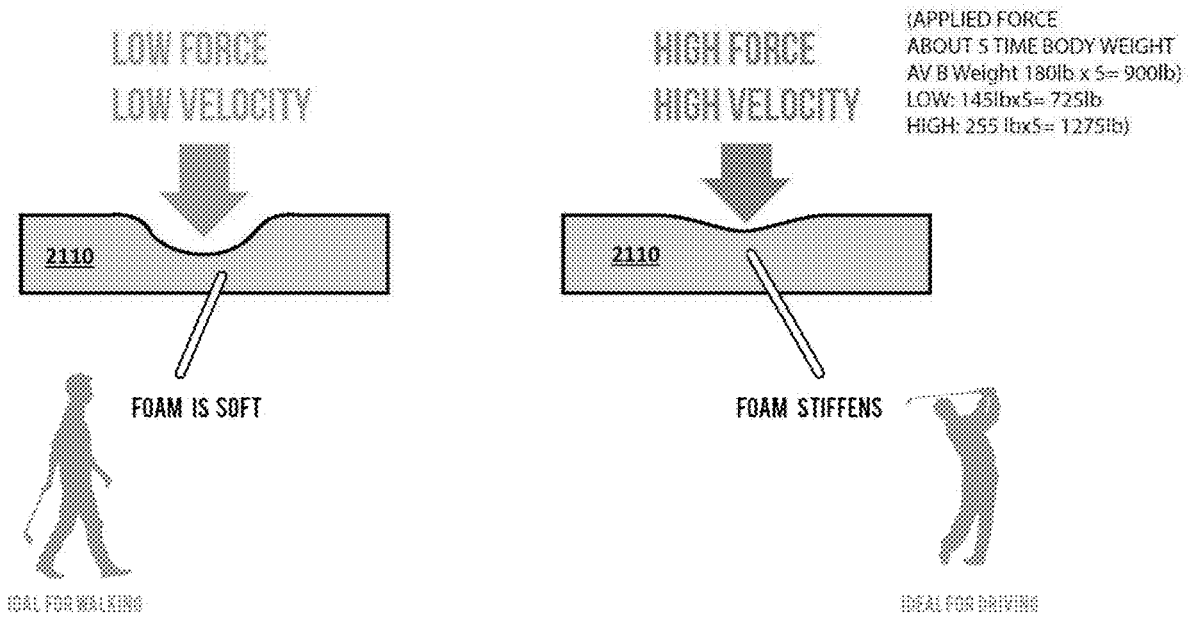
FIG. 21 schematically illustrates an adaptability of the foam material(s) described herein to accommodate both walking and golfing applications.

FIG. 21 illustrates an adaptability of the foam material(s) described elsewhere herein to accommodate both walking/running and golf-related actions or movements. In some non-limiting embodiments, the foam material 2110 may be relatively soft when (i) a first force less than a threshold force is exerted on the foam material and/or (ii) when a subject's foot moves towards or against the foam material at a velocity or acceleration that is less than a threshold velocity or acceleration. In some embodiments, the foam material 2110 may be relatively firm and/or stiff when (i) a second force greater than or equal to a threshold force is exerted on the foam material and/or (ii) when a subject's foot moves towards or against the foam material at a velocity or acceleration that is greater than or equal to a threshold velocity or acceleration. In some embodiments, when the foam material 2110 is relatively soft, the foam material may be better suited for walking and/or running. In some embodiments, when the foam material 2110 is relatively firm and/or stiff, the foam material may be better suited for walking and/or running.

Spring Loaded Structures

In another aspect, the present disclosure provides an article of footwear. In some cases, the article of footwear may comprise a shoe. In some cases, the shoe may include a golf shoe. In some cases, the golf shoe may be optimized to provide a spring effect, an enhanced flex characteristic, and/or a controlled torsional response during various golf-related actions or movements (e.g., walking, running, crouching, swinging a golf club, etc.).

In some cases, the golf shoe may comprise an upper and a sole assembly connected to the upper. In some cases, the sole assembly may comprise a midsole, an outsole, and one or more spring loaded structures integrated with at least one of the midsole or outsole. In some cases, the one or more spring loaded structures may be configured to support a subject's foot. In some cases, the one or more spring loaded structures may be configured as a cushioning and/or suspension system for a subject's foot. In some cases, the one or more spring loaded structures may be configured to provide a spring effect, a force dampening effect, or a shock absorption effect in response to one or more forces exerted on the sole assembly. In some cases, the one or more spring loaded structures may be configured to enhance the flex characteristics of the golf shoe. In some cases, the one or more spring loaded structures may be configured to control a torsional response of the sole assembly in order to aid or facilitate one or more golf-related actions or movements.

In some embodiments, the one or more spring loaded structures may be configured to flex, bend, twist, or rotate as a subject executes one or more golf-related actions or movements. In some embodiments, the one or more spring loaded structures may be configured to flex, bend, twist, or rotate naturally in response to a golfer's swing and/or stride. In some cases, the one or more spring loaded structures may provide one or more suspension, cushioning, and/or flex-related characteristics that can enhance the actual and perceived comfort of the shoe. In some cases, the one or more spring loaded structures may provide one or more suspension-related and/or cushioning-related effects that can complement or supplement the cushioning and/or suspension provided by the midsole compound of the sole assembly. In some embodiments, the one or more spring loaded structures may be configured to compress in response to one or more forces exerted on the sole assembly (e.g., during a golf-related action or movement).

Figure 22A:
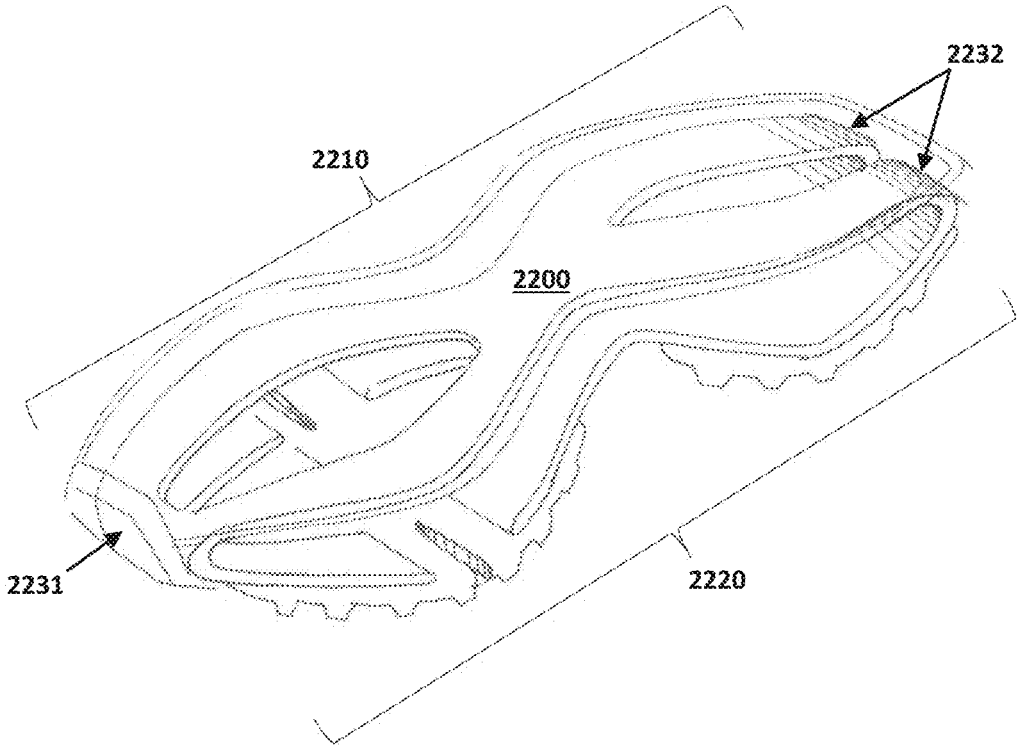
FIGS. 22A-22C schematically illustrate various examples of a spring loaded structure that can be integrated with a sole assembly of a golf shoe, in accordance with some embodiments.

Referring to FIG. 22A, in some cases, the one or more spring loaded structures may comprise an elastic member 2200. In some cases, the elastic member 2200 may be configured to support a subject's foot. In some cases, the elastic member 2200 may be configured to provide a suspension effect for the subject's foot during a golf-related action or movement. In some cases, the elastic member 2200 may be configured to provide a force dampening or shock absorption effect that enhances the actual and perceived comfort of the shoe. In some cases, the elastic member 2200 may be configured to provide an elastic response when one or more forces are exerted on the sole (e.g., during a golf-related action or movement) in order to aid or facilitate a golf-related action or movement. In some cases, the elastic member 2200 may be configured to provide an elastic response in or along one or more directions in three-dimensional space. In some cases, the elastic member 2200 may be configured to provide an elastic response along or about one or more axes in three-dimensional space. In some cases, the elastic member 2200 may be configured to control a position and/or an orientation of a subject's foot during a golf-related action or movement. In some cases, the elastic member 2200 may be configured to control a movement of a subject's foot in response to one or more forces exerted on the sole assembly during a golf-related action or movement.

In some cases, the elastic member 2200 may comprise a molded component. In some cases, the molded component may be formed using one or more resin-based materials. In some cases, the elastic member 2200 may comprise a molded carbon structure or a molded composite structure. In some cases, the molded carbon or composite structure may be formed using one or more resin-based materials. In some cases, the elastic member 2200 may comprise a plurality of composite layers that are attached or coupled together (e.g., by way of a molding process). In some cases, the plurality of composite layers may be layered and molded together to form the elastic member 2200 or a portion thereof Elastic Member Structure In some cases, the elastic member 2200 may comprise a superior portion 2210, an inferior portion 2220, and at least one curved portion extending between the superior portion 2210 and the inferior portion 2220. In some cases, the at least one curved portion may include an anterior curved portion 2231 and/or a posterior curved portion 2232. In some cases, the superior portion 2210 and/or the inferior portion 2220 may be integrally formed with the anterior curved portion 2231 and/or the posterior curved portion 2232.

Superior Portion

Figure 22B:
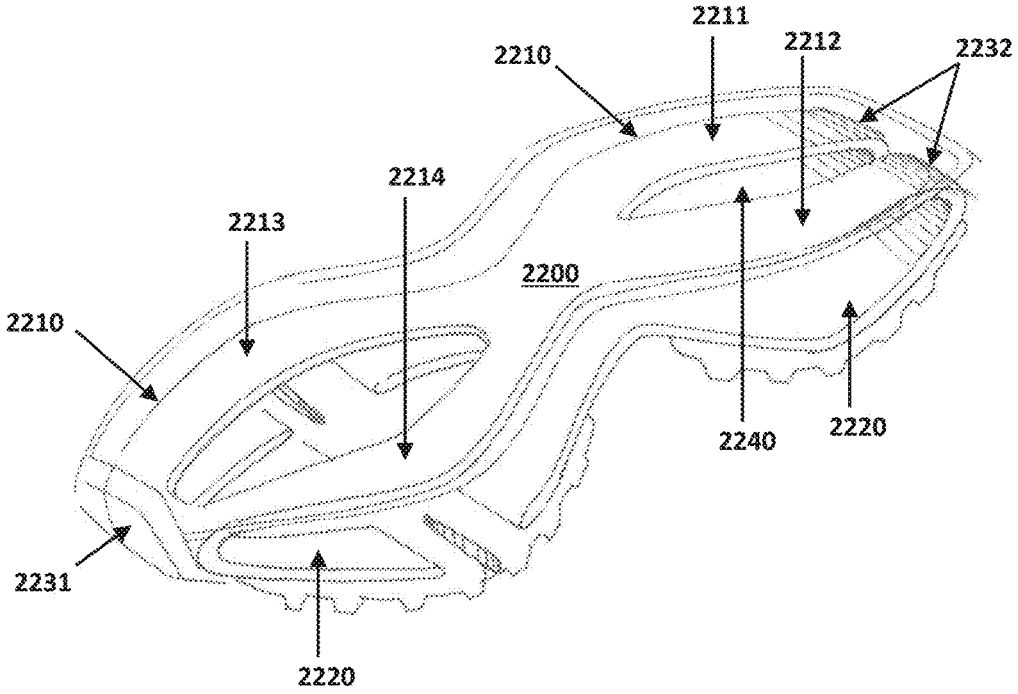

Referring to FIG. 22B, in some cases, the superior portion 2210 may comprise a first member 2211 and a second member 2212 extending from a central region of the elastic member 2200 towards a posterior end of the sole assembly. In some cases, the first and second members 2211, 2212 may be spaced apart with a gap therebetween. In some cases, the first and second members 2211, 2212 may diverge from the central region of the elastic member 2200.

In some cases, the superior portion 2210 may further comprise a third member 2213 and a fourth member 2214 extending from the central region of the elastic member 2200 towards an anterior end of the sole assembly. In some cases, the third member 2213 and the fourth member 2214 may diverge from the central region of the elastic member 2200 and converge at or near the anterior end of the sole assembly.

In some cases, the first member 2211 and the second member 2212 may diverge from a central region of the elastic member 2200. In some cases, the first and second members 2211, 2212 may be spaced apart with a gap 2240 provided therebetween. In some cases, the gap 2240 may be configured to enhance the subject's ability to feel and/or control the amount of torque that is applied to the elastic member during a golf-related action or movement. In some cases, the gap 2240 may be configured to facilitate (i) a movement of the first and second members 2211, 2212 relative to each other or (ii) a movement of the first or second member 2211, 2212 relative to another portion of the elastic member 2200. In some cases, the movement may comprise at least one of a bending motion, a flexing motion, a rotational motion, or a translational motion of the first member 2211 and/or the second member 2212. In some cases, the gap 2240 may be configured to promote bending or flexing of the elastic member 2200 along an axis extending between the first member 2211 and the second member 2212. In some cases, the gap 2240 may be configured to control or modulate a torsional response of one or more select portions of the elastic member 2200 during a golf-related action or movement. In some cases, the one or more select portions may include a portion of the elastic member 2200 that is located in a forefoot, midfoot, and/or a rearfoot region of the sole assembly. In some cases, the one or more select portions may include a portion of the elastic member 2200 that extends between the forefoot region and the rearfoot region of the sole assembly. In some cases, the one or more select portions may include the first and second members 2211, 2212 of the superior portion of the elastic member 2200. In some cases, the one or more select portions may include one or more arms or members of the inferior portion of the elastic member 2200.

Curved Portion

In some embodiments, the elastic member 2200 may comprise at least one curved portion. In some embodiments, the at least one curved portion may comprise an anterior curved portion 2231 extending between an anterior end of the superior portion 2210 and an anterior end of the inferior portion 2220. In some embodiments, the at least one curved portion may comprise at least one posterior curved portion 2232 extending between a posterior end of the superior portion 2210 and a posterior end of the inferior portion 2220. In some cases, the anterior curved portion 2231 and the posterior curved portion 2232 may be integrally formed with the anterior and/or posterior end(s) of the superior portion 2210 and/or the inferior portion 2220.

Inferior Portion

Figure 22C:
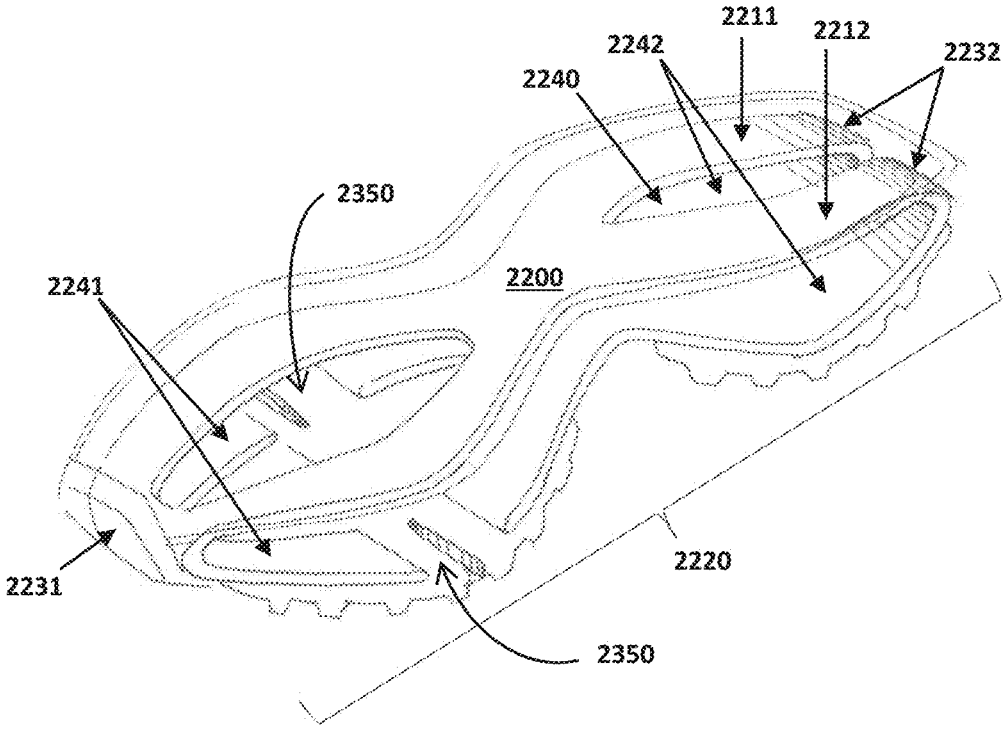

Referring now to FIG. 22C, in some embodiments, the elastic member 2200 may comprise an inferior portion 2220. In some embodiments, the inferior portion 2220 may comprise a first set of arms 2241 extending from the anterior curved portion 2231 towards a break region 2350 located within a forefoot region of the sole assembly. In some embodiments, the first set of arms 2241 may be configured to extend from the break region 2350 and converge towards the anterior curved portion 2231 of the elastic member 2200.

In some embodiments, the inferior portion 2220 may comprise a second set of arms 2242 extending from the at least one posterior curved portion 2232 towards the break region 2350. In some cases, the at least one posterior curved portion 2232 may comprise a first posterior curved portion and a second posterior curved portion connecting (i) the second set of arms 2242 of the inferior portion and (ii) the first and second members 2211, 2212 of the superior portion. In some cases, the first posterior curved portion may connect the first member 2211 of the superior portion and a first arm of the second set of arms 2242 of the inferior portion. In some cases, the second posterior curved portion may connect the second member 2212 of the superior portion and a second arm of the second set of arms 2242 of the inferior portion.

In some embodiments, the first posterior curved portion and the second posterior curved portion may be remotely spaced to maintain the gap 2240 provided between the first and second members 2211, 2212. In some cases, the gap 2240 may extend between the first and second posterior curved portions to divide or separate the posterior ends of both the superior and inferior portions of the elastic member 2200. In some cases, the gap 2240 may be configured to promote bending or flexing of the elastic member 2200 along an axis extending between the first and second posterior curved portions. In some cases, the gap 2240 may be configured to control or modulate a torsional response of the elastic member 2200 during a golf-related action or movement.

Break Region

As shown in FIGS. 22A-22C and FIG. 23, in some embodiments, the elastic member 2200 may include a break region 2350. In some embodiments, the break region 2350 may be configured as a flex region to reduce a bending stiffness and/or a torsional stiffness of the elastic member 2200 in one or more select regions.

In some cases, the break region 2350 may correspond to a portion of the elastic member 2200 where two or more sections or segments of the elastic member are decoupled or disconnected to enhance the flexibility of the elastic member 2200 in one or more select regions. In some cases, the break region 2350 may be configured to extend between the first set of arms 2241 and the second set of arms 2242 to divide or bisect the inferior portion of the elastic member.

In some embodiments, the break region 2350 may provide an axis along which the elastic member 2200 is configured to bend or flex. In some cases, the axis may extend along or across a width of the elastic member 2200. In some cases, the break region 2350 may allow a forefoot region of the shoe or the elastic member to bend or flex relative to a midfoot and/or rearfoot region of the shoe or elastic member (e.g., to aid or facilitate one or more golf-related actions or movements).

Shank Region

Figure 23:
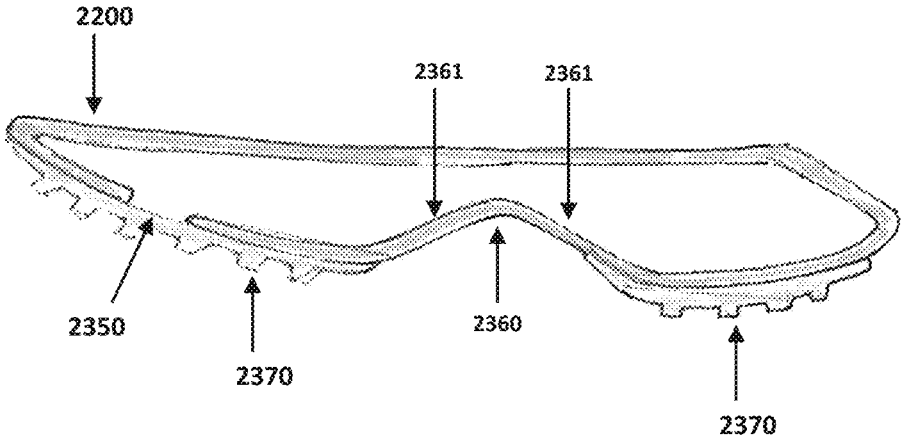
FIG. 23 schematically illustrates a cross-sectional side view of an exemplary spring loaded structure that can be integrated with a sole assembly of a golf shoe.

Referring now to FIG. 23, in some embodiments, the inferior portion of the elastic member 2200 may comprise a shank region 2360 having a U-shaped or V-shaped profile. In some cases, the U-shaped profile may be formed by two or more sides or surfaces 2361 that extend from the inferior portion of the elastic member towards the superior portion of the elastic member to form a concave curvature. In some cases, the V-shaped profile may be formed by two or more sides or surfaces 2361 that extend from the inferior portion of the elastic member towards the superior portion of the elastic member to form a convex angle.

In some embodiments, the U-shaped or V-shaped profile may be configured to provide an elastic response when a force is exerted on the elastic member. In some embodiments, the U-shaped or V-shaped profile may be configured to enhance the spring effect provided by the elastic member in order to aid or facilitate a golf-related action or movement. In some embodiments, the U-shaped or V-shaped profile may provide a forward or upward propulsion effect to aid or enhance a golf-related action or movement. In some embodiments, the U-shaped or V-shaped profile may provide additional support or cushioning for a subject's foot when one or more loads are exerted on the sole assembly. In some embodiments, the U-shaped or V-shaped profile may be configured as a cushioning and/or suspension subsystem that can manage or dampen forces exerted on the sole assembly. In some embodiments, the U-shaped or V-shaped profile may be configured to stop or prevent the shoe or the elastic member from collapsing if the force or pressure exerted on the elastic member exceeds a certain threshold.

Traction Elements

In some embodiments, the shoe may comprise one or more traction elements 2370 that are attached or coupled to the elastic member 2200. In some embodiments, the one or more traction elements 2370 may be integrated with or integrally formed with the elastic member 2200. In some embodiments, the traction elements 2370 may be integrated with or directly attached or coupled to a bottom facing portion of the elastic member 2200. In some cases, the bottom facing portion may correspond to a portion of the elastic member 2200 that faces a ground surface under the shoe. As described elsewhere herein, the one or more traction elements 2370 may comprise, for example, one or more plastic or thermoplastic materials, one or more thermoset materials, one or more rubber or thermoplastic rubber materials, one or more thermoplastic polyurethanes (TPUs), one or more thermoplastic elastomers (TPEs), one or more polyesters, one or more polyethers, and/or one or more polyolefins.

In some cases, the traction elements 2370 may be formed using one or more TPU-based resins. In some cases, the one or more TPU-based resins may be directly injected into or onto a carbon piece or a composite component of the shoe. The carbon or composite piece or component may include a custom insert, a spring loaded structure, or any of the elastic members described herein. In some cases, the one or more TPU-based resins may be in the form of a melted or molten resin that can be flowed and directly injected into or onto the carbon or composite piece or component. In some cases, the melted or molten TPU-based resin can be thermally treated (e.g., cooled to a predetermined temperature range or to ambient temperature) or cured (e.g., using one or more select wavelengths of light or one or more select ranges of wavelengths) to transform the melted or molten TPU-based resin into a solidified resin structure that is in the shape of the one or more traction elements 2370. The solidified resin structure may be directly integrated with and/or integrally formed with the carbon or composite piece or component of the shoe.

In some embodiments, the solidified resin structure forming the one or more traction elements 2370 may be configured to adhere to the carbon or composite piece or component by way of a physical bond and/or a chemical bond. In some cases, the physical bond and/or the chemical bond may be formed during the direct injection process or as a result of the direct injection process. In some cases, the physical bond and/or the chemical bond may be formed during the thermal treatment process or as a result of the thermal treatment process. In some cases, the physical bond and/or the chemical bond may be formed during the curing process or as a result of the curing process.

In some embodiments, a physical bond and/or a chemical bond may be formed between the solidified resin structure and the carbon or composite piece or component. In some cases, the physical or chemical bond may be formed between the solidified resin structure and one or more particles or molecules of the carbon or composite piece or component. In some cases, the physical or chemical bond may be formed between the solidified resin structure and one or more resin-based materials used to form the carbon or composite piece or component. In some cases, the resin-based material(s) used to form the carbon or composite piece or component may include a TPU resin material that can create a physical and/or chemical bond with the solidified resin structure(s), either during or as a result of a direct injection process, a thermal treatment process, or a curing process as described above.

Methods of Manufacture

In another aspect, the present disclosure provides a method for manufacturing a golf shoe comprising a structure embedded in or integrated with a sole assembly of the golf shoe. The structure may be embedded in or integrated with the sole assembly of the golf shoe during a manufacturing process for a midsole and/or a sole assembly of the golf shoe.

The presently disclosed methods may be used to integrate complex three-dimensional (3D) structures that would not otherwise be insertable or embeddable in a sole assembly using traditional molding methods and/or conventional manufacturing or assembly methods. Examples of such 3D structures can include, for example, lattice structures and/or custom inserts as described in detail above. In some cases, the presently disclosed methods may be used to encapsulate additively manufactured parts (e.g., 3D printed parts) during a molding or foaming process. In other cases, the methods of the present disclosure may be used to encapsulate machined parts (or any other parts formed using a subtractive manufacturing process). In some cases, the presently disclosed methods may be used to encapsulate thermoplastic polyurethane (TPU) parts and/or composite parts with various complex shapes, such as those described and referenced elsewhere herein. In some cases, the TPU parts may include, for example, injected TPU plastic parts, molded TPU plastic parts, extruded TPU plastic parts, machined TPU plastic parts, and/or 3D printed TPU plastic parts. In some cases, the composite parts may include, for example, injected composite parts, molded composite parts, extruded composite parts, machined composite parts, and/or 3D printed composite parts.

Traditionally, various different components, parts, sections, or layers of the shoe can be molded separately in order to produce a sole assembly with a structure embedded in or integrated with the midsole or sole assembly of the shoe. The various different components, parts, sections, or layers of the midsole or sole assembly may include, for example, a top portion or layer of the midsole or sole assembly, a middle portion or layer of the midsole or sole assembly, and/or a bottom portion or layer of the midsole or sole assembly. The various different components, parts, sections, or layers of the midsole or sole assembly may optionally include a custom insert or internal structure/endoskeleton that can be embedded in or integrated with the midsole or sole assembly (or any portion thereof). In many cases, each discrete component, part, section, or layer of the midsole or sole assembly may require a specific set of tooling, which can be cumbersome and costly to design, implement, and manage. Further, after molding the various components or parts, the individual components and parts of the midsole or sole assembly still need to be assembled, which can involve additional manufacturing steps that are costly and time intensive and/or labor intensive.

In one aspect, the present disclosure provides a streamlined and efficient method for directly producing a midsole or sole assembly comprising a structure or custom insert that is embedded in or integrated with the midsole or sole assembly. In some cases, the midsole or sole assembly comprising the structure or custom insert can be manufactured in a single molding step and/or using a single mold. The presently disclosed methods for directly producing midsoles or sole assemblies with custom inserts and embedded/integrated structures can be implemented to increase manufacturing capacities of factories and production lines, and facilitate the rapid and efficient production of shoes to meet or exceed product demand and/or production targets within shortened time frames.

In another aspect, the present disclosure provides a method for manufacturing a golf shoe having a structure or custom insert embedded in or integrated with the midsole or sole assembly of the golf shoe. The method may comprise placing the structure or custom insert in a cavity region of a midsole or sole assembly mold and initiating a foaming process. The foaming process may involve flowing a molding agent and/or a foaming agent around at least a portion of the structure or custom insert. The foaming agent may interact with the molding agent to form at least a portion of the midsole or sole assembly of the golf shoe. The portion of the midsole or sole assembly of the golf shoe that is formed using the molding agent and/or the foaming agent may at least partially encapsulate or cover the structure or custom insert placed in the cavity region of the midsole or sole assembly mold prior to the foaming process. In some cases, the portion of the midsole or sole assembly of the golf shoe formed using the molding agent and/or the foaming agent may fully encapsulate or cover the structure or custom insert. In some cases, the structure or custom insert may be fully embedded in or at least partially integrated with the foam material that is produced during the foaming process.

The methods of the present disclosure address several disadvantages associated with conventional golf shoe fabrication methods, which utilize traditional molds (e.g., for EVA foams) that are designed at a smaller size to account for the expansion of the foam material during the foaming process. Unlike other conventional methods (which require waiting for the EVA to fully expand before integrating an insert with the EVA material, making it infeasible or impractical to insert a 1:1 scale insert in a smaller size mold), the methods of the present disclosure can leverage the capabilities of 1:1 scale molding to enable a manufacturing process in which a true to size structure or custom insert can be placed in a 1:1 scale midsole or sole assembly mold to directly produce a golf shoe with a midsole or sole assembly having an appropriately sized and shaped structure or custom insert. The midsole or sole assembly having the structure or custom insert may be produced in a single molding process. As described elsewhere herein, the molding process may involve flowing a molding agent and/or a foaming agent around at least a portion of the structure or custom insert to at least partially cover or encapsulate the structure or custom insert. The presently disclosed methods for manufacturing golf shoes may be implemented to fabricate custom inserts that are not achievable with traditional EVA foaming processes (including the insert designs described herein). The presently disclosed methods for manufacturing golf shoes may also enable cost-effective manufacturing of shoes with custom inserts, and minimize tooling expenses compared to traditional stock fit assembly methods, since the present methods can be used to produce a final part (e.g., a midsole or sole assembly with a structure or custom insert) directly from a single mold, without any post molding manufacturing operation to stock fit the parts together.

In another aspect, the present disclosure provides a method for manufacturing a golf shoe. The method may comprise providing a 1:1 scale mold. As used herein, a 1:1 scale mold may comprise a mold that is configured to produce a foam material corresponding in size and shape to a cavity of the mold. The size and shape of the mold cavity may correspond to the final size and shape of the foam material. In some cases, the shape of the foam material and the shape of the mold cavity may comprise similar shapes. In some cases, a difference or variation in a corresponding dimension of the foam material and a corresponding dimension of the mold cavity may be within about 10% or less.

In some embodiments, the method may further comprise providing a structure (e.g., a custom insert or an endoskeleton) in a midsole or sole assembly mold. In some cases, the structure may be fixed or secured at a predetermined distance from a surface of the mold cavity so that the structure "floats" inside the mold. In some cases, the structure may be fixed or coupled to the mold using positioning pins. The positioning pins may be disposed on the structure itself. Alternatively, the positioning pins may be disposed on a surface of the mold. In some cases, the structure may be fixed or coupled to one or more features of the mold. The one or more features may include, for example, a sidewall of the mold (or any other structural component or feature of the mold or mold cavity).

In some embodiments, the method may involve providing a molding agent and/or a foaming agent to the mold. The method may involve providing the molding agent and/or the foaming agent according to one or more molding parameters. The molding agent and/or the foaming agent may flow around and encapsulate the structure to form a foam material surrounding the structure.

In some embodiments, the method may comprise controlling an operation of a molding machine or a molding system to create a molded midsole or sole assembly having an internal structure or custom insert embedded therein. The operation of the molding machine or molding system may be controlled by adjusting the one or more molding parameters referenced above. In some non-limiting embodiments, the one or more molding parameters may comprise various operational parameters that can be adjusted to control a molding processing. The molding parameters may include, for example, a flow rate of the molding agent or the foaming agent, a flow direction of the molding agent or the foaming agent relative to the internal structure or custom insert, or a flow pattern of the molding agent or foaming agent throughout the mold cavity. In any of the embodiments described herein, the various molding parameters may be controlled using a processing unit (e.g., a computer, a processor, a logic circuit, etc.). The processing unit may be configured to control or adjust an operation of the molding machine or molding system based on the one or more molding parameters. In some cases, the one or more molding parameters may be set by an operator of the molding machine or molding system. In other cases, the one or more molding parameters may be set by an algorithm or an artificial intelligence or machine learning based system.

In some embodiments, one or more nozzles may be used to provide the molding agent and/or the foaming agent. In some embodiments, the one or more nozzles providing the molding agent and/or the foaming agent may be configured to spray or inject the molding agent and/or the foaming agent into one or more target regions in a cavity of the mold. In other embodiments, the one or more nozzles providing the molding agent and/or the foaming agent may be configured to pour the molding agent and/or the foaming agent into one or more target regions in a cavity of the mold (e.g., in cases where the midsole is created using a polymeric material such as polyurethane, which can be flowed into the mold cavity). In any of the embodiments described herein, the position and/or the orientation of the nozzles may be controlled or modulated using a drive unit (e.g., a motor) and/or based on one or more inputs from an operator controlling the operation of the one or more nozzles or any other computer or machinery operatively coupled to the one or more nozzles.

In some embodiments, the method may involve molding the midsole or sole assembly around the structure provided within the mold. In some cases, the molding may comprise, for example, injection molding or compression molding. In some cases, the molding may involve concurrently (i) forming a foam material in the size and shape of a midsole or sole assembly and (ii) integrating or embedding the structure in or with the foam material.

In some embodiments, the molding agent and/or the foaming agent may be provided to the mold by way of a single shot operation (e.g., a single shot injection) or a multi-shot operation (e.g., a multi shot injection). In some embodiments, the molding agent and/or the foaming agent may be poured or flowed into the mold. In some embodiments, the molding agent and/or the foaming agent may be injected into a single location or region in the mold. In other embodiments, the molding agent and/or the foaming agent may be injected into multiple locations or regions in the mold. In some cases, the molding agent and/or the foaming agent may be injected into the multiple locations or regions in the mold simultaneously or concurrently. In other cases, the molding agent and/or the foaming agent may be injected into multiple locations or regions in the mold in series or in succession.

In any of the embodiments described herein, the sole material formed by the molding agent and/or the foaming agent may have a plurality of regions with different material properties. In some embodiments, the different material properties may include, for example, a hardness, a softness, a stiffness (e.g., flexural stiffness or torsional stiffness), a rigidity, a tensile strength, or any of the other material properties described herein. In some non-limiting embodiments, a hardness, stiffness, or tensile strength of the sole material may gradually change or vary across a dimension of the sole material. The dimension of the sole material may include, for example, a length, a width, and/or a depth of the sole material.

In another aspect, the present disclosure provides a method for manufacturing a sole assembly with an internal structure or custom insert. The method may comprise providing a mold for producing a midsole or a sole assembly. The mold may comprise any of the characteristics or features described herein with respect to molds.

In some embodiments, the method may further comprise securing the internal structure or custom insert to the mold or a surface feature of the mold. The internal structure or custom insert may be secured to the mold using various surface features (e.g., guide pins, positioning pins, protrusions, depressions, etc.) or by way of a snap fit or form fit attachment. The securing of the internal structure or custom insert to the mold may involve fixing the position and orientation of the internal structure or custom insert to facilitate the embedding or encapsulation of the internal structure/custom insert within a foam material.

In some embodiments, the method may further comprise providing a composition comprising a molding agent and a foaming agent to the mold to produce the midsole or sole assembly with the internal structure or custom insert at least partially embedded therein. In some cases, the midsole or sole assembly with the internal structure or custom insert at least partially embedded therein may be produced or fabricated in a single manufacturing step. The single manufacturing step may comprise a manufacturing step that can be performed using a single mold. The single mold may comprise, for example, a 1:1 scale mold as described elsewhere herein.

In some cases, providing the composition comprising the molding agent and the foaming agent to the mold may involve flowing the composition around the internal structure or custom insert to surround or encapsulate the internal structure or custom insert. Flowing the composition around the internal structure or custom insert may involve flowing the composition towards one or more sides or surfaces of the internal structure or custom insert. The angle at which various particles of the composition impinge or impact the side(s) or surface(s) of the internal structure or custom insert may range from 0 degrees to about 90 degrees or more.

In some cases, flowing the composition around the internal structure or custom insert may involve flowing the composition towards a plurality of sides or surfaces of the internal structure or custom insert simultaneously. In some cases, the composition may be flowed towards (i) a first side or surface at a first angle and (ii) a second side or surface at a second angle. In some cases, the first side or surface and the second side or surface may be adjacent to one another. In other cases, the first side or surface and the second side or surface may be located apart or remote from each other. In some cases, the first angle may be the same as the second angle. In other cases, the first angle and the second angle may be different.

In some cases, flowing the composition around the internal structure or custom insert may involve flowing the composition towards a plurality of sides or surfaces of the internal structure or custom insert sequentially. In some cases, the composition may be flowed towards (i) a first side or surface at a first time instance and (ii) a second side or surface at a second time instance. In some cases, the first side or surface and the second side or surface may be adjacent to one another. In other cases, the first side or surface and the second side or surface may be located apart or remote from each other.

In any of the embodiments described herein, surrounding or encapsulating the internal structure or custom insert with the composition comprising the molding agent and the foaming agent may result in a foaming process that occurs around the internal structure or custom insert and within the mold for the midsole or the sole assembly. The foaming process may produce a foam material from the molding agent. The foam material may form at least a portion of the midsole or sole assembly. The portion of the midsole or sole assembly that is formed from the foam material may comprise a size and a shape that is complementary to a size and a shape of any of the internal structures or custom inserts described herein. The portion of the midsole or sole assembly that is formed from the foam material may surround or encapsulate the internal structures/custom inserts of the present disclosure, either partially or entirely.

In some cases, the foaming process may produce the foam material from the molding agent. In some cases, the foaming agent may interact (physically and/or chemically) with the molding agent to produce a foam material comprising one or more cells or cell structures. In some cases, the mold used to receive the composition comprising the molding agent and the foaming agent may be configured to release or vent any pressure buildup that may occur as a result of the foaming process, to ensure that the size and shape of the resulting foam material corresponds to the size and shape of the mold or mold cavity.

In any of the embodiments described herein, producing the midsole or the sole assembly may not or need not involve expanding the composition or the molding agent in the mold. As described above, the mold may be configured to release or vent pressure buildup during the foaming process to ensure that the size and shape of the resulting foam material corresponds to the size and shape of the mold or mold cavity. Utilizing the molds having the features described herein may allow manufacturers to utilize true to size inserts during a 1:1 scale molding operation, which can greatly simplify and accelerate the process of creating a midsole having a properly sized and shaped structure embedded therein. In any of the embodiments described herein, the midsole or sole assembly having the embedded or integrated internal structure/custom insert can be produced using a single mold, and without any post molding manufacturing operation to embed or integrate the internal structure/custom insert with the midsole or sole assembly.

In another aspect, the present disclosure provides a method for constructing the golf shoes of the present disclosure. In some embodiments, the method may comprise constructing an upper. In some cases, the upper may comprise an insole or an insole component as described elsewhere herein. In some cases, various parts or components may be stitched, glued, or otherwise attached together to form the upper. In some embodiments, a footbed of the upper may be positioned above an insole board of the upper. In some embodiments, the insole board may be positioned between the footbed and the midsole of the shoe. In some embodiments, the upper may be connected or fused to the midsole using a cement assembly process.

In some embodiments, the method may comprise constructing a sole assembly. In some cases, the sole assembly may comprise a midsole and/or an outsole. In some cases, at least one of the midsole or the sole assembly may comprise an internal structure or custom insert that is integrated with or embedded in the midsole or sole assembly.

In some non-limiting embodiments, the internal structure or custom insert may be integrated with or embedded in the midsole or the sole assembly by way of a stock fitting process. In some cases, the stock fitting process may involve a manual integration of the internal structure or custom insert with the midsole and/or sole assembly. In other cases, the stock fitting process may involve an automated or semi-automated integration of the internal structure with the midsole and/or sole assembly. In some embodiments, the stock fitting process may involve coupling the internal structure or custom insert to the midsole and/or sole assembly using one or more adhesives.

In some non-limiting embodiments, the various components, sections, layers, or portions of the golf shoe may be assembled by way of a stocking fitting process. For example, the custom inserts or internal structures described herein can be manufactured and stock fit with a midsole and/or sole assembly to produce a final part (e.g., a target shoe having a sole assembly with a structure or custom insert that is optimized for a particular subject's anatomy and/or swing biomechanics).

In some embodiments, the internal structure or custom insert may be integrated with or embedded in the midsole or the sole assembly by (1) placing the internal structure or custom insert in a cavity of a mold corresponding to the midsole or the sole assembly and (2) flowing a molding agent and a foaming agent around the internal structure or custom insert to encapsulate the internal structure or custom insert in a foam material that is produced from an interaction between the molding agent and the foaming agent. In some cases, the interaction may comprise a foaming process that produces one or more cells or cell structures that impart various favorable properties to the foam material (e.g., to enhance stability or traction for golf-related actions or movements). In some embodiments, the method may involve venting or releasing a pressure build up that occurs during the foaming process, to ensure that (i) the resulting foam material corresponds to a size and a shape of the mold, and (ii) the internal structure or custom insert placed in the mold is properly sized for the foam midsole or sole assembly that is produced in the mold.

In some embodiments, at least a portion of the sole assembly may comprise two or more distinct parts that are formed and integrated together in a single molding step. The two or more distinct parts may include, for example, a foam material forming a portion of the midsole, a foam material forming a portion of the sole assembly, and/or an internal structure or custom insert to be embedded in the foam material forming a portion of the midsole or the sole assembly. In some cases, the two or more distinct parts may comprise parts that have different material properties. In some cases, the two or more distinct parts may comprise parts that are made of different materials and/or made at different times or using different processes. In any of the embodiments described herein, the internal structure or custom insert may be fabricated first before being placed in a mold corresponding to the midsole or the sole assembly in order to produce the midsole or the sole assembly with the integrated or embedded internal structure/custom insert. In any of the embodiments described herein, the integration or embedding of the internal structure or custom insert in or with the midsole or the sole assembly may occur in a single molding step in which the foam material of the midsole or the sole assembly is also created concurrently or in parallel.

In some embodiments, constructing the shoe may comprise attaching the insole footbed or the insole board to the midsole or the upper. In some embodiments, the insole board may be bonded to the top surface of the midsole. In some cases, portions of the insole (e.g., a lasting board or an insole board) may be attached or otherwise fixed or coupled to a portion of the upper using a lasting process (e.g., a single lasting process or a double lasting process), a Strobel construction method, and/or a gasket hotmelt.

In some embodiments, the method may comprise assembling an outsole to the midsole. In some cases, at least a portion or a section of the bottom surface of the midsole may be bonded to a top surface of the outsole (e.g., using adhesives, glues, cements, fasteners, or any other attachment mechanisms or techniques).

In some embodiments, the method may comprise attaching the sole assembly to the upper.

In some cases, prior to attachment to the sole assembly, the upper may be pulled onto a last, and a lasting board may be attached to the upper with an adhesive. The lasting board may then be attached to the sole assembly (e.g., with an adhesive, glue, or cement) to form the golf shoe.

In some alternative embodiments, the method may comprise attaching a material onto an open bottom of the upper, effectively closing off the open bottom of the upper to create a sock-like construction. In some embodiments, the method may further comprise attaching a portion of the upper (e.g., the insole footbed or the insole board) to a portion or a component of the sole assembly (e.g., the midsole and/or the outsole) to form the golf shoe. In some non-limiting embodiments, the midsole may include a custom insert or internal structure as described elsewhere herein.

In any of the embodiments described herein, the resulting sole assembly may provide an optimal combination of support, structural rigidity, stability, and flex characteristics. For example, a shoe with a sole assembly comprising the custom inserts or internal structures described herein may provide the golfer with a comfortable and stable platform that supports the golfer's feet during a golf-related action or movement while retaining an optimal or desired stiffness and/or flex characteristic.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present technology.

It also should be understood the terms, "first", "second", "third", "fourth", "fifth", "sixth", "seventh", "eight", "ninth", "tenth", "eleventh", "twelfth", "top", "bottom", "upper", "lower", "upwardly", "downwardly", "right", "left", "center", "middle", "proximal", "distal", "anterior", "posterior", "forefoot", "midfoot", and "rearfoot", and the like are relative terms used to refer to one position of an element based on one perspective and should not be construed as limiting the scope of the technology.

All patents, publications, test procedures, and other references cited herein, including priority documents, are fully incorporated by reference to the extent such disclosure is not inconsistent with this technology and for all jurisdictions in which such incorporation is permitted. It is understood that the shoe materials, designs, constructions, and structures; shoe components; and shoe assemblies and sub-assemblies described and illustrated herein represent only some embodiments of the technology. It is appreciated by those skilled in the art that various changes and additions can be made to such products and materials without departing from the spirit and scope of this invention. It is intended that all such embodiments be covered by the appended claims.

What is claimed is:

1. A golf shoe, comprising:

an upper; and a sole assembly connected to the upper, the sole assembly comprising:

a midsole;

an outsole; and an elastic member integrated with at least one of the midsole or outsole, wherein the elastic member comprises a superior portion, an inferior portion, and at least one curved portion extending between the superior portion and the inferior portion, wherein the superior portion of the elastic member comprises:

(i) a first member and a second member extending towards a posterior end of the sole assembly, wherein the first and second members are spaced apart with a gap therebetween to facilitate a movement of the first and second members relative to each other or a movement of the first or second member relative to another portion of the elastic member, and (ii) a third member and a fourth member extending towards an anterior end of the sole assembly, wherein the third member and the fourth member converge at or near the anterior end of the sole assembly, and wherein the inferior portion of the elastic member comprises (i) a first set of arms extending across a forefoot region of the sole assembly and (ii) a second set of arms extending from a rearfoot region of the sole assembly and across a midfoot region of the sole assembly to the forefoot region of the sole assembly, wherein the second set of arms is configured to extend upwards towards a central portion of the superior portion of the elastic member to form a U-shaped or V-shaped profile that enhances an elastic response of the midfoot region of the sole assembly.

2. The golf shoe of claim 1, wherein the gap is configured to promote flexing of the elastic member along an axis extending between the first member and the second member.

3. The golf shoe of claim 1, wherein the gap is configured to provide a controlled torsional response for the elastic member during a golf swing.

4. The golf shoe of claim 1, wherein the at least one curved portion comprises an anterior curved portion extending between an anterior end of the superior portion and an anterior end of the inferior portion.

5. The golf shoe of claim 4, wherein the at least one curved portion further comprises at least one posterior curved portion extending between a posterior end of the superior portion and a posterior end of the inferior portion.

6. The golf shoe of claim 5, wherein the superior portion and the inferior portion are integrally formed with the anterior curved portion and the at least one posterior curved portion.

7. The golf shoe of claim 5, wherein the first set of arms is configured to extend from the anterior curved portion towards a break region located within the forefoot region of the sole assembly.

8. The golf shoe of claim 7, wherein the first set of arms is configured to converge towards the anterior curved portion of the elastic member.

9. The golf shoe of claim 7, wherein the second set of arms is configured to extend from the at least one posterior curved portion towards the break region.

10. The golf shoe of claim 9, wherein the at least one posterior curved portion comprises a first posterior curved portion and a second posterior curved portion connecting (i) the second set of arms of the inferior portion and (ii) the first and second members of the superior portion.

11. The golf shoe of claim 10, wherein the first posterior curved portion and the second posterior curved portion are remotely spaced to maintain the gap between the first and second members.

12. The golf shoe of claim 11, wherein the gap extends between the first and second posterior curved portions to divide and separate the posterior ends of both the superior and inferior portions of the elastic member.

13. The golf shoe of claim 7, wherein the break region is disposed between the first set of arms and the second set of arms to divide or bisect the inferior portion of the elastic member.

14. The golf shoe of claim 7, wherein the break region provides an axis along which the elastic member is configured to bend or flex.

15. The golf shoe of claim 1, wherein the U-shaped or V-shaped profile forms a shank region of the inferior portion of the elastic member.

16. The golf shoe of claim 15, wherein the U-shaped profile is formed by two or more sides or surfaces of the inferior portion that extend towards the superior portion of the elastic member to form a concave curvature.

17. The golf shoe of claim 15, wherein the V-shaped profile is formed by two or more sides or surfaces of the inferior portion that extend towards the superior portion of the elastic member to form a convex angle.

18. The golf shoe of claim 1, wherein the elastic member comprises a molded carbon or composite component with one or more curved fibers or strands.

19. The golf shoe of claim 1, wherein the inferior portion of the elastic member comprises a break region disposed entirely within the forefoot region of the sole assembly.

20. The golf shoe of claim 1, wherein the second set of arms comprises a first arm and a second arm that are detached or decoupled from each other.

* * * * *